US005425481A

United States Patent [19]

Makie et al.

[11] Patent Number: 5,425,481

[45] Date of Patent: Jun. 20, 1995

[54] TONER CARTRIDGE

[75] Inventors: Ikuo Makie; Toshiaki Kusuda; Eiji Okamoto; Yoshihisa Tanaka; Kazuya Kamidaira, all of Osaka, Japan

[73] Assignee: Mita Industrial Co., Ltd., Japan

[21] Appl. No.: 111,375

[22] Filed: Aug. 24, 1993

[30] Foreign Application Priority Data

| | | | |
|---|---|---|---|
| Aug. 25, 1992 | [JP] | Japan | 4-226173 |
| Aug. 25, 1992 | [JP] | Japan | 4-226174 |
| Aug. 25, 1992 | [JP] | Japan | 4-226175 |
| Mar. 5, 1993 | [JP] | Japan | 5-045093 |

[51] Int. Cl.[6] ..... B65D 25/38

[52] U.S. Cl. ..... 222/160; 222/325; 222/541; 222/DIG. 1; 141/364; 141/351; 206/455

[58] Field of Search ..... 222/325, DIG. 1, 541, 222/504, 160; 206/455; 141/351-354, 363, 364, 365, 366, 375; 355/215, 260

[56] References Cited

U.S. PATENT DOCUMENTS

| | | | |
|---|---|---|---|
| 4,799,608 | 1/1989 | Oka | 222/541 X |
| 4,834,246 | 5/1989 | Inoue et al. | 206/631 |
| 4,895,104 | 1/1990 | Yoshino et al. | 355/260 X |
| 4,969,557 | 11/1990 | Oka | 222/DIG. 1 X |
| 5,018,560 | 5/1991 | Tsukamoto | 355/260 X |
| 5,030,998 | 7/1991 | Shibata et al. | 355/260 |
| 5,077,584 | 12/1991 | Tanaka et al. | 222/DIG. 1 X |
| 5,142,335 | 8/1992 | Sakata et al. | 222/DIG. 1 X |
| 5,175,587 | 12/1992 | Kato et al. | 222/DIG. 1 X |
| 5,194,900 | 3/1993 | Hagihara et al. | 355/260 |
| 5,260,749 | 11/1993 | Yahata | 222/DIG. 1 |
| 5,261,568 | 11/1993 | Corby et al. | 222/325 X |
| 5,329,340 | 7/1994 | Fukuchi et al. | 222/DIG. 1 X |

FOREIGN PATENT DOCUMENTS

| | | |
|---|---|---|
| 4134997 | 4/1992 | Germany . |
| 3-56951 | 5/1991 | Japan . |
| 3-86371 | 8/1991 | Japan . |

*Primary Examiner*—Andres Kashnikow
*Assistant Examiner*—Lisa Douglas
*Attorney, Agent, or Firm*—Beveridge, DeGrandi, Weilacher & Young

[57] ABSTRACT

A toner cartridge is extractably set in a storing recess of an image forming apparatus main body, and toner is supplemented to a specified part of the image forming apparatus main body. While the toner cartridge is brand-new, an inner seal member peelably adhered to the lower surface of the toner cartridge main body seals the toner dropping opening at the lower surface. After setting the toner cartridge in the storing recess, by peeling off and taking up the inner seal member by the take-up shaft, the toner dropping opening is unsealed. An outer seal member provided slidably along the lower surface of the toner cartridge main body opens or closes the toner dropping opening beneath the inner seal member. When the toner cartridge is drawn out from the storing recess, an outer seal member operating member becomes engaged with an engaging part of the image forming apparatus main body, thereby automatically closing the outer seal member.

59 Claims, 50 Drawing Sheets

TONER CARTRIDGE

BACKGROUND OF THE INVENTION

1. Field of the Invention

The present invention relates to a toner cartridge and a toner refilling device for refilling a developing device with toner in an image forming apparatus such as electrostatic copier and facsimile apparatus.

2. Description of the Prior Art

A toner cartridge generally comprises a storing case having a toner dropping opening in the lower surface and containing toner inside, and a sheet-form seal member closing the toner dropping opening being peelably adhered to the lower surface of the storing case.

The toner cartridge is inserted and set in the storing recess of the image forming apparatus main body, and the seal member is peeled off. As a result, the toner dropping opening is opened, and the toner in the storing case drops in to refill the developing device of the image forming apparatus disposed beneath the storing case.

When the toner in the developing device is spent up, the toner cartridge is drawn out of the storing recess, and a new toner cartridge is set in the storing recess, so that the used toner cartridge may be replaced with a new one.

In the storing case of the spent toner cartridge, however, a slight amount of toner is left over, including the toner depositing on the seal member. Therefore, when drawing out the spent toner cartridge from the storing recess, the remaining toner drops from the toner dropping opening, and the dropping toner scatters about inside and outside the image forming apparatus main body.

To avoid this, it is proposed to use a toner cartridge provided with a slit for inserting the seal member in when stripping off seal member (Japanese Laid-open Utility Model Hei. 3-86371). In this toner cartridge, when the seal member passes through the slit, the toner depositing on the upper surface of the seal member is scraped off by the slit. In this toner cartridge, however, since the slit itself is opened to the outside, when drawing out the spent toner cartridge from the storing recess, the toner depositing on the slip drops and scatters.

Other toner cartridge has been presented (Japanese Laid-open Utility Model Hei. 3-56951), in which a cleaning compartment is provided adjacently to the end of the storing case, and a cleaning roller for cleaning the toner depositing on the upper surface of the seal member when peeling off the seal member is provided in this cleaning compartment. In this toner cartridge, same as in the toner cartridge disclosed in the Japanese Laid-open Utility Model Hei. 3-86371, when drawing out the spent toner cartridge, the toner depositing on the slit may scatter.

In a different toner cartridge hitherto presented, before drawing out the spent toner cartridge, a plate-form shutter member is inserted into the storing recess of the image forming apparatus main body along the lower surface of the toner cartridge, and the toner cartridge is drawn out in a state of preventing dropping of toner by the shutter member. When replacing the toner cartridge, however, the shutter member must be inserted, and it took time and labor in replacing.

The toner scatters away from the toner cartridge also when, aside from the case of drawing out the spent toner cartridge as mentioned above, the seal member is peeled off by mistake if a new toner cartridge is not set correctly in the storing recess of the image forming apparatus main body.

SUMMARY OF THE INVENTION

It is hence a first object of the invention to present a toner cartridge capable of securely preventing scatter of toner when replacing, and replacing easily.

It is a second object of the invention to present a toner refilling device capable of preventing the toner cartridge from being opened unexpectedly, and preventing toner scattering securely.

To achieve the first object, one aspect of the invention presents a toner cartridge having a toner cartridge main body with a toner dropping opening, and detachably set in a storing recess of an image forming apparatus main body comprising:

an inner seal member in a sheet form for closing said toner dropping opening as being peelably attached to the lower surface of said toner cartridge main body, take-up means for releasing the toner dropping opening by taking up while peeling said inner seal member when required, an outer seal member in a sheet form capable of opening and closing the toner dropping opening beneath said inner seal member, as being slidably provided along the lower surface of said toner cartridge main body, and outer seal member operating means being provided so as to be engaged with engaging means of the image forming apparatus main body, so as to automatically close said outer seal member when said toner cartridge main body is drawn out from the storing recess in the state of being engaged with the engaging member.

According to this toner cartridge, when the toner cartridge is spent and drawn out from the storing recess of the image forming apparatus main body, the outer seal is automatically closed by the outer seal member operating means. Therefore, when drawing out the spent toner cartridge, the toner does not scatter. Besides, since the outer seal is automatically closed, the replacement work of toner cartridge is very easy.

In other preferred aspect, said outer seal member operating means comprises a slide member which crosses said toner dropping opening in a state of fixing one end of said outer seal, and is movable along the lower surface of the toner cartridge main body. This slide member is arrested of its relative move to the image forming apparatus main body when the toner cartridge main body is drawn out from the storing recess in the state of being engaged with the engaging means of the image forming apparatus main body. As a result, when drawing out the toner cartridge main body, the slide member relatively moves to the toner cartridge main body, and releases the outer seal.

To achieve the second object, other aspect of the invention presents a toner refilling device for refilling a predetermined part of an image forming apparatus main body with toner, by a toner cartridge containing toner, being detachably set in a storing recess of the image forming apparatus main body, comprising:

a toner cartridge main body containing toner and forming a dropper dropping opening in the lower surface, a seal member in a sheet form for closing said toner dropping opening as being peelably adhered to the lower surface of said toner cartridge main body, take-up means provided inside said toner cartridge main body for releasing said toner dropping opening by taking up while peeling said seal member when required, driving force transmitting means containing a drive coupling part that can be coupled with an external driving member for transmitting the driving force of the driving member to said take-up means, and route cut-off means for usually cutting off the driving force transmitting route from the driving member to the take-up means through said driving force transmitting means, and connecting only when the toner cartridge is set in the storing recess.

According to this toner refilling device, only when the toner cartridge is set in the storing recess, the driving force transmitting route from the driving member to the take-up means is connected, and while the toner cartridge is not set, the driving force transmitting route is cut off by the route cut-off means. Therefore, when the toner cartridge is not set, the take-up means cannot be driven, thereby avoiding unnecessary peeling of the seal member, so that scatter of toner may be prevented.

DETAILED DESCRIPTION OF THE PREFERRED EMBODIMENTS

Referring now to the accompanying drawings, some of the preferred embodiments of the invention are described in detail below.

Embodiment 1

The first embodiment of the invention is described below by reference to FIG. 1 through FIG. 23.

General Outline Structure

Figure 1A:
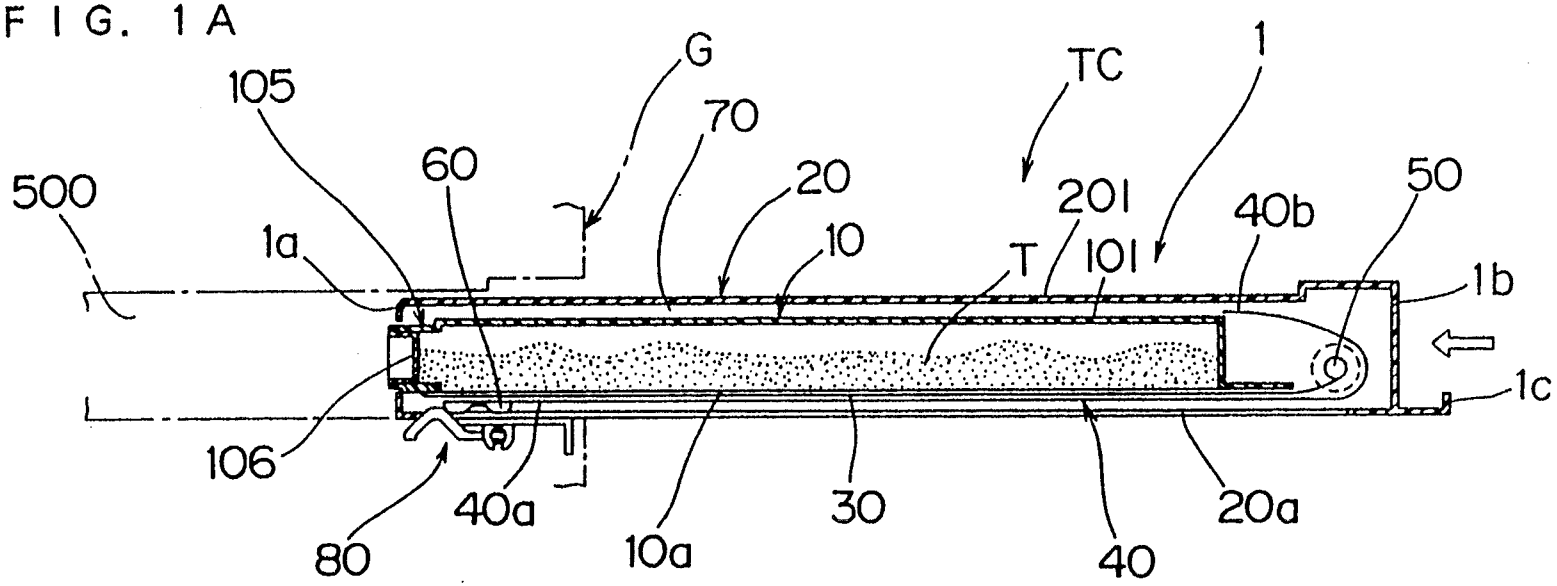
FIG. 1A and FIG. 1B are schematic sectional views sequentially showing the steps of mounting of a toner cartridge on the storing recess of an image forming apparatus main body in a first embodiment of the invention.

FIG. 1A shows the state of introduction of front end of a toner cartridge TC into a storing recess 500 provided in an image forming apparatus main body G. Referring to FIG. 1A, this toner cartridge TC comprises i) a toner cartridge main body 1 of double container type consisting of an inner container 10 containing toner T, and an outer container 20 containing the inner container 10, ii) toner dropping openings 10*a*, 20*a* formed respectively in the inner container 10 and outer container 20, iii) an inner seal member 30 in sheet form for covering the toner dropping opening 10*a* of the inner container 10, being peelably adhered to the lower surface of the inner container 10, iv) an outer seal member 40 in sheet form for opening and closing the toner dropping opening 20*a* of the outer container, v) a take-up shaft 50 as take-up means for taking up the inner seal member 30 while peeling off from the inner container 10 as shown in FIG. 2B as required, and vi) a slide member 60 for presenting outer seal member operating means for opening and closing the toner dropping opening 20*a* of the outer container 30 by the outer seal member 40, by sliding along the lower surface of the outer container 20, with one end of the outer seal member 40 in fixed state.

Figure 24:
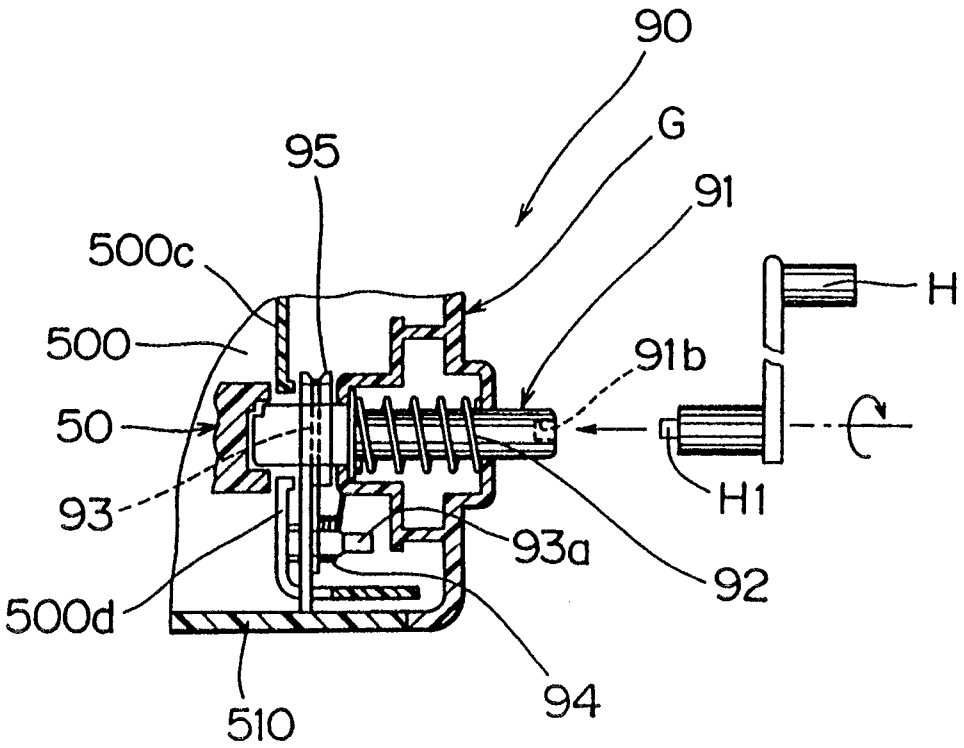
FIG. 24 is a schematic sectional view of the driving force transmitting mechanism showing the state of the drive coupling shaft coupled with the take-up shaft.

The take-up shaft 50 is designed to be driven by a hand-turning handle H as external driving member, through a drive force transmitting mechanism 90 provided in the image forming apparatus main body G as shown in FIG. 24.

Figure 1B:
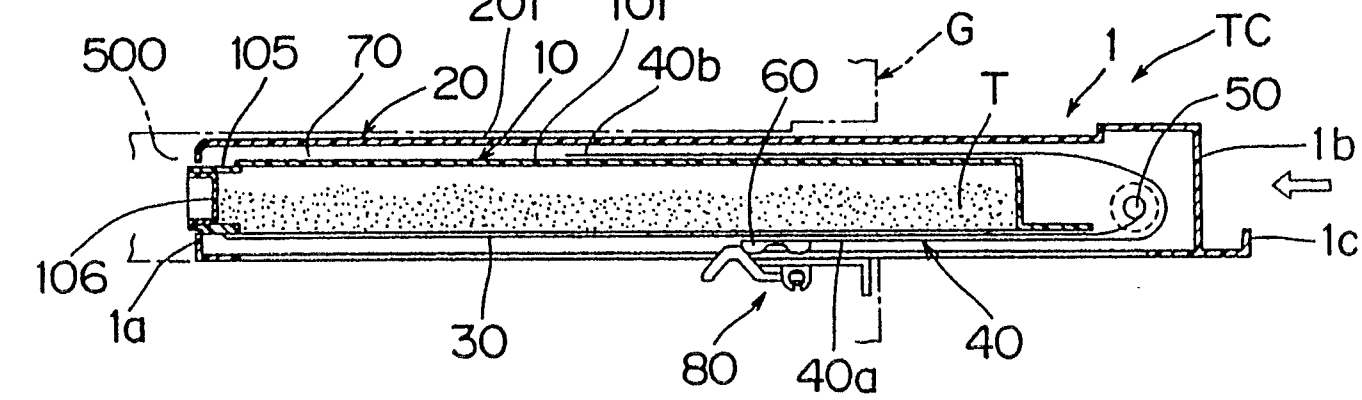

As shown in FIG. 1A and FIG. 1B, the toner cartridge main body 1 is moved in and out of the storing recess 500 along its longitudinal direction. In the bottom near the inlet in the storing recess 500, there is a slide member moving member 80 for opening and closing the outer seal member 40 as being engaged with the slide member 60. The outer seal member 40 is moved to the closing position shown in FIG. 1A and the opening position shown in FIG. 2A, along with the relative move of the slide member 60 engaged with the slide member moving member 80, to the toner cartridge main body 1. In this toner cartridge TC, in the unused state, the outer seal member 40 is set in the closed state. The slide member 60 automatically releases the outer seal member 40, depending on the insertion action of the toner cartridge TC, as sequentially shown in FIG. 1A, FIG. 1B, and FIG. 2A. The slide member 60 also automatically closes the outer seal member 40, depending on the drawing action of the toner cartridge TC, as sequentially shown in FIG. 3A and FIG. 3B.

Both ends of the toner cartridge main body TC in the longitudinal direction are referred to as lead-in end 1*a* and drawing end 1*b*, respectively.

Toner Cartridge Main Body

Referring to FIG. 5 to FIG. 12, the toner cartridge main body 1 is explained below.

Figure 5:
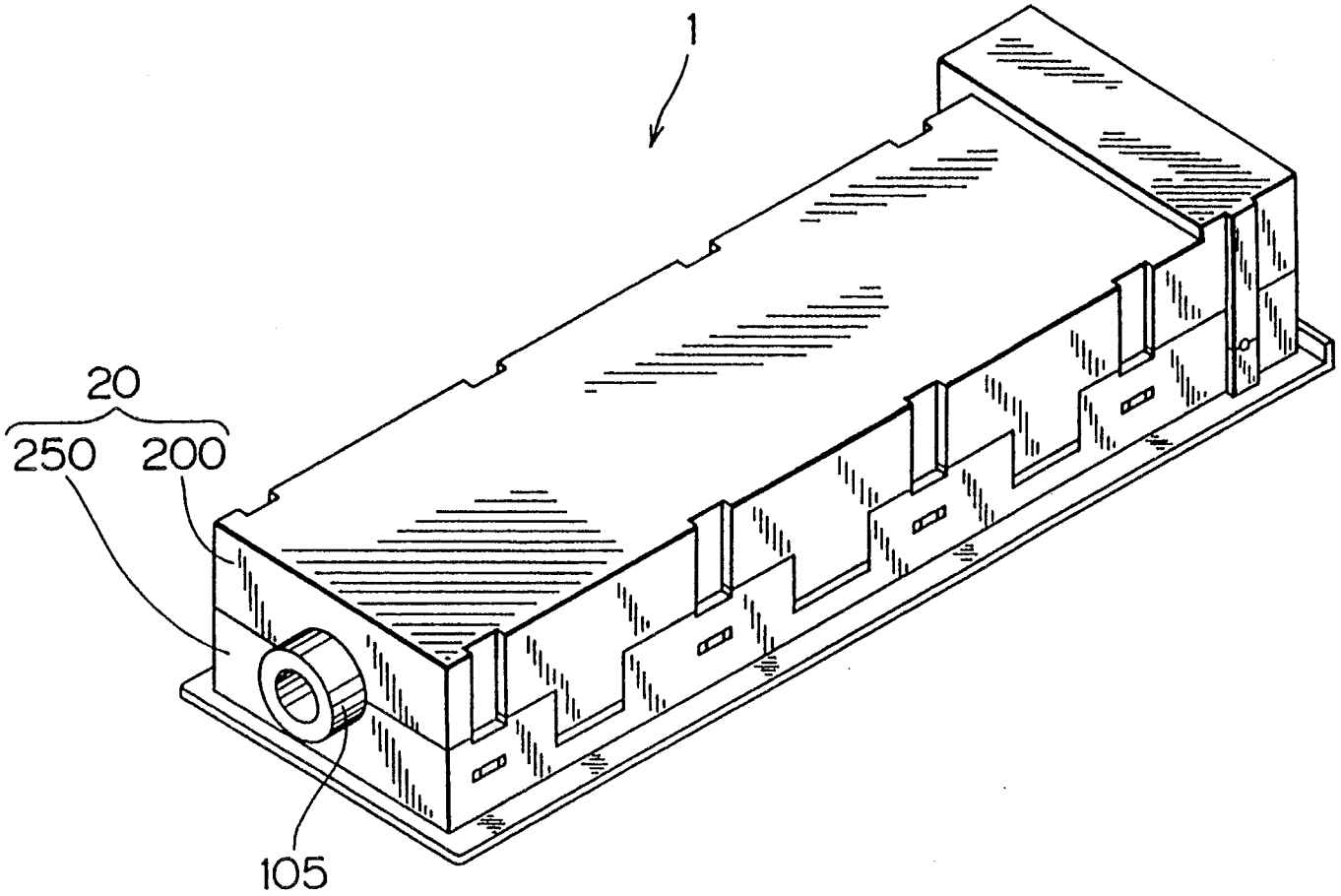
FIG. 5 is a general perspective view of a toner cartridge main body.
Figure 6:
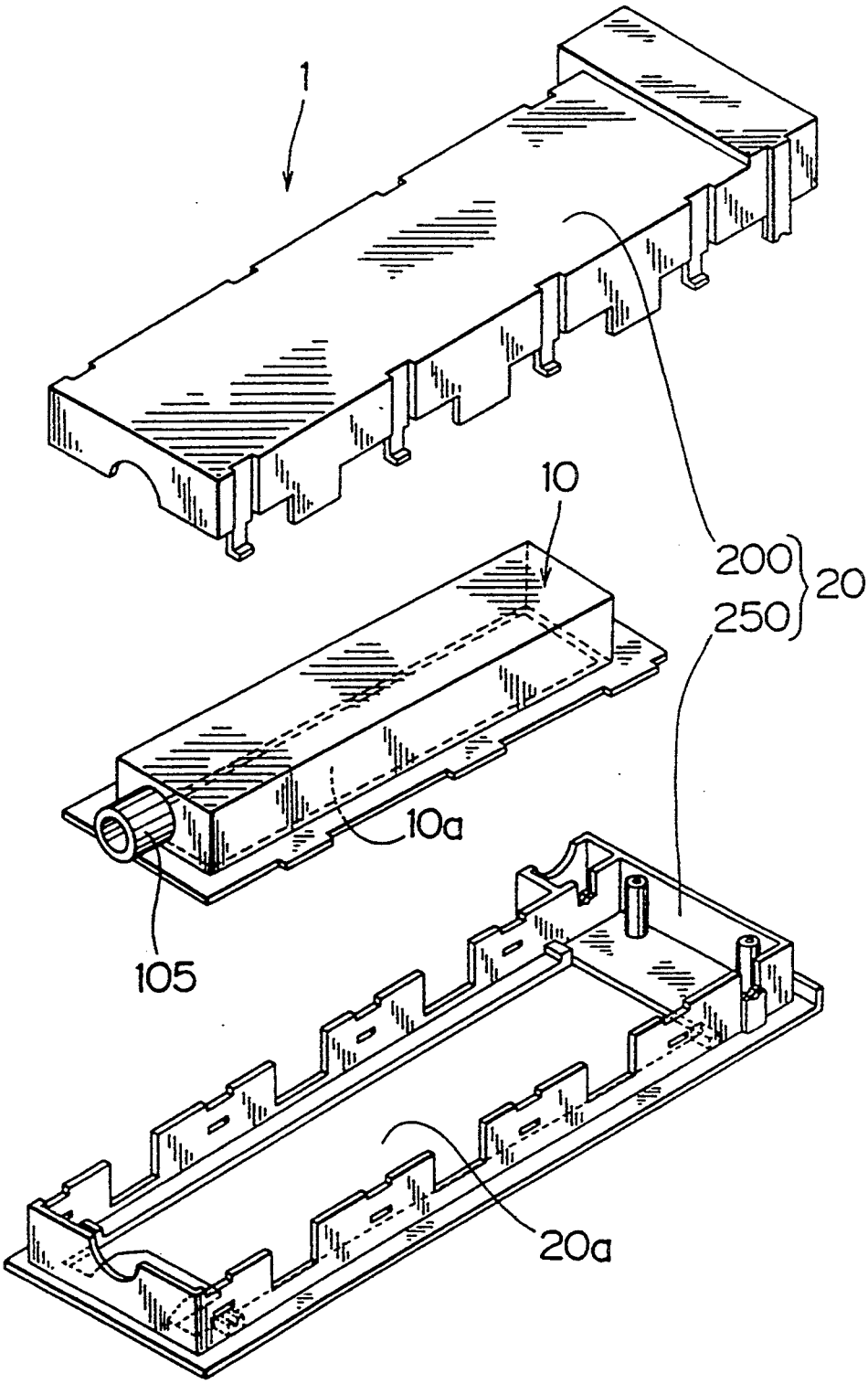
FIG. 6 is a perspective exploded view of a toner cartridge main body.

First, referring to FIG. 5 and FIG. 6, the outer container 20 is divided into upper and lower halves, an upper casing 200 and a lower casing 250. The both casings 200, 250 are mutually fitted and fixed. Besides, the both casings 200, 250 are fixed in the state of positioning the inner container 10, by inserting a tongue 107 (see FIG. 8) of the inner container 20 into their fitting parts.

Figure 8:
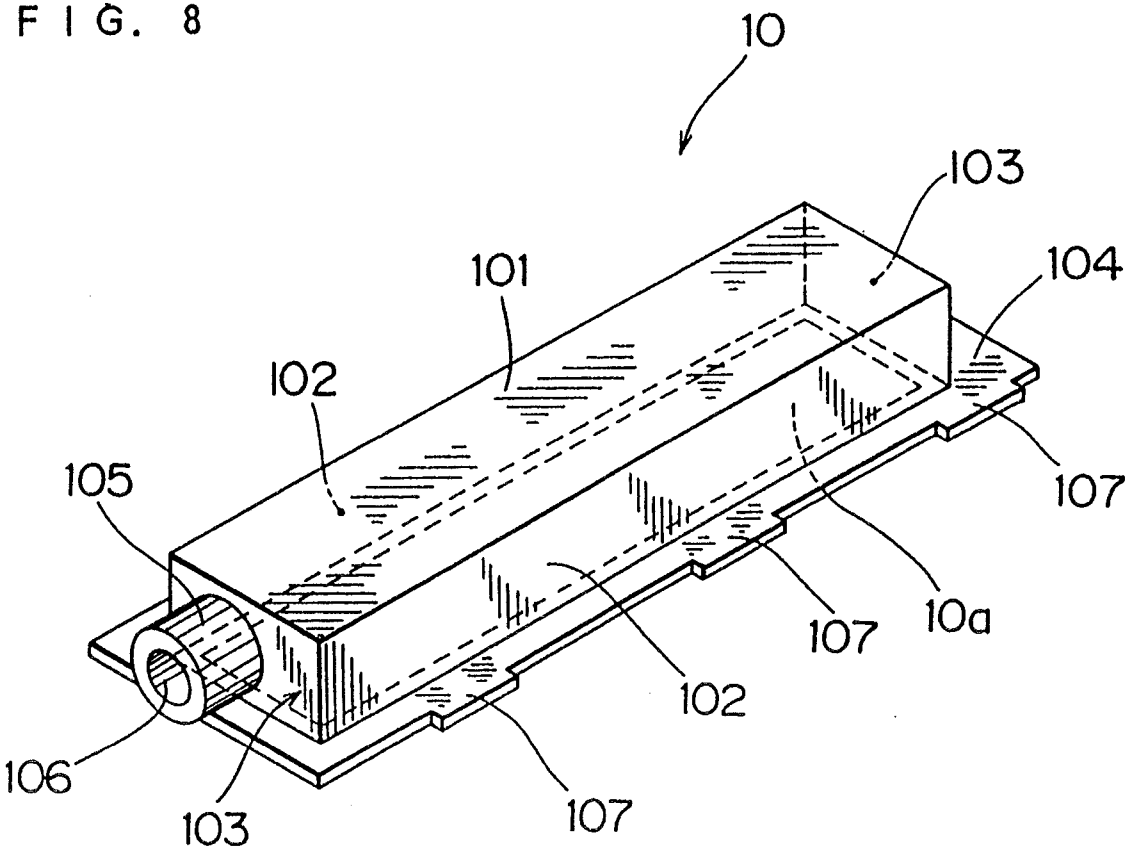
FIG. 8 is a perspective view of an inner container.

The upper casing 200 and lower casing 250 are formed in one body by resin. Referring to FIG. 1A and FIG. 8, the inner container 10 is also formed in one body by resin, and a plug 106 is thermally fused to a toner feed tube 105 formed on the inner container 10.

Figure 2A:
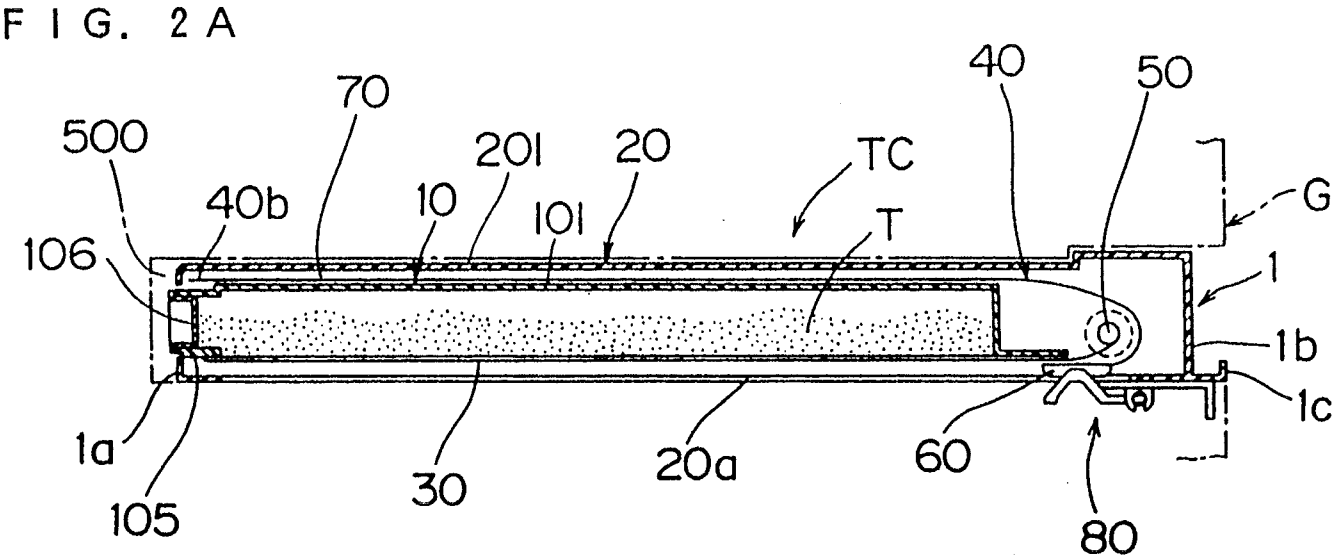
FIG. 2A and FIG. 2B are schematic sectional views sequentially showing the steps of peeling off the inner seal member of the toner cartridge mounted on the storing recess.
Figure 2B:
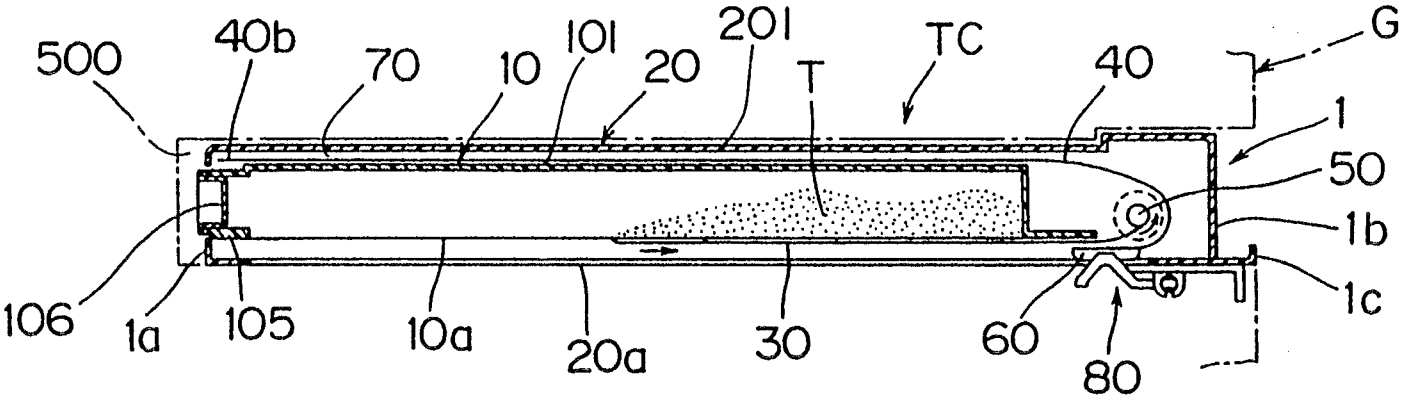

Referring to FIG. 1A, the upper surface 101 of the inner container 10, and the upper surface 201 of the upper casing 200 of the outer container 20 are parallel at a specific interval, and between these upper surfaces 101, 201, there is a storing space 70 for storing a part of the outer seal member 40 in a nearly upright state as shown in FIG. 2A when required.

When the toner dropping opening 20*a* of the outer container 20 is released by the outer seal member 40, a part of the outer seal member 40 is guided by the take-up shaft 50 in a state turned upside down, and is stored in the storing space 70. The storing space 70 is formed between the upper surface 101 of the inner container 10, and the upper surface 201 of the upper casing 200 of the outer container 20, and the outer seal member 40 is guided by the upper surfaces 101, 201 and take-up shaft 50, and therefore the number of parts may be saved as compared with the case of installing guide member separately, and the manufacturing cost can be lowered.

Moreover, a part of the outer seal member 40 releasing the toner dropping opening 20*a* of the outer container 20 is stored in a nearly upright state as shown in FIG. 2A, and therefore when an outer seal member 40 of high rigidity is employed, bending mark is not formed on the outer seal member 40 when the outer seal member 40 enters the area above side 101. By such outer seal 40 without bending mark, the toner dropping opening 20*a* of the outer container is closed, and the sealing is secure, so that toner scattering may be prevented securely.

Upper Casing

Figure 7:
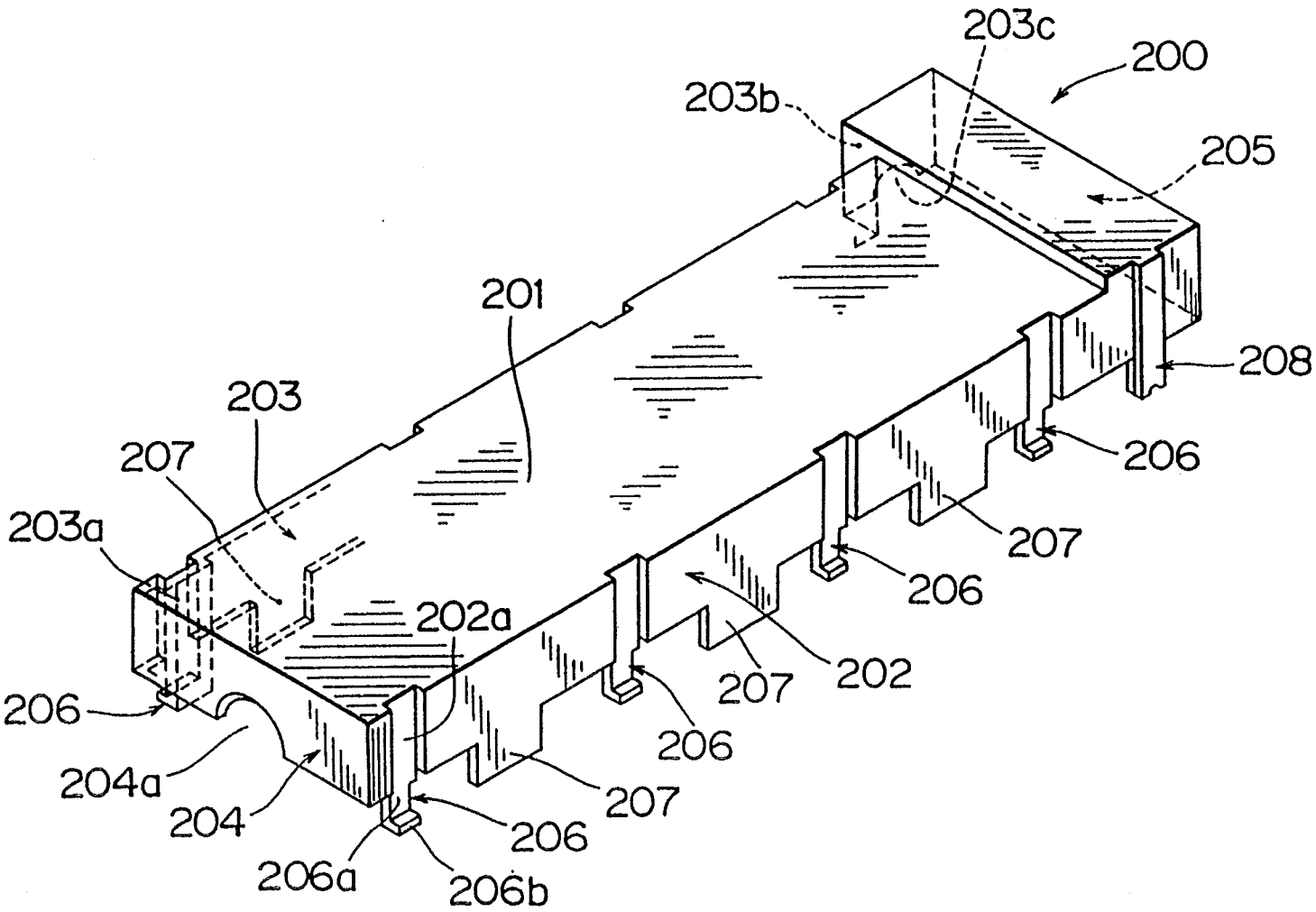
FIG. 7 is a perspective view of an upper casing for composing the upper part of an outer container.

Referring to FIG. 7, the upper casing 200 is in a box form having a nearly rectangular shape in a plan view, and its lower surface is opened. The upper casing 200 comprises the upper surface 201, and side surfaces 202, 203 and end surfaces 204, 205 for composing the peripheral wall parts, extending downward from the four corners of the top surface 201. The side surfaces 202, 203 run along the longitudinal direction of the toner cartridge main body 1, and the end surfaces 204, 205 run along the widthwise direction of the toner cartridge main body 1.

The side surfaces 202, 203 are provided with plural pawls 206 to be hooked on specific parts of the lower casing 250, plural bumps 207 disposed between the pawls 206 and a shaft support part 208 for supporting the take-up shaft 50, which are formed so as to extend downward. Concerning the shaft bearing part formed on the side surface 203, it is omitted in the drawing because it is same in composition as the shaft bearing part 208 provided on the side surface 202.

The pawls 206 are in an L-sectioned shape, and consist of an elastically deformable support part 206*a* extending downward in a continuous form with concave surfaces 202*a*, 203*a* formed in the side surfaces 202, 203, and a pawl main body 206*b* bending at right angle from the lower end of the support part 206*a* and extending outward. The outer surface of the support part 206*a* is flush with the concave surfaces 202*a*, 203*a*.

In the portion corresponding to the withdrawal side end 1*b* of the side surface 203, a protrusion 203*b* projecting from the other parts is formed, and a semicircular notch 203*c* for introducing the larger end 50*d* to be described later of the take-up shaft 50 is formed in this protrusion 203*b*. Although not shown, a partition plate is provided against the inner surface of the protrusion 203*b*, and a shaft support in the same composition as the shaft support 208 is formed, extending downward from the partition plate.

A semicircular notch 204*a* for inserting the toner feed tube 105 is formed in the end surface 204 disposed at a position corresponding to the lead-in side end 1*a* of the toner cartridge main body 1.

Referring to FIG. 8, the inner container 10 is in a box form having an approximately rectangular form in a plan view. The inner container 10 comprises the rectangular upper surface 101, each pair of side surfaces 102 and end surfaces 103 extending downward from the four sides of the upper surface 101, and a lower edge 104 in a plate form, continuously extending outward from the lower end of the side surfaces 102 and end surfaces 103 and running around the whole circumference of the inner container 10.

At the end surface 103 disposed at a position corresponding to the lead-in side end 1*a* of the toner cartridge main body 1 of the inner container 10, the toner feed tube 105 for feeding toner inside the inner container 10 when manufacturing the toner cartridge is formed in a projected form. The front end of the toner feed tube 105 is designed to project outward of the outer container 20 as shown in FIG. 1A, in the assembled state of the inner container 10 and outer container 20. The inside of the toner feed tube 105 communicates with the inside of the inner container 10, and is isolated from the outside by the plug 106 introduced into the tube from the front end side. The plug 106 is intended to clog the toner feed tube 105 by thermal fusion after the toner is supplied in the inner container 10 from the toner feed tube 105.

The toner cartridge main body 1 is a double container structure consisting of the inner and outer containers 10, 20, and can be filled with toner from a single toner feed tube 105. Therefore, the structure is simple, and the sealing performance is high.

Figure 12:
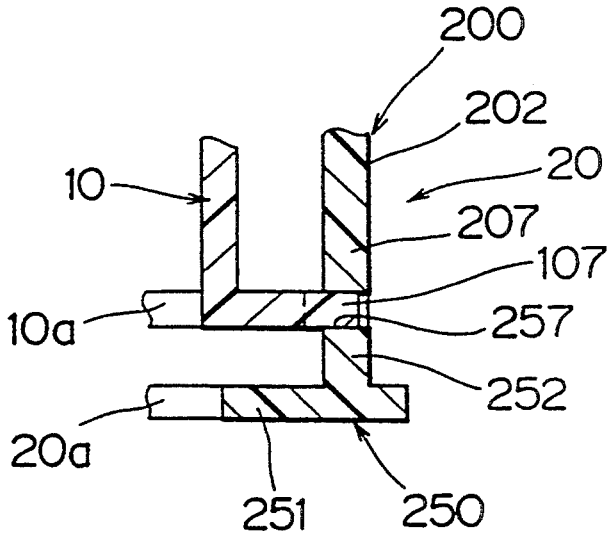
FIG. 12 is an essential sectional view of the toner cartridge main body showing the fixed state of the inner container by the upper and lower casings.

Plural tongues 107 extending outward are formed in the parts of the lower edge 104 along the longitudinal direction. These tongues 207 are, as shown in FIG. 12, when fitting the protrusions 107 of the upper casing 200 and recesses 257 of the lower casing 250 to be described later, pinched by these fitting parts. As a result, the inner container 10 is fixed, as being positioned in the outer container 20.

Thus, the outer container 20 consists of upper and lower casings 200, 250 fixed by fitting, and the inner container 10 is positioned and fixed by these upper and lower casings 200, 250, the hence the toner cartridge 1 can be assembled only by fitting together without using screws or the like.

Lower Casing

Figure 9:
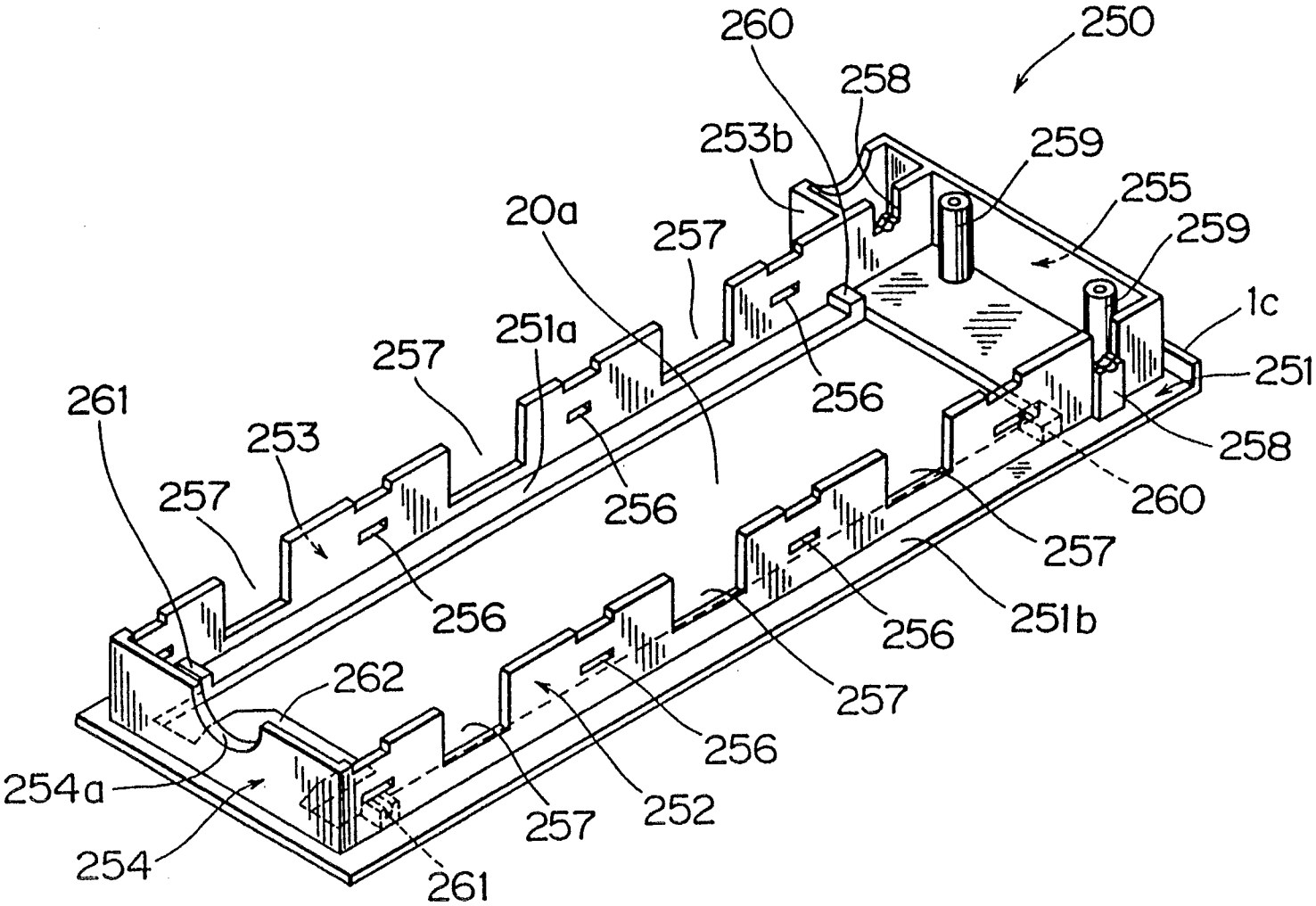
FIG. 9 is a perspective view of a lower casing for composing the lower part of the outer container.
Figure 10:
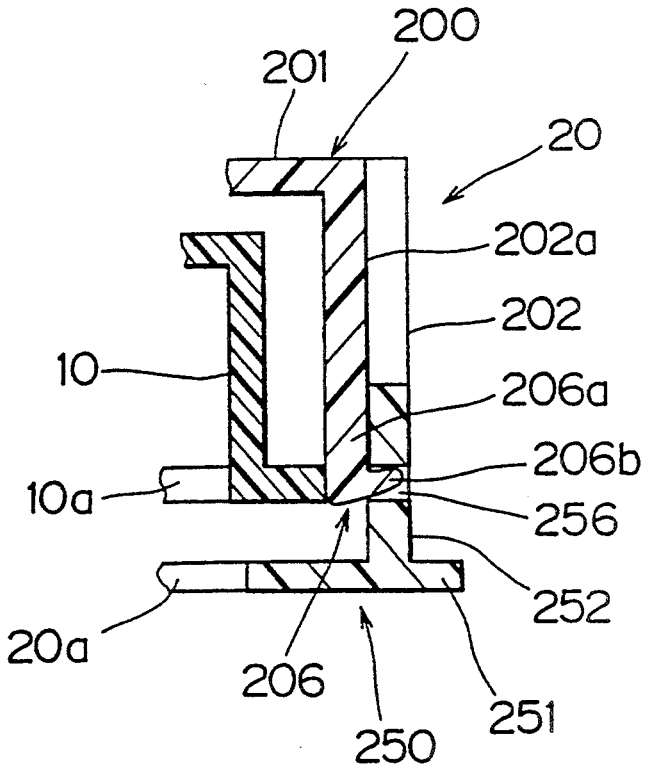
FIG. 10 is a longitudinal sectional view of the toner cartridge main body showing the fitting parts of the upper and lower casings.

Referring then to FIG. 9, the lower casing 250 is in an approximately rectangular form in a plan view. The upper surface of the lower casing 250 is open, and the toner dropping opening 20*a* of the outer container 20 is formed in its lower surface.

The lower casing 250 comprises a lower edge 251 formed around the toner dropping opening 20a, and side surfaces 252, 253 and end surfaces 254, 255 extending upward from the vicinity of the four sides of the lower edge 251 to compose peripheral walls. The side surfaces 252, 253 run along the longitudinal direction of the toner cartridge main body 1, and the end surfaces 254, 255 run along the widthwise direction of the toner cartridge main body 1.

Figure 11:
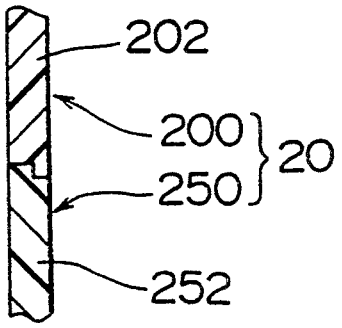
FIG. 11 is a longitudinal sectional view showing the fitting parts of the upper and lower casings.

The side surfaces 252, 253 comprise plural hook slits 256 (see FIG. 10) for hooking the pawls 206 of the upper casing 200, plural recesses 257 located between the hook slits 256 for fitting the protrusions 207 of the upper casing 200, and a shaft support part 258 for supporting the take-up shaft 50 in collaboration with the shaft support part 208 of the upper casing. In the side surface 253, a box-shaped protrusion 253*b* is formed in a projected form, corresponding to the protrusion 203*b* of the upper casing 200. The side surfaces 202, 203 of the upper casing 200 and the side surfaces 252, 253 of the lower casing 250 are mutually formed in a zigzag form as shown in FIG. 11.

The lower edge 251 possesses an inner edge 251*a* disposed at the inner side of the side surfaces 252, 253 and end surfaces 254, 255, and an outer edge 251*b* disposed at the outer side, thereby composing peripheral walls. In the part of the inner edge 251*a* corresponding to the withdrawal side end 1*b* of the toner cartridge main body 1, there are a pair of bosses 259 to befitted with a pair of tubular parts (not shown) formed in the upper casing 200, respectively, and also a pair of protrusions 260 for presenting opening position stopper means for defining the outer seal member 40 in the opening position through the slide member 60 are formed in a projecting state having the toner dropping opening 20*a* held in the widthwise direction. A finger hook 1*c* for hooking a finger when drawing out is formed in the part of the outer edge 251*b* of the lower edge 251 corresponding to the withdrawal side end 1*b*.

Figure 17:
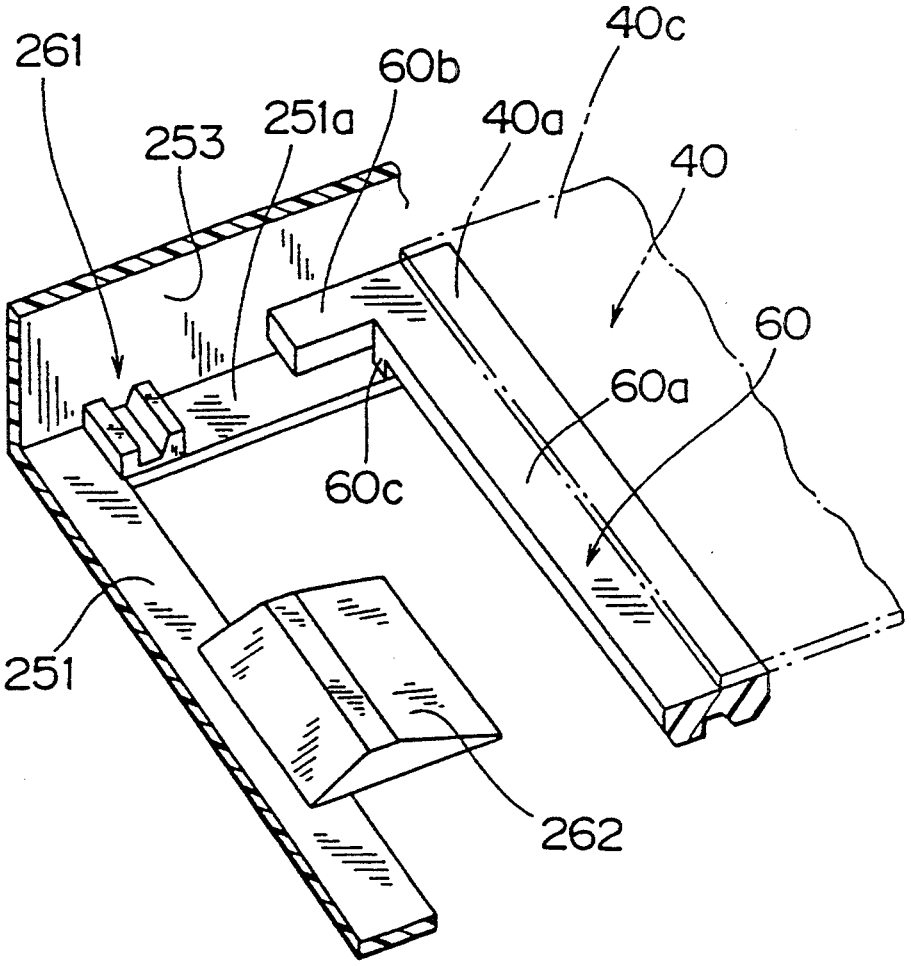
FIG. 17 is an essential perspective view of the toner cartridge main body showing the state just before the outer seal member is moved to the closing position by the slide member.
Figure 18:
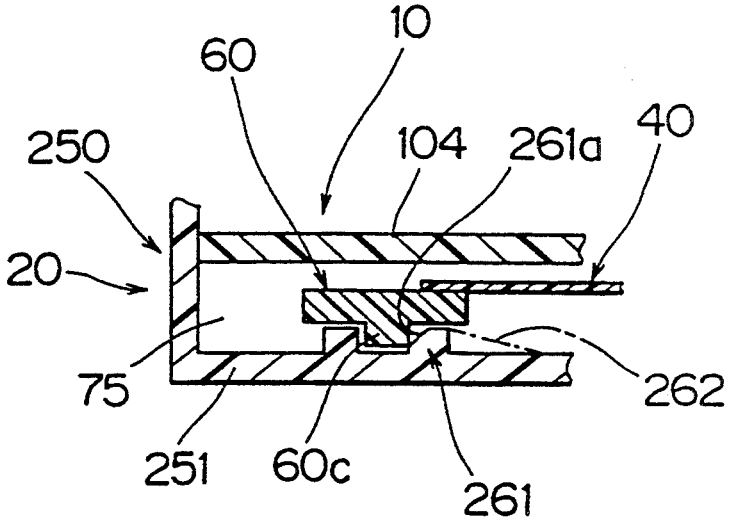
FIG. 18 is an essential sectional view of the toner cartridge main body showing the state of the slide member engaged by the closing position stopper member.

Moreover, as shown in FIGS. 9, 17 and 18, in the part of the inner edge 251*a* corresponding to the lead-inside end 1*a* of the toner cartridge main body 1, there are a pair of protrusions 261 for presenting closed position stopper means for defining the outer seal member 40 in the closing position through the slide member 60, being provided in a state of holding the toner dropping opening 20*a* in the widthwise direction, while a guide part 262 forming a cam surface for guiding engagement and disengagement of the slide member 60 with the protrusions 261 is provided in a state of projecting to the toner dropping opening 20*a* side. The protrusions 261 for presenting the closing position stopper means are engaged with protrusions 60*c* described later of the slide member 60 in the central dent 261*a* (see FIG. 18), and define the outer seal member 40 in the closing position. Referring to FIG. 17, the guide part 262 is in an angle form, and when it abuts against the lower surface of the main body 60*a* of the slide member 60, the protrusions 60*c* of the slide member 60 are guided into the dent 261*a*. The protrusions 261 for presenting the closing position stopper means also compose move defining means for defining the move of the slide member 60, so as to prevent the seal member 40 from being released in the state of the toner cartridge TC being dismounted from the storing recess 500.

In the end surface 254 corresponding to the lead-in side end 1*a* of the toner cartridge main body 1, a notch 254*a* in a semicircular section is formed. Between this notch 254*a* and notch 204*a* of the upper casing 200, the toner feed tube 105 is inserted and fixed.

Inner Seal Member

The inner seal member 30 is a slender sheet, and covers the toner dropping opening 10*a* of the inner container 10, in a thermally fused state to the lower surface of the lower edge 104 of the inner container 10. The base end 30*a* of the inner seal member 30 is affixed to the take-up shaft 50 as shown in FIG. 1A.

Take-up Means

Figure 13:
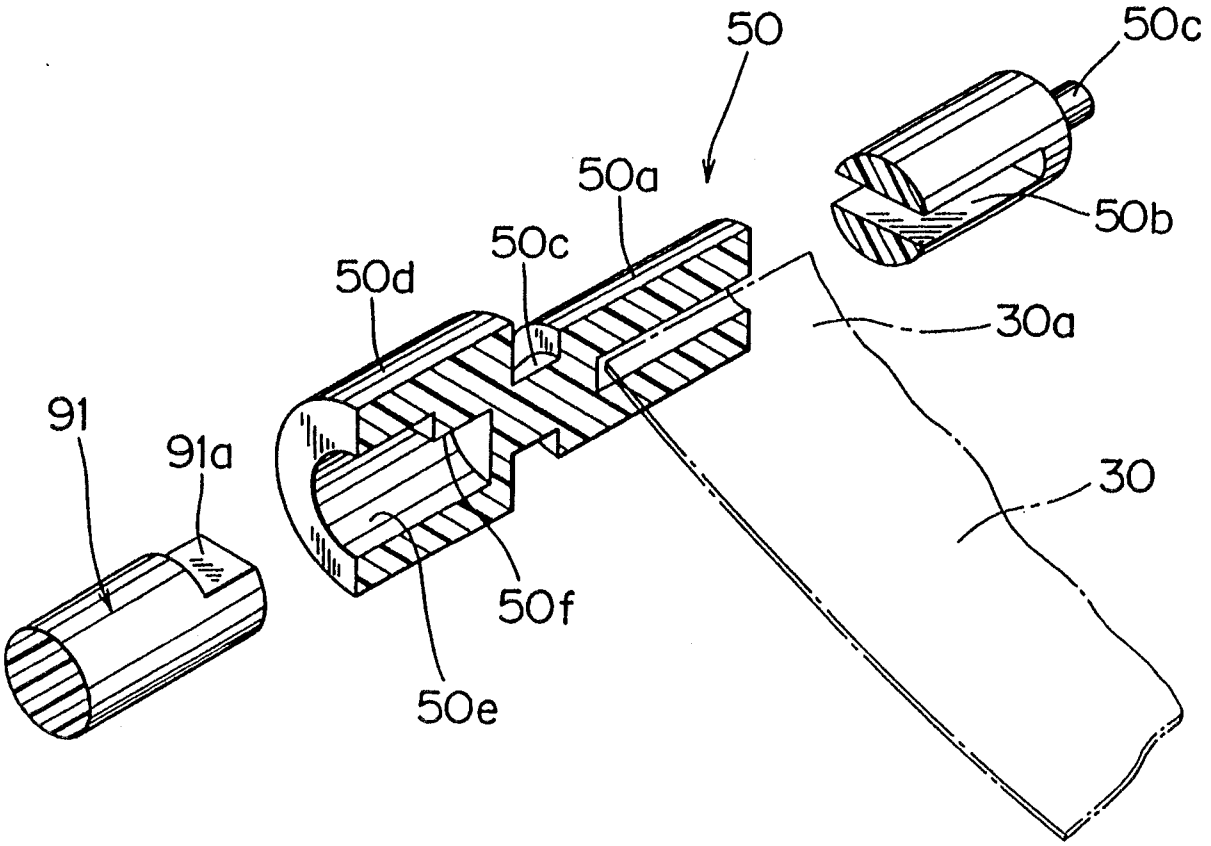
FIG. 13 is a partially sectional exploded perspective view of a take-up shaft and a drive coupling shaft.

Referring to FIG. 13, the take-up shaft 50 possesses a main body 50*a* having a slit 50*b* for fixing the base end 30*a* of the inner seal member 30 provided in the widthwise direction, a pair of smaller ends 50*c* formed coaxially on both ends of the main body 50*a*, being supported by the shaft support parts 208, 258 of the upper and lower casings 200, 250, and a larger end 50*d* formed continuously to one smaller end 50*c*. At the larger end 50*d* is formed a drive coupling recess 50*e* for inserting and coupling a drive coupling shaft 91 contained in the driving force transmission mechanism 90. At the front end of the drive coupling shaft 91, a plane 91*a* parallel to the axial direction is formed, and, deep inside the drive coupling recess 50*e* corresponding to it, there is a plane 50*f* to be matched with the plane 91*a* of the drive coupling shaft 91 in specified rotation phase.

Slide Member

Figure 14:
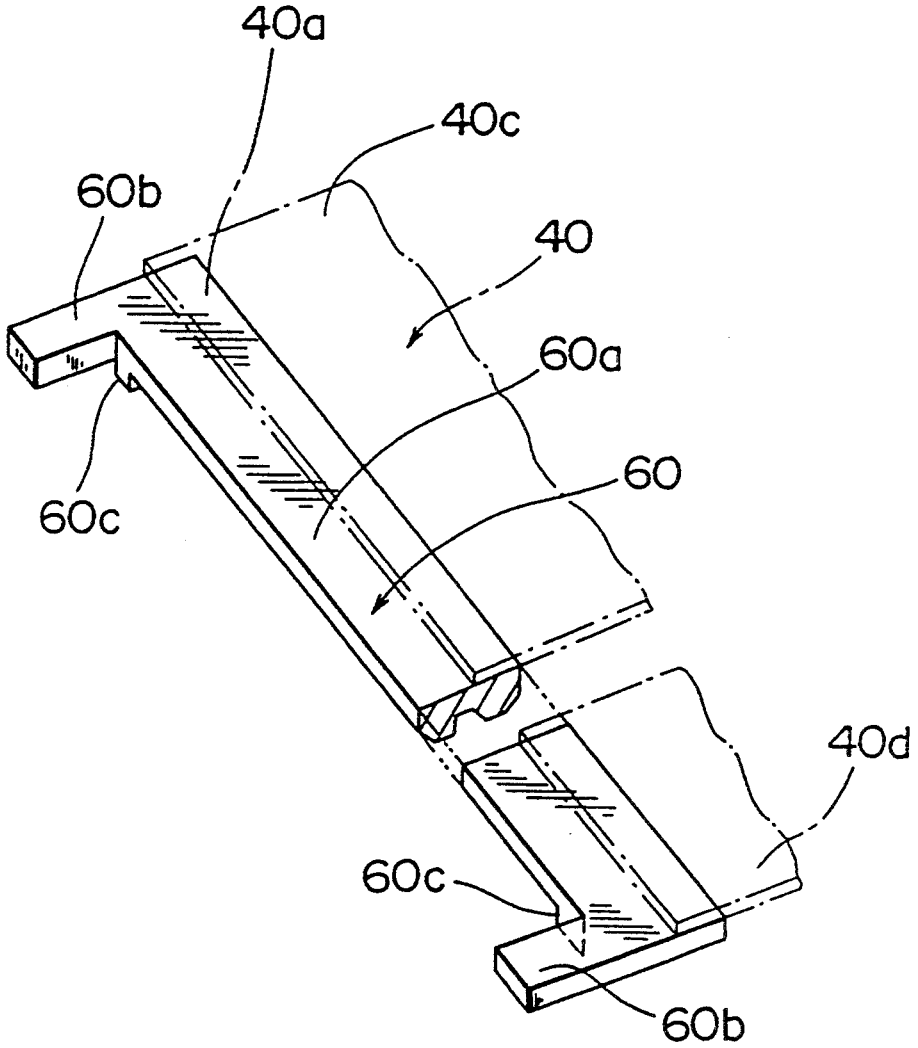
FIG. 14 is a partially sectional perspective view of a slide member.

In FIG. 14, one end 40*a* of the outer seal member 40 is affixed to the upper surface of the slide member 60. The slide member 60 comprises a main body 60*a* straddling over the toner dropping opening 20*a* of the outer container 20 in the widthwise direction, a pair of guided parts 60*b* formed at both ends of the main body 60*a*, and the protrusions 60*c* formed in the lower surface of the guided parts 60*b*.

Figure 16:
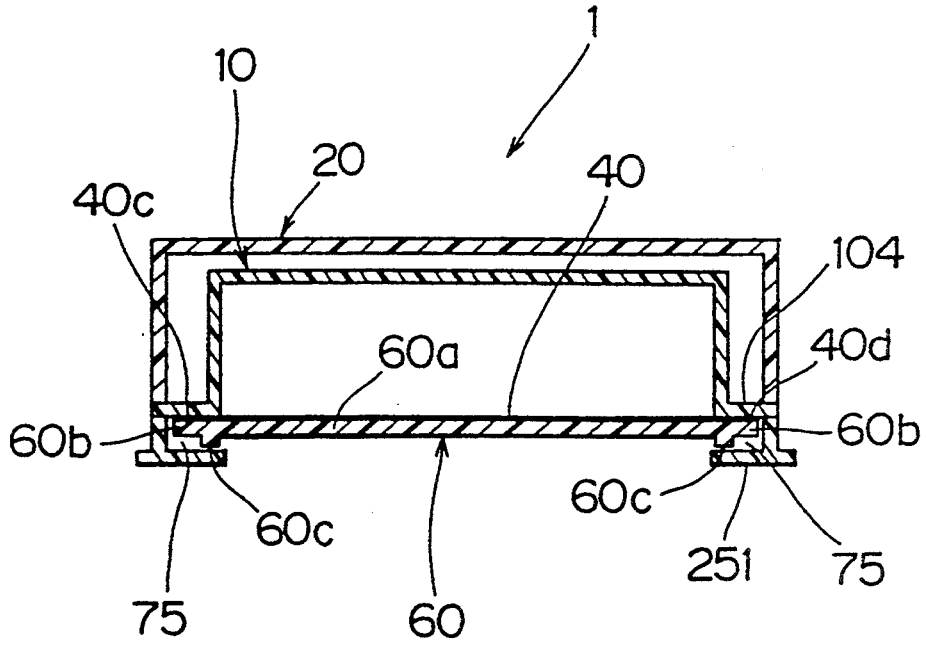
FIG. 16 is a longitudinal sectional view of the toner cartridge main body showing the guided state of the slide member.

The pair of guided parts 60*b* of the slide member 60 are, as shown in FIG. 16, invading into a pair of guide grooves 75 formed between the lower surface of the lower edge 104 of the inner container 10, and the upper surface of the lower edge 251 of the lower casing 250 of the outer container 20. The slide member 60 is guided by the guide grooves 75, and slides and moves in the longitudinal direction of the outer container 20. Along with the sliding move of the slide member 60, the outer seal member 40 opens and closes the toner dropping opening 20*a* of the outer container 20.

Thus, the upper slide member 60 for opening and closing the outer seal member 40 is guided by the guide grooves 75 formed between the inner container 10 and outer container 20. Therefore, without requiring particular guide member, the number of parts may be curtailed. Besides, as shown in FIG. 16, since the both edges 40*c*, 40*d* of the outer seal member 40 are disposed in both guide grooves 75, sealing by the outer seal member 40 is secure.

Figure 15:
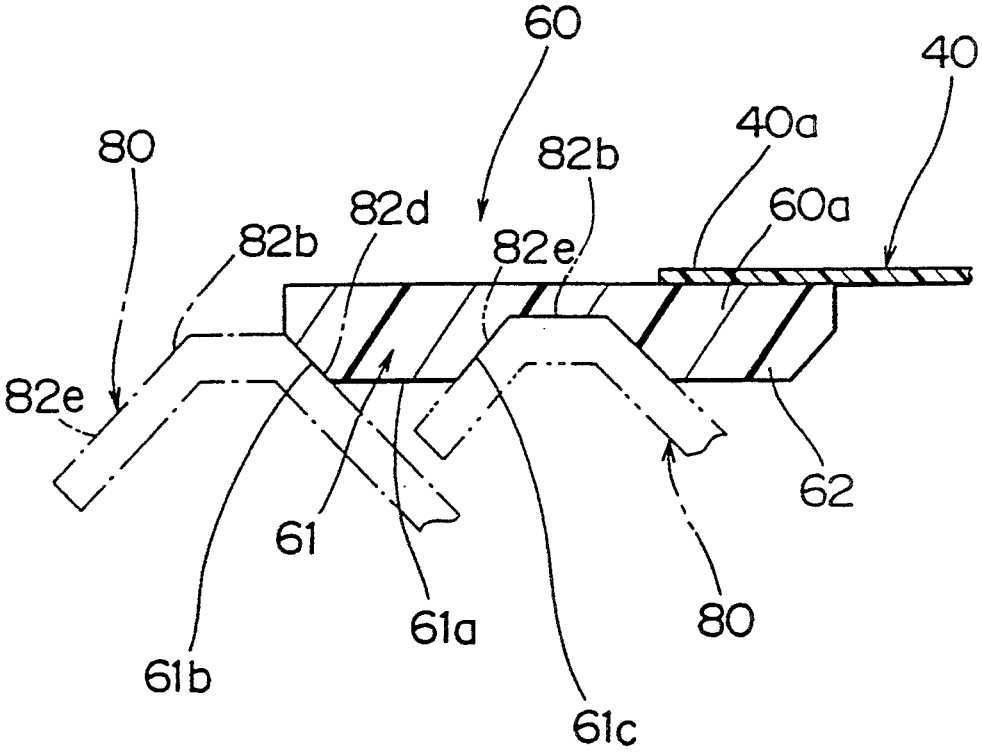
FIG. 15 is an essential sectional view of the slide member.

Referring to FIG. 15, a pair of protrusions 61, 62 are formed in the lower surface of the main body 60*a* of the slide member 60. One protrusion 61 possesses a top 61*a* for pushing down the slide member moving means 80 in the disengagement position, an outer seal member releasing part 61*b*, and an outer seal member closing part 61*c* comprising mutually opposing slopes formed across the top 61*a*.

The slide member 60, as the outer seal member releasing part 61*b* engaged with the slide member moving member 80, moves the outer seal member 40 to the opening position, depending on the insertion motion of the toner cartridge TC into the storing recess 500. Or, when the outer seal member opening part 61*c* is engaged with the slide member moving member 80, the slide member 60 moves the outer seal member 40 to the closing position, depending on the drawing motion of the toner cartridge TC from the storing recess 500.

The protrusion 260 as the opening position stopper means formed in the lower edge 251 of the lower casing 250 abuts against the slide member 60 just before move of the outer seal member 40 to the opening position is completed, and arrests relative move of the slide member 60 to the toner cartridge main body 1. As a result, the slide member moving means 80 engaged with the outer seal member opening part 61*b* rides over the top 61*a*, and is engaged with the outer seal member closing part 61*c*.

Likewise, the protrusion 261 as the closing position stopper means formed in the lower edge 251 of the lower casing 250 abuts against the slide member 60 just before move of the outer seal member 40 to the closing position is completed, and arrests the relative move of the slide member 60 to the toner cartridge main body 1. As a result, the slide member moving member 80 engaged with the outer seal member closing part 61*c* rides over the top 61*a*, and is engaged with the outer seal member opening part 61*b*.

Storing Recess

Figure 19A:
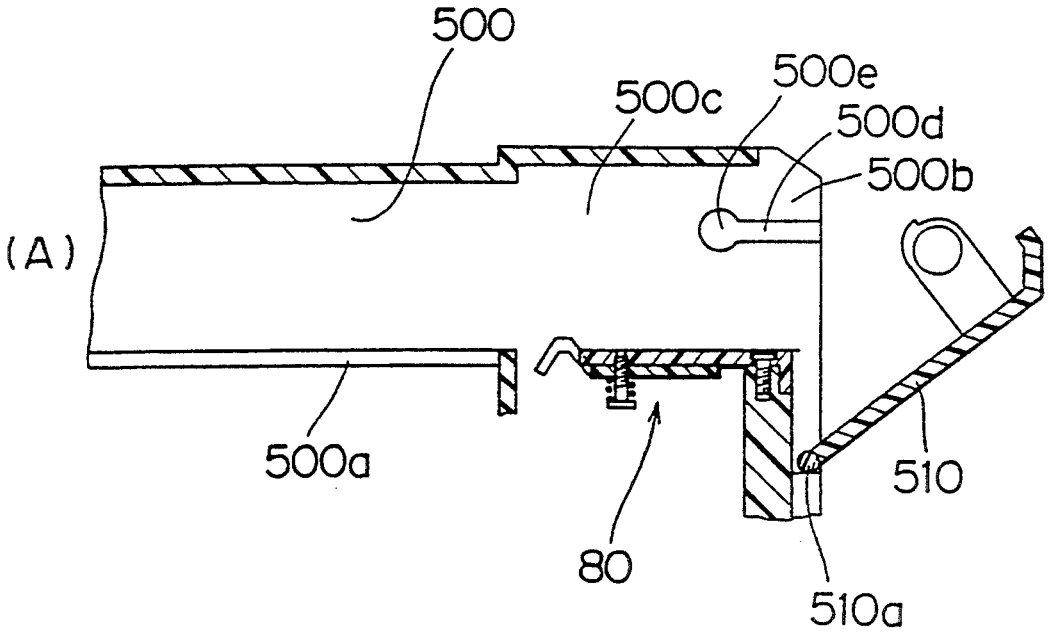
FIG. 19A and FIG. 19B are schematic sectional views sequentially showing the steps of closure of the storing recess of the image forming apparatus main body by a lid.
Figure 19B:
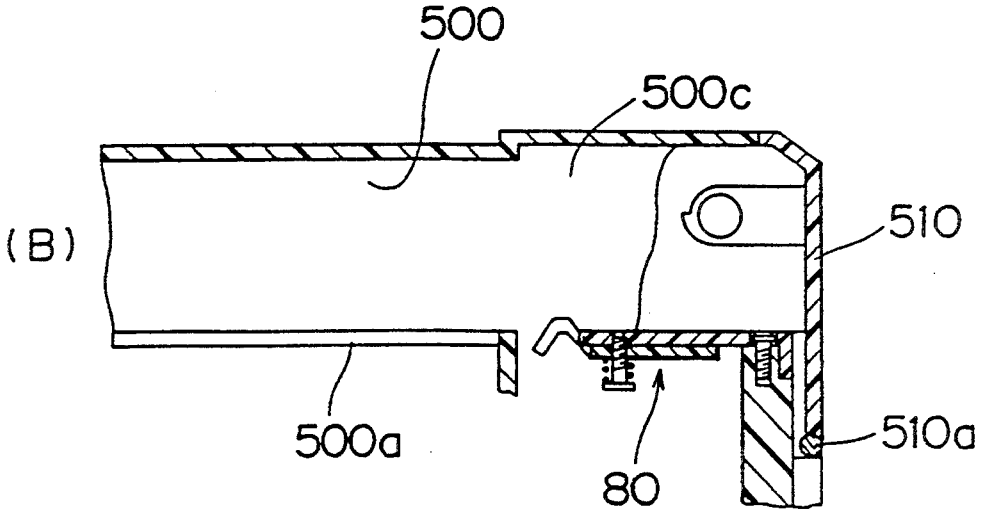

Referring to FIG. 19A and FIG. 19B, the storing recess 500 is disposed above the developing device (not shown) of the image forming apparatus main body G, and is loaded and unloaded with the toner cartridge TC. In the bottom of the storing recess 500, there is an opening 500*a* for dropping the toner discharged from the toner cartridge TC into the developing device.

For loading and unloading the toner cartridge TC into the storing recess 500, the opening 500*b* provided at the inlet of the storing recess 500 is released as shown in FIG. 19A, or closed as shown in FIG. 19B, by a lid 510 which is rotated about a shaft 510*a* formed in a specified position of the image forming apparatus main body G.

In the inside wall 500*c* of the storing recess 500, a lead-in groove 500*d* opened at one end in order to lead in the take-up shaft 50 as the toner cartridge TC is introduced into the storing recess 500, and an insertion part 500*e* for moving in and out the drive coupling shaft 91 in the storing recess 500, being provided in the deepest inside part of the lead-in groove 500*d* are formed. In the bottom near the inlet in the storing recess 500, the slide member moving member 80 is disposed.

Slide Member Moving Member

Figure 20:
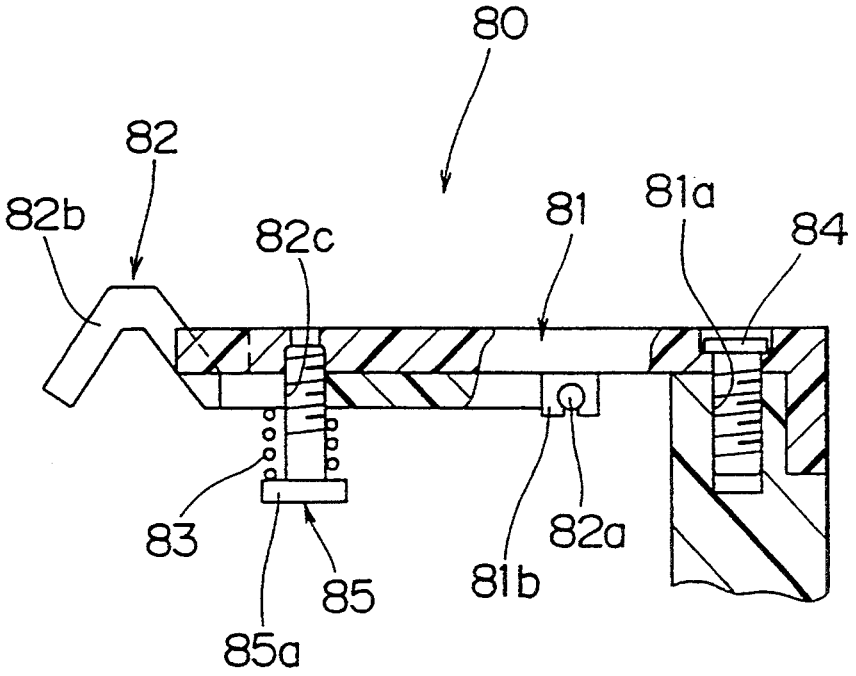
FIG. 20 is a partial sectional side view of a slide member moving member.
Figure 21:
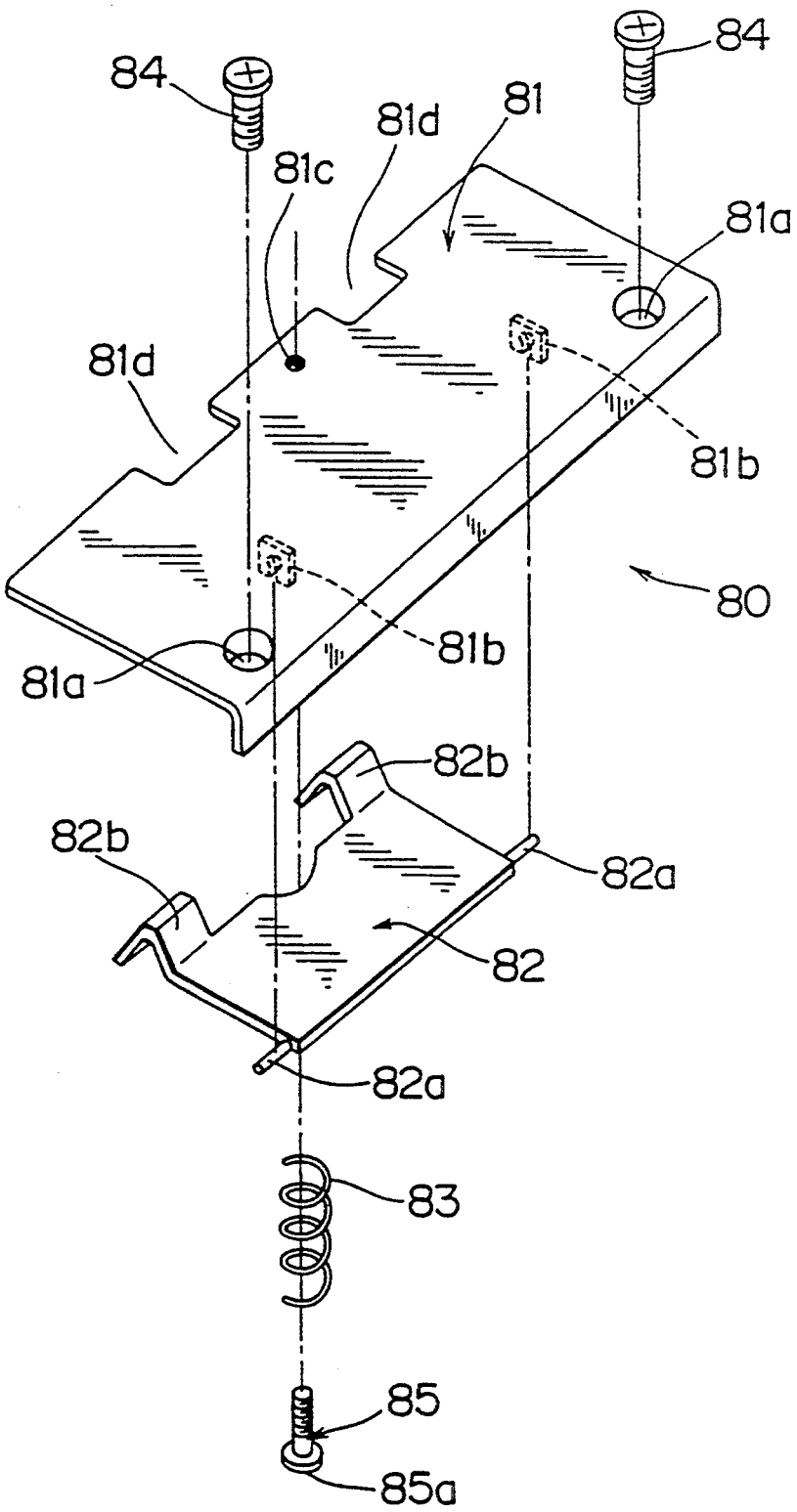
FIG. 21 is an exploded perspective view of the slide member moving member.

Referring to FIG. 20 and FIG. 21, the slide member moving member 80 comprises a fixed member 81 fixed by screws 84 in the bottom near the inlet in the storing recess 500, a rotary member 82 for presenting a movable member moving between the upper position to be engaged with the slide member 60 and the lower position for clearing the engagement, in a state being supported by the fixed member 81, and a compression coil spring 83 as thrusting means for thrusting the rotary member 82 to the upper position.

The fixed member 81 has an L-shaped section, and a pair of screw insertion holes 81*a* for inserting a pair of screws 84 are formed at the rear end of the fixed member 81. In the lower surface of the fixed member 81, a pair of shaft support parts 81*b* are projecting in order to support the pair of shaft parts 82*a* of the rotary member 82, respectively. In the front end middle part of the fixed member 81, a screw hole 81*c* is formed for driving a screw 85 as the spring holding member for inserting the compression coil spring 83. Also at the front end of the fixed member 81, there are a pair of notches 81*d* through which a pair of engaging protrusions 82*b* of the rotary member 82 penetrate.

At both ends in the widthwise direction of the base end part of the rotary member 82, a pair of shaft parts 82*a* projecting sideways are formed, and the pair of engaging protrusions 82*b* bent in an angle form are formed at the front end of the rotary member 82. In the middle of the front end of the rotary member 82, a recess 82*c* is formed for inserting the screw 85 through which the compression coil spring 83 is inserted.

Referring to FIG. 20, the compression coil spring 83 is interspaced between the head 85*a* of the screw 85 fixed to the fixed member 81 and the lower surface of the rotary member 82, and thrusts the rotary member 82 in the clockwise direction. That is, the engaging protrusion 82*b* of the movable member 82 is thrust in the direction projecting into the storing recess 500 by the compression coil spring 83. Besides, when the top 61*a* of the slide member 60 passes over the engaging protrusion 82*b*, the movable member 82 turns counterclockwise while compressing the compression coil spring 83, and the engaging protrusion 82*b* retreats from the storing recess 500.

The engaging protrusion 82*b* comprises an outer seal member opening part 82*d* and an outer seal member closing part 82*e* consisting of a pair of slopes inclined reversely to each other. The outer seal member opening part 82*d* is engaged with the outer seal member opening part 61*b* of the slide member 60, while the outer seal member closing part 82*e* is engaged with the outer seal member closing part 61*c* of the slide member 60.

Figure 22:
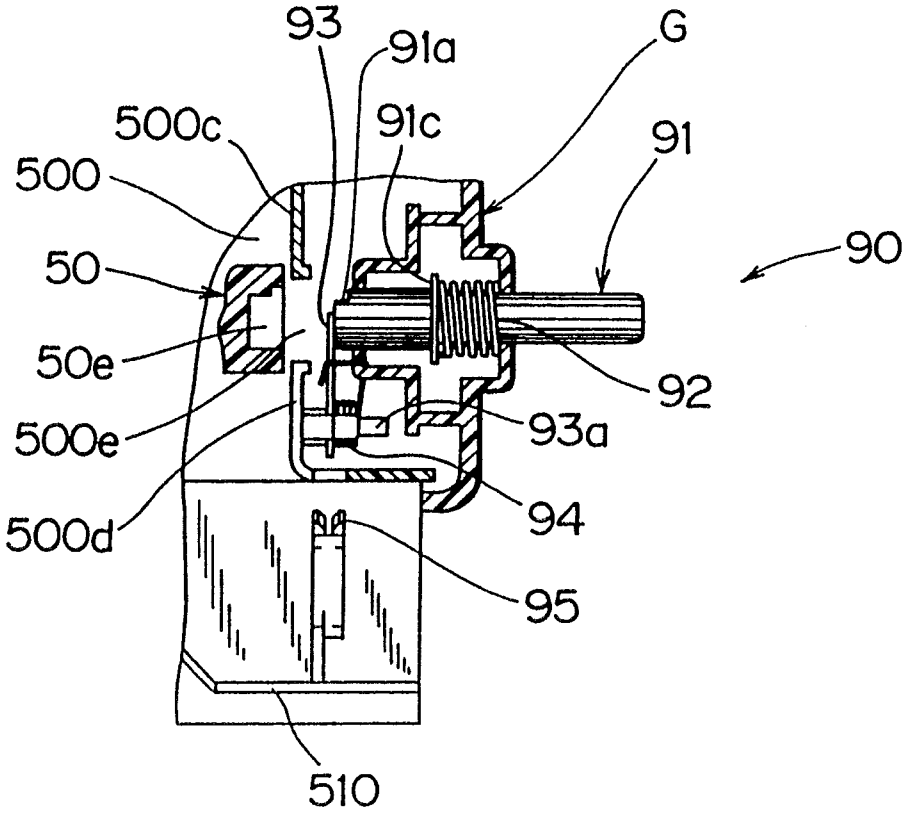
FIG. 22 is a schematic sectional view of a driving force transmitting mechanism before the lid of the storing recess is closed.
Figure 23:
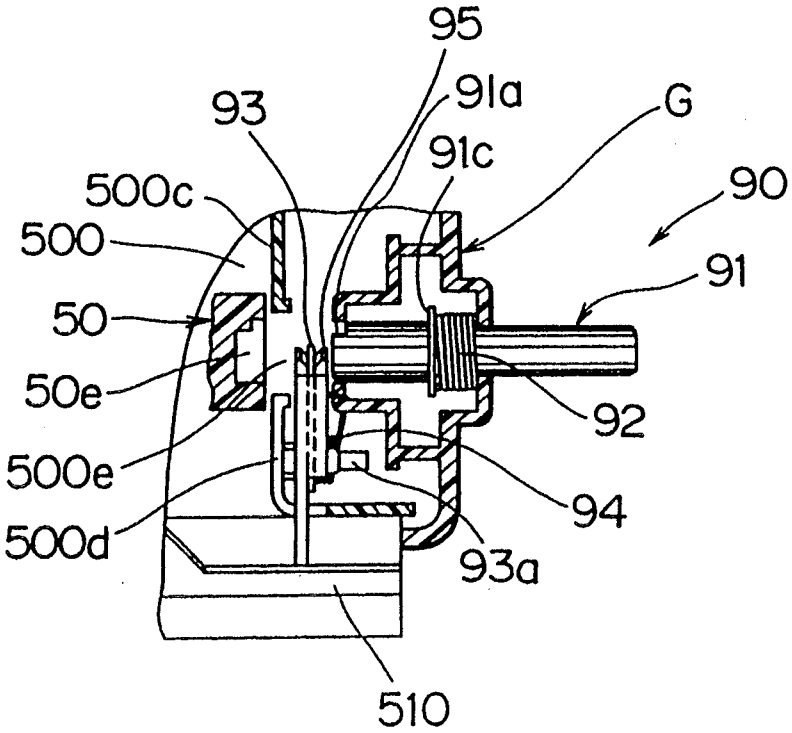
FIG. 23 is a schematic sectional view of the driving force transmitting mechanism showing the state of the drive coupling shaft being about to be coupled with the take-up shaft in cooperation with the closing action of the lid.
Figure 25:
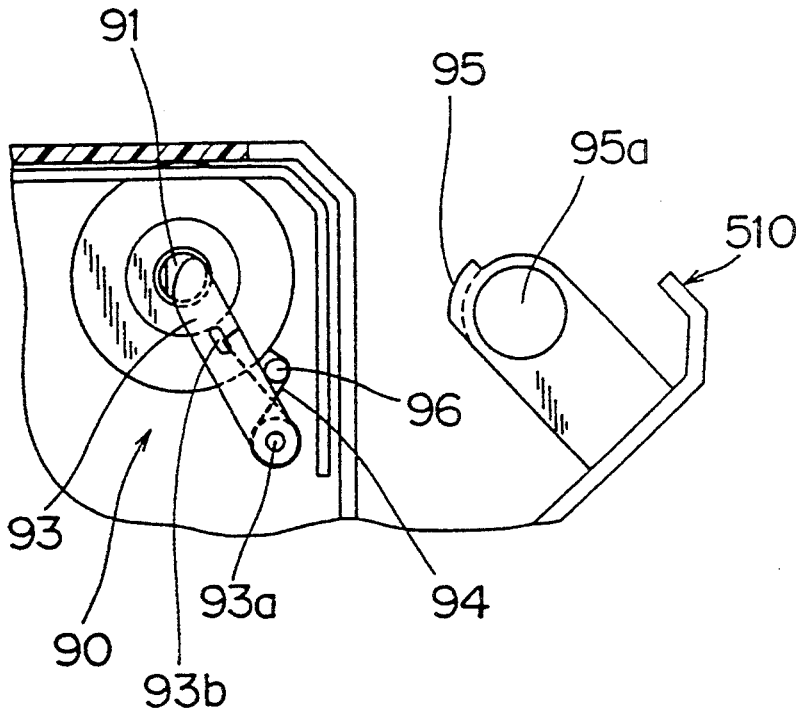
FIG. 25 is a schematic sectional view of the driving force transmitting mechanism corresponding to the state in FIG. 22.
Figure 26:
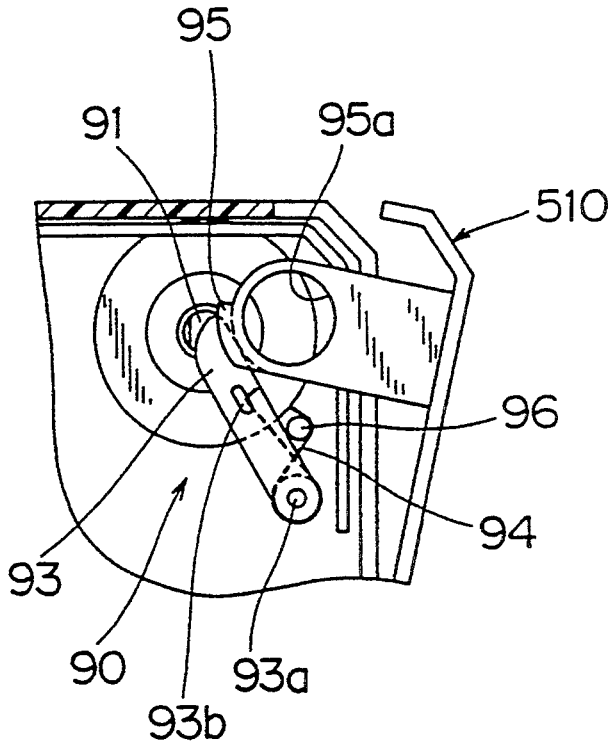
FIG. 26 is a schematic sectional view of the driving force transmitting mechanism corresponding to the state in FIG. 23.
Figure 27:
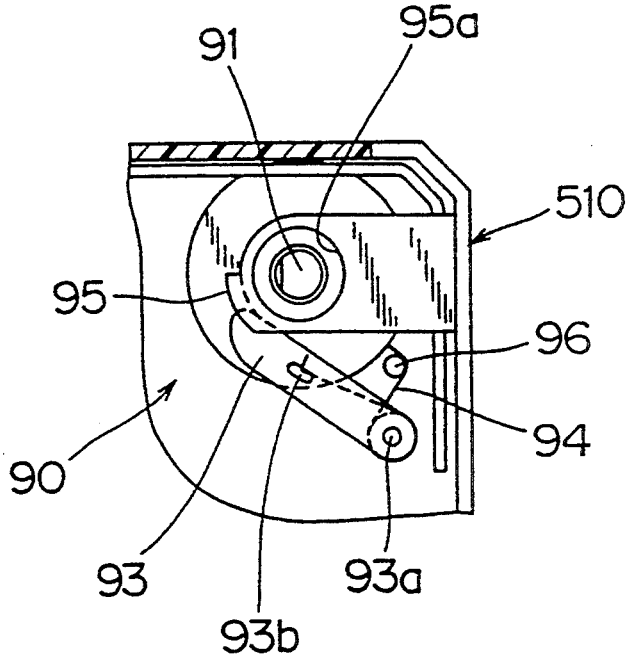
FIG. 27 is a schematic sectional view sequentially showing the steps corresponding to FIG. 24.

Driving Force Transmission Mechanism for Transmitting Driving Force to Take-up Shaft FIG. 22 to FIG. 24 are schematic sectional views sequentially showing the steps of coupling the drive coupling shaft 91 to the take-up shaft along with the closing action of the lid 510. FIG. 25 to FIG. 27 are schematic sectional views corresponding to FIG. 22 to FIG. 24, respectively. With reference to these diagrams, the driving force transmission mechanism 90 is explained. The driving force transmission mechanism 90 is disposed on the side surface 500*c* near the inlet of the storing recess 500. The driving force transmission mechanism 90 comprises the drive coupling shaft 91 coupled detachably to the take-up shaft 50, a compression coil spring 92 as thrusting means for thrusting the drive coupling shaft 91 in the axial direction, a lock member 93 for holding the drive coupling shaft 91 in the specified position, a torsion spring 94 as thrusting means for thrusting the lock member 93 in the locked state, and a lock member driving part 95 provided in the back side of the lid 510 for unlocking the lock member 93.

The drive coupling shaft 91 is free to move in the axial direction between the coupling position (see FIG. 24 and FIG. 27) of the take-up shaft 50 inserted in the drive coupling recess 50*e*, in the state of advancing into the storing recess 500, and the disengaging position (see FIG. 22 and FIG. 25) for clearing the coupling as retreating from the storing recess 500. Referring to FIG. 22, in the middle part of the drive coupling shaft 91, a flange 91*c* moving in the axial direction together with the drive coupling shaft 91 is formed. The rear end of the drive coupling shaft 91 is projecting outward from the image forming apparatus main body G. Referring to FIG. 24, by inserting and coupling the coupling protrusion H1 of the hand turning handle H into the coupling recess 91*b* formed in this rear end, the take-up shaft 50 is driven through the hand turning handle H and coupling drive shaft 91.

Referring to FIG. 13, as mentioned above, the flat part 91*a* to be engaged with the flat part 50*f* formed in the drive coupling recess 50*e* is formed at the front end of the drive coupling shaft 91. The mutually engaged flat parts 50*f*, 91*a* compose the torque transmission surface.

Referring to FIG. 22, the compression coil spring 92 is interspaced between the inner surface of the image forming apparatus main body G and the flange 91*c* of the drive coupling shaft 91, and thrusts the drive coupling shaft 91 to the coupling position (the take-up shaft 50 side).

The lock member 93 is composed of a plate member rotatably fitted around the shaft 93*a* mounted on the image forming apparatus main body G. The base end of the lock member 93 is rotatably supported by the shaft 93*a*. The lock member 93, of which front end abuts against the front end of the drive coupling shaft 91, is free to rotate about the shaft 93*a*, between the lock position (see FIG. 22 and FIG. 25) for holding the drive coupling shaft 91 in the disengaging position, and the unlocking position (see FIG. 24 and FIG. 27).

Referring to FIG. 25, the torsion spring 94 is wound around the shaft 93*a*, and its one end is hooked on the shaft 96 fixed on the image forming apparatus main body G, while the other end is hooked on the hook hole 93*b* provided in the middle part in the longitudinal direction of the lock member 93. This torsion spring 94 thrusts the lock member 93 to the lock position (in the counterclockwise direction in FIG. 23).

Referring to FIG. 25, the lock member driving part 95 is in a plate form, and is projecting to the rear side of the lid 510. This lock member driving part 95 moves the lock member 93 from the lock position shown in FIG. 25 to the unlocking position shown in FIG. 27 in cooperation with the closing action of the lid 510 sequentially shown in FIG. 25 to FIG. 27. The lock member driving part 95 also possesses an insertion hole 95*a* for inserting the coupling drive shaft 91 with the lock member 93 moved to the unlocking position.

The operation of the driving force transmission mechanism 90 is explained below.

As shown in FIG. 2A, when the toner cartridge TC is set in the storing recess 500 of the image forming apparatus main body G, the take-up shaft 50 is introduced to the position confronting the front end of the drive coupling shaft 91. In this state, by the lock member 93 in the lock position shown in FIG. 22 and FIG. 25, the drive coupling shaft 91 is held in the disengaged position.

When the lid 510 is closed, as sequentially shown in FIG. 23 and FIG. 24, and in FIG. 26 and FIG. 27, the lock member driving part 95 provided on the lid 510 draws away the lock member 93 to the unlocking position shown in FIG. 24 and FIG. 27, in cooperation with the closing action of the lid 510. As a result, the coupling drive shaft 91 thrust by the compression spring 92 penetrates through the insertion hole 95*a* of the lock member driving part 95, and is coupled with the drive coupling recess 50*e* of the take-up shaft 50 of the toner cartridge TC. Consequently, it is possible to drive the take-up shaft 50 by the handle H.

Thus, in cooperation with the closing action of the lid 510, driving and coupling to the take-up shaft 50 is effected, and driving and coupling is not effected unless the lid 510 is closed. Therefore, unless the lid 510 is closed, the inner seal member 30 is not peeled off, so that toner scatter may be securely prevented.

Besides, with the lid 510 closed, the drive coupling shaft 91 in the coupling position penetrates through the insertion hole 95*a* of the lock member driving part 95, and by this drive coupling shaft 91, opening of the lid 510 is blocked through the lock member driving part 95. Therefore, with the drive coupling shaft 91 coupled to the drive coupling recess 50*e* of the toner cartridge TC, opening of the lid 510 is prevented, so that toner scatter may be prevented more securely.

Moreover, by picking the rear end of the drive coupling shaft 91 by finger, and moving to the right in FIG. 24 by resisting the compression coil spring 92, it is set aside to the disengaging position shown in FIG. 22, and only when the take-up shaft 50 is set in a drive prohibited state, the toner cartridge TC can be drawn out from the storing recess.

Attaching and Detaching of Toner Cartridge in Storage Recess

Referring now to FIGS. 1A, 1B, 2A, 2B, 3A, 3B, and 4, the operation for detaching and attaching of toner cartridge TC in the storing recess 500 is described below.

In the first place, a new toner cartridge TC for replacement is as shown in FIG. 1, and the toner dropping opening 10*a* of the inner container 10 is closed by the inner seal member 30, and the toner dropping opening 20*a* of the outer container 20 is closed by the outer seal member 40. In this state, the slide member 60 is moved to the position shifted to the lead-in side end 1*a* of the toner cartridge main body 1.

When the lead-in side end 1*a* of the toner cartridge main body 1 is inserted into the storing recess 500, as shown in FIG. 1A, the slide member 60 and slide member moving member 80 are engaged with each other. Specifically, as shown by single dot chain line in FIG. 15, the outer seal member opening part 61*b* of the slide member 60 is engaged with the outer seal member opening part 82*d* of the pair of engaging protrusions 82*b* of the slide member moving member 80.

Furthermore, when the toner cartridge main body 1 is inserted into the inner side of the storing recess 500, the slide member moving member 80 moves the slide member 60 relatively to the toner cartridge main body 1, in cooperation with this insertion action, and the outer seal member 40 is released as shown in FIG. 1B.

Just before setting of the toner cartridge 1 in the storing recess 500 is complete, the right end of the slide member 60 in FIG. 2A abuts against the protrusion 260 as the opening position stopper means (see FIG. 9; this protrusion 260 is omitted in FIG. 1). As a result, the relative move of the slide member 60 to the toner cartridge main body 1 is defined. In this state, by further inserting the toner cartridge main body 1, the engaging protrusion 82*b* of the rotary member 82 of the slide member moving member 80 rides over the top 61*a* of the protrusion 61 of the slide member moving member 60, and the outer seal member closing part 82*e* of the slide member moving member 80 is engaged with the outer seal closing part 61*c* of the slide member 60 as indicated by double dot chain line in FIG. 15, thereby becoming the state as shown in FIG. 2B. In this state, moreover, by closing the lid 510, the take-up shaft 50 is coupled with the drive coupling shaft 91.

Consequently, turning the handle H, the take-up shaft 50 is driven, and the inner seal member 30 is taken up on the take-up shaft 50 while peeling off as shown in FIG. 2B. As a result, the toner dropping opening 10*a* of the inner container 10 is opened, and the toner T drops into the specified part of the developing device (not shown) beneath through the toner dropping openings 10*a*, 20*a*.

Figure 3A:
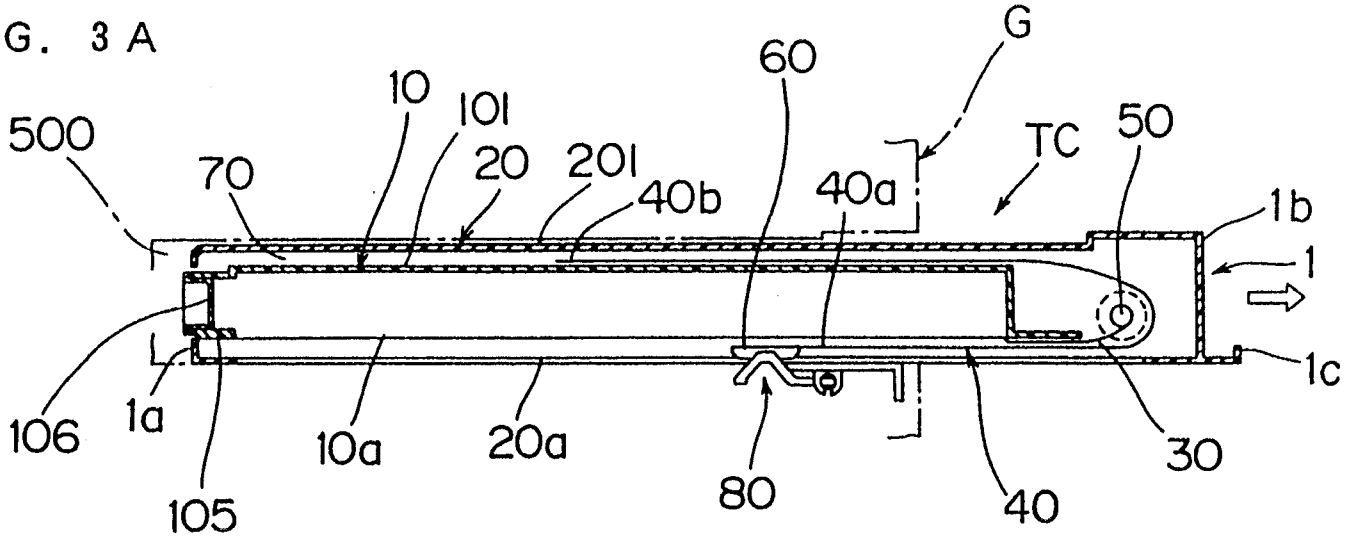
FIG. 3A and FIG. 3B are schematic sectional views sequentially showing the steps of drawing out the spent toner cartridge from the storing recess.
Figure 3B:
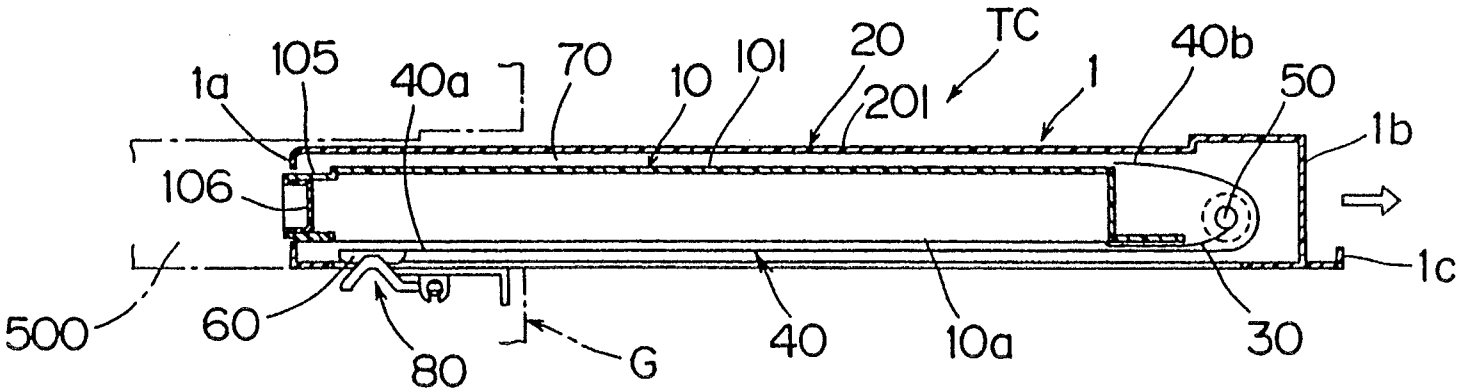
Figure 4:
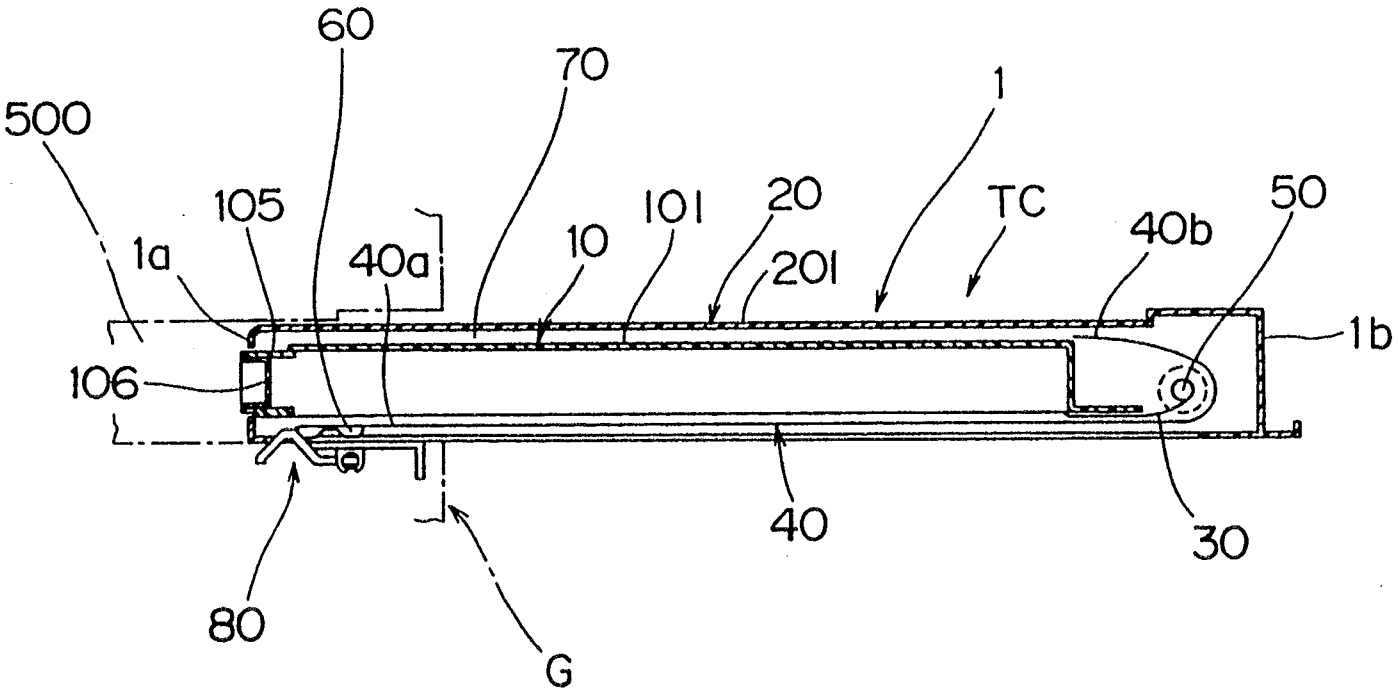
FIG. 4 is a schematic sectional view showing the state just before completion of withdrawal of toner cartridge.

To draw out the spent toner cartridge TC, on the other hand, upon completion of insertion of the toner cartridge TC, the outer seal member closing part 82*e* of the slide member moving member 80 is already engaged with the outer seal member closing part 61*c* of the slide member 60. Therefore, in cooperation with the drawing action of the toner cartridge TC, the slide member 60 is moved relatively toward the lead-in side end 1*a* to the toner cartridge main body 1 as shown in FIG. 3A, and is moved to the closing position as shown in FIG. 3B.

Referring to FIG. 18, the slide member 60 reaching the closing position is guided by the slope of the guide 262, and abuts against a pair of protrusions 261 as closing position stopper means. As a result, the relative move of the slide member 60 to the toner cartridge main body 1 is defined. In this state, by further drawing out the toner cartridge main body 1, the engaging protrusion 82*b* of the slide member moving means 80 rides over the top 61*a* of the protrusion 61 of the slide member 60, and cancels the engagement with the slide member 60. Then the toner cartridge TC is completely removed from the storing recess 500.

Thus, when detaching for replacement, since the toner dropping openings 10*a*, 20*a* are automatically closed by the outer seal member 40 which is not stained with toner, and the toner scatter can be securely prevented, and the replacement work is very easy at the same time.

Still more, in the state that the toner cartridge TC is dismounted from the storing recess 500 of the image forming apparatus main body 1, the toner dropping openings 10*a*, 20*a* are securely closed by the outer seal member 40. That is, the outer seal member 40 serves also as the shutter when transporting the toner cartridge TC, and hence any particular shutter is not needed.

Embodiment 2

FIG. 28A to FIG. 36 relate to the second embodiment of the invention.

Figure 28A:
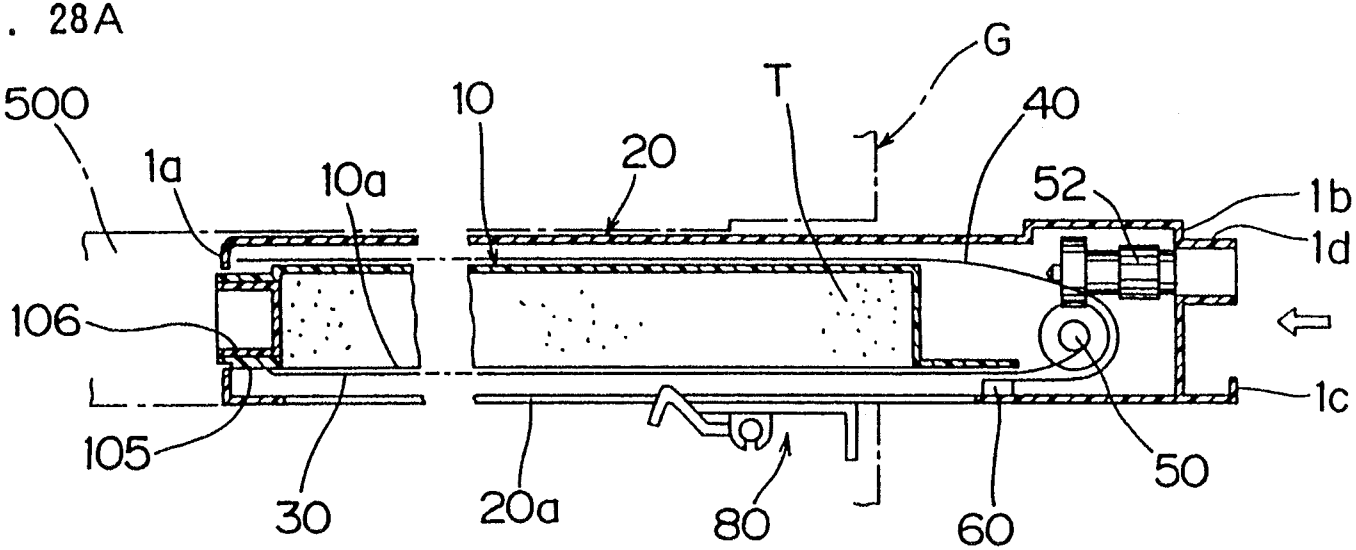
FIG. 28A and FIG. 28B are schematic sectional views sequentially showing the steps of insertion of the toner cartridge into the storing recess of the image forming apparatus main body in a second embodiment of the invention.
Figure 28B:
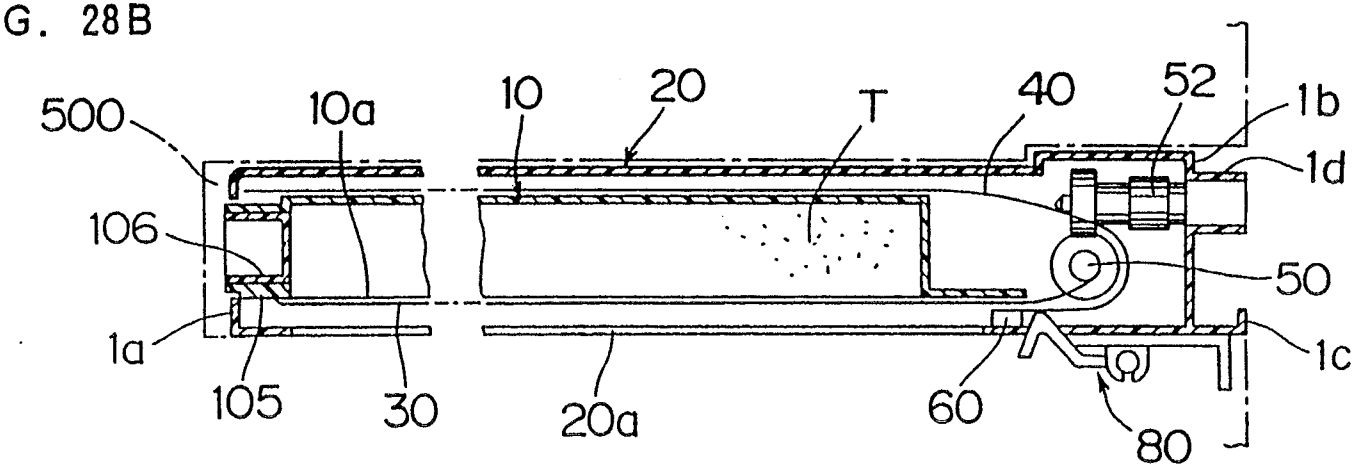

Principal differences between Embodiment 2 and Embodiment 1 are as follows.

i) In Embodiment 1, the toner dropping openings 10*a*, 20*a* of the toner cartridge TC before being settled in the storing recess 500 were closed by the outer seal member 40. In Embodiment 2, by contrast, the toner dropping openings 10*a*, 20*a* of the toner cartridge TC before being settled in the storing recess 500 are opened as shown in FIG. 28A representing the settling step. Meanwhile, when settling of the toner cartridge TC in the storing recess 500 is complete, the slide member 60 is arrested of relative move to the toner cartridge main body 1 by opening position stopper means (not shown), and the slide member 60 rides over the engaging protrusion 82*b* of the slide member moving member 80, and moves from the rightward position of the engaging protrusion 82*b* (see FIG. 28A) to the leftward position (see FIG. 28B). When the toner cartridge TC is spent and drawn out of the storing recess 500, although not shown in the drawings, the toner dropping openings 10*a*, 20*a* are closed by the outer seal member 40, same as in Embodiment 1, by the action of the slide member moving member 80 and slide member 60.

ii) In Embodiment 1, the take-up shaft 50 as the take-up means projected to the side of the toner cartridge main body 1, and was provided with the drive coupling shaft 91 disposed coaxially with the take-up shaft 50.

Figure 29:
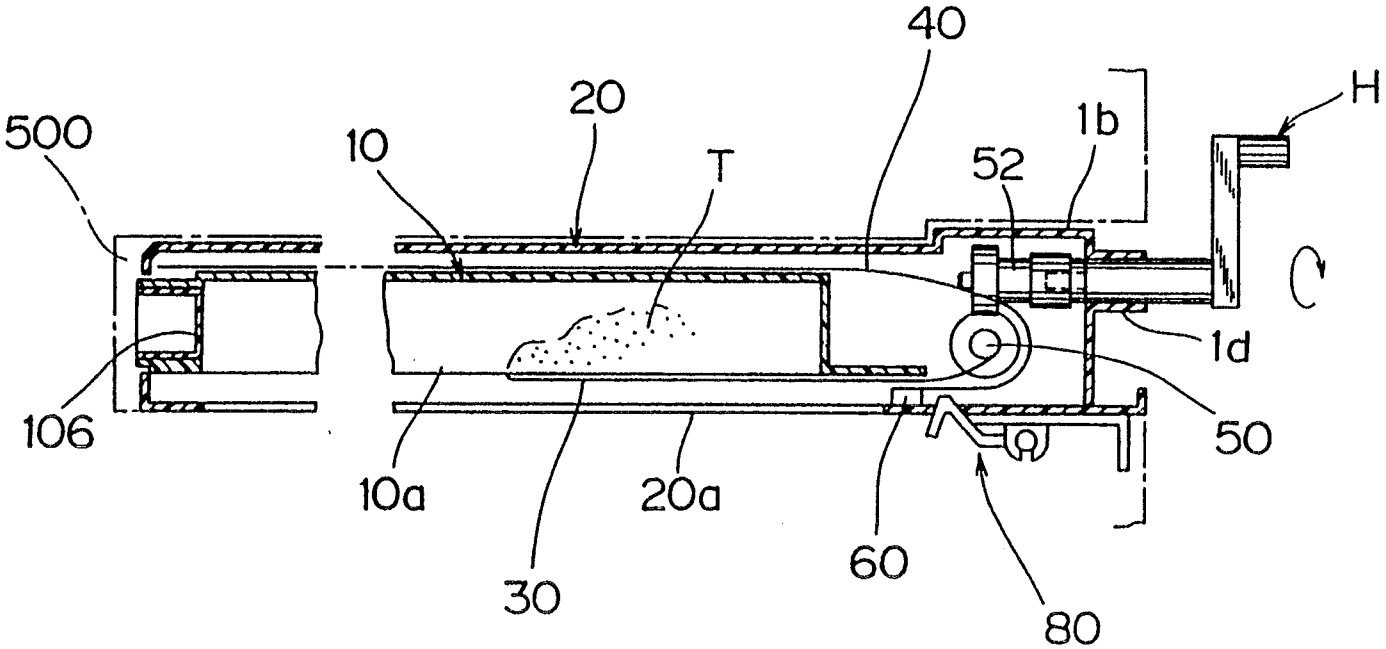
FIG. 29 is a schematic sectional view showing the step of peeling off the inner seal member of the mounted toner cartridge.
Figure 30:
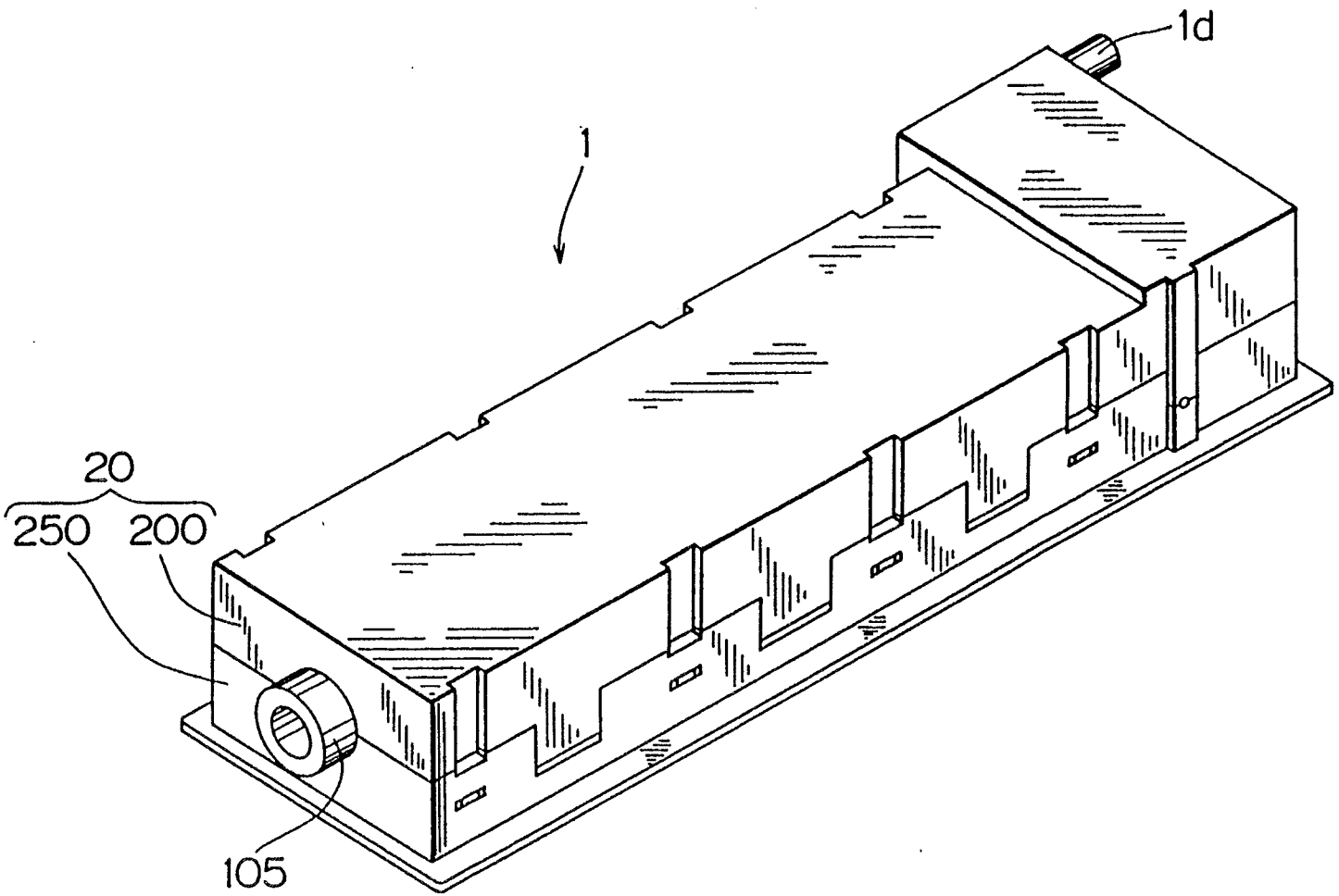
FIG. 30 is a perspective view of a toner cartridge main body.
Figure 31:
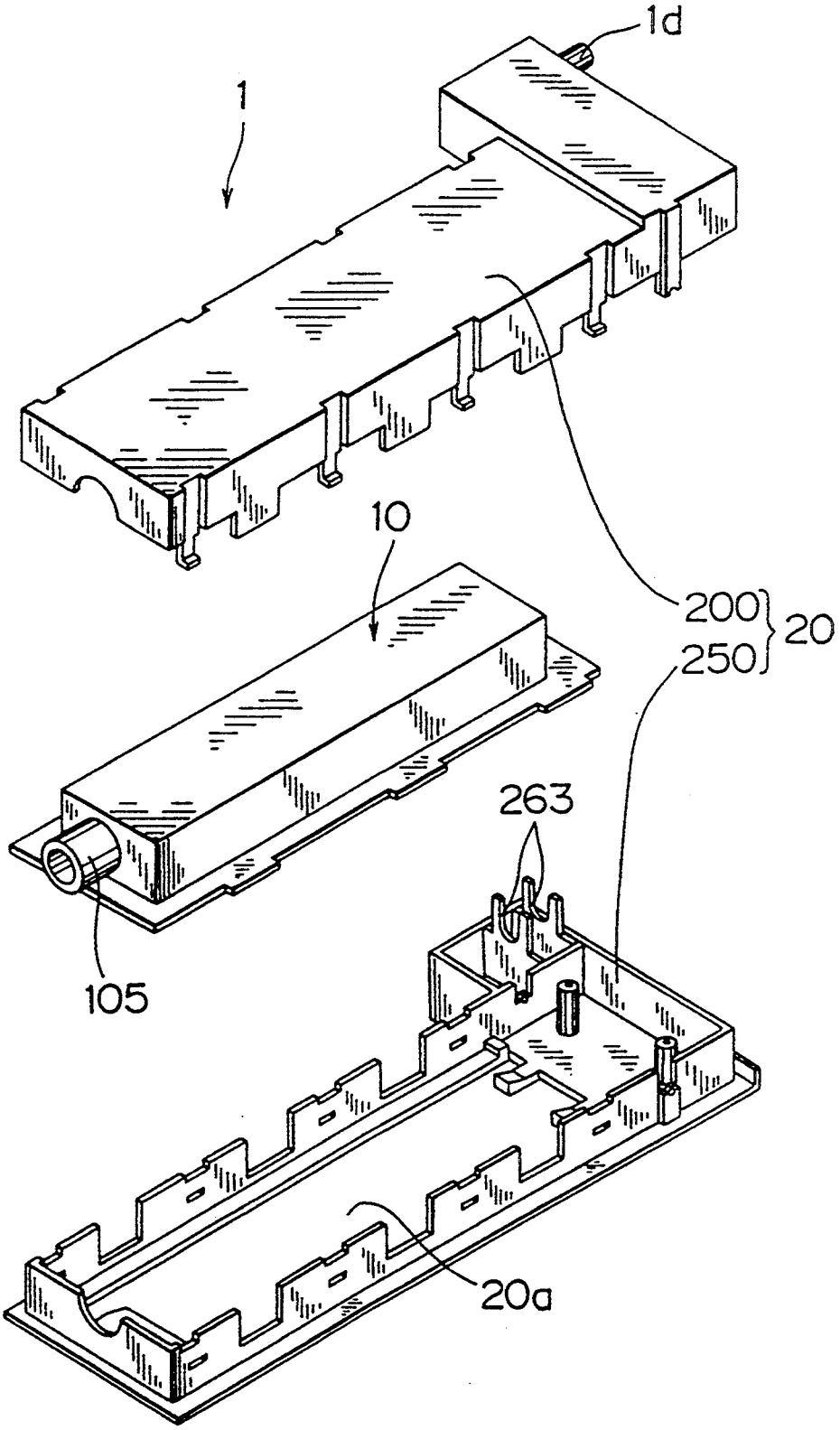
FIG. 31 is an exploded perspective view of the toner cartridge main body.
Figure 32:
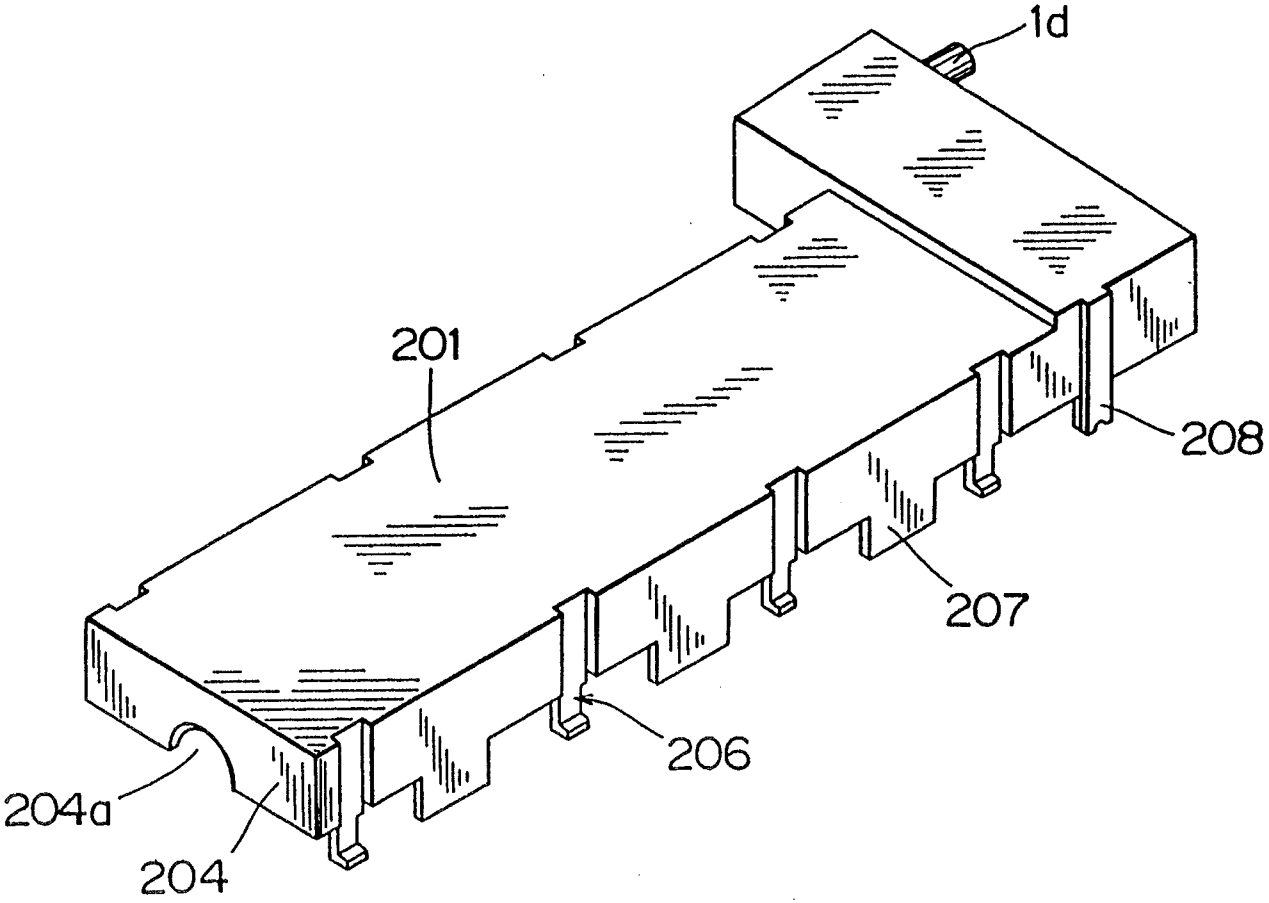
FIG. 32 is a perspective view of an upper casing for composing the upper part of an outer container.

By contrast, in Embodiment 2, instead of the take-up shaft 50 in Embodiment 1, a take-up shaft 51 forming a first gear 51*a* at one end is used, and instead of the drive coupling shaft 91 in Embodiment 1, a drive coupling shaft 52 forming a second gear 52*a* rotated in engagement with the first gear 51*a* at one end is used. A screw gear mechanism is composed of the first and second gears 51*a*, 52*a*. The drive coupling shaft 52 is disposed along the direction parallel to the direction orthogonal to the take-up shaft 51. The right end of the drive coupling shaft 52 in FIG. 28A is confronting the handle insertion tube 1*d* (see FIG. 28A to FIG. 33) provided at the withdrawal side end 1*b* of the toner cartridge main body 1. After putting the toner cartridge TC into the storing recess 500, to peel off the inner seal member 30, as shown in FIG. 29, the hand turning handle H inserted in the handle insertion tube 1*d* is coupled with the drive coupling shaft 52 so as to rotate in unison, and the hand turning handle H is rotated to drive the take-up shaft 51.

iii) In Embodiment 2, referring to FIG. 30 to FIG. 32, the upper casing 200 composing the upper part of the outer container 20 of the toner cartridge main body 1 forms the handle insertion tube 1*d* at the end of the withdrawal side end 1*b*. Besides, as shown in FIG. 33, at a specified position of the lower casing 250, a pair of support parts 263 for rotatably supporting the drive coupling shaft 52 are formed, and similar support parts (not shown) are formed at the corresponding parts of the upper casing 200.

Figure 33:
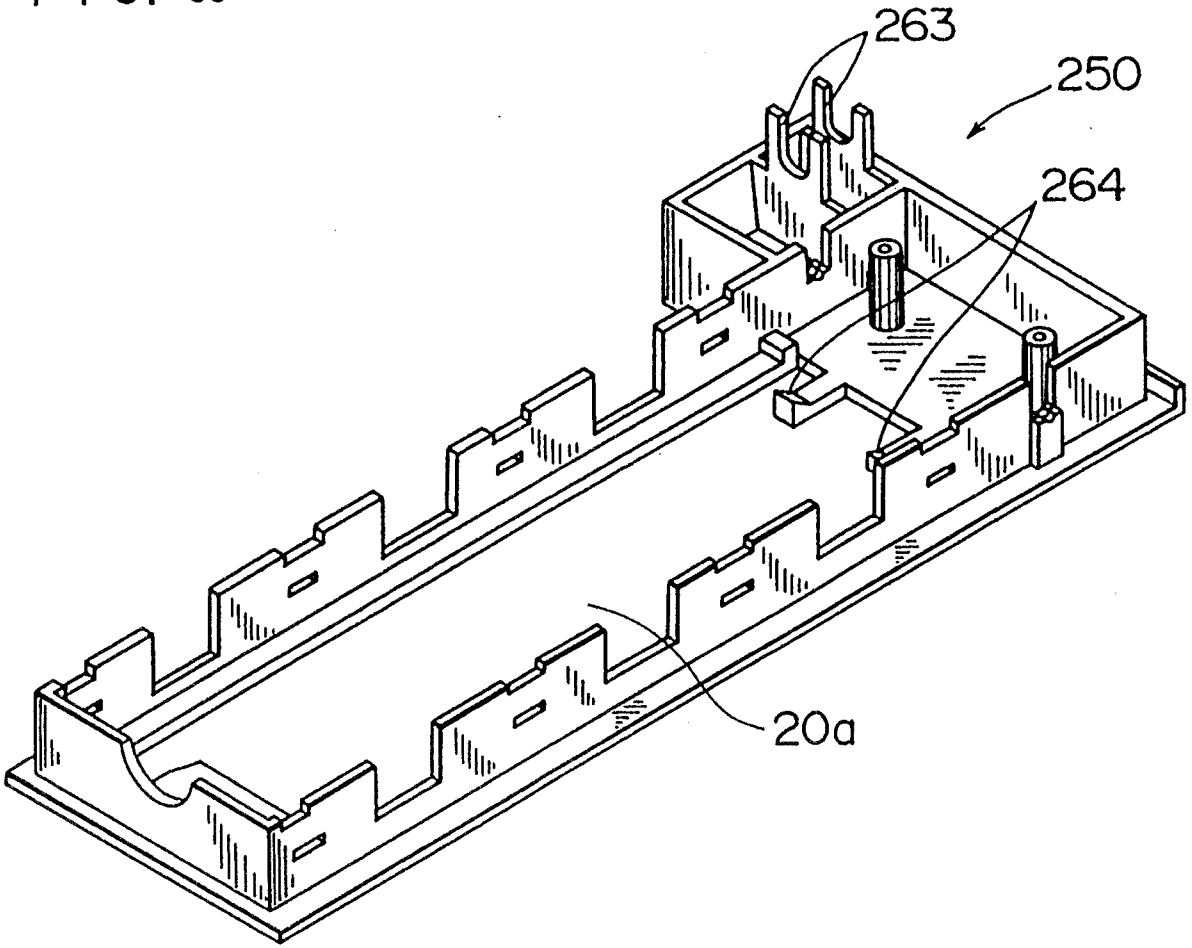
FIG. 33 is a perspective view of a lower casing for composing the lower part of the outer container.
Figure 34:
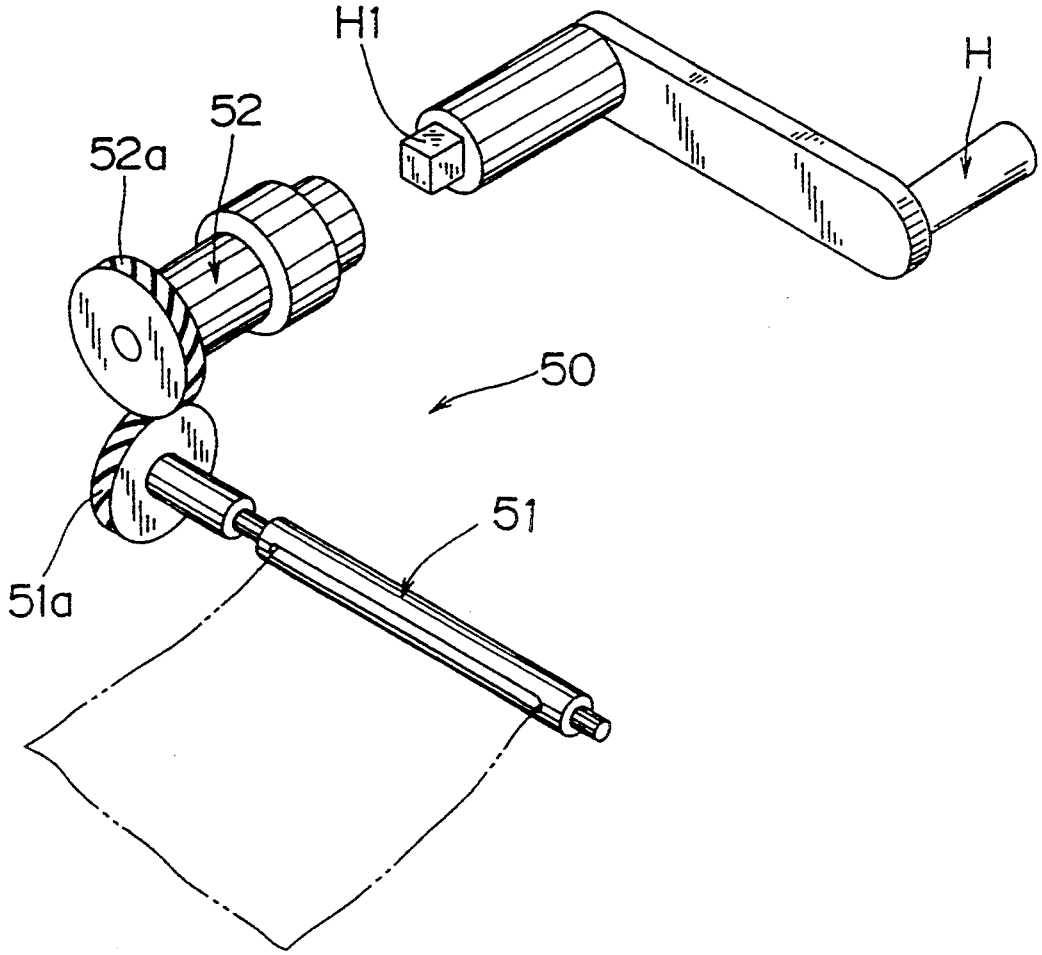
FIG. 34 is an exploded perspective view of take-up means.
Figure 35:
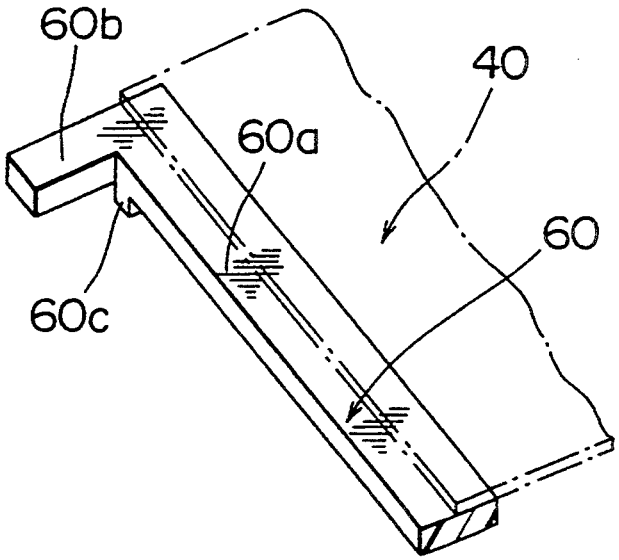
FIG. 35 is a partially sectional perspective view of a slide member.
Figure 36:
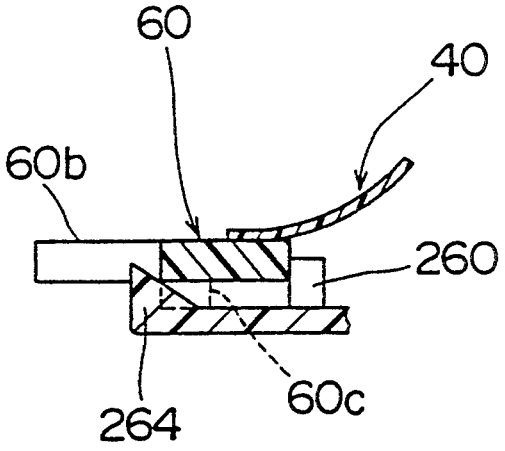
FIG. 36 is an essential sectional view showing the engaged state of the slide member
Figure 37:
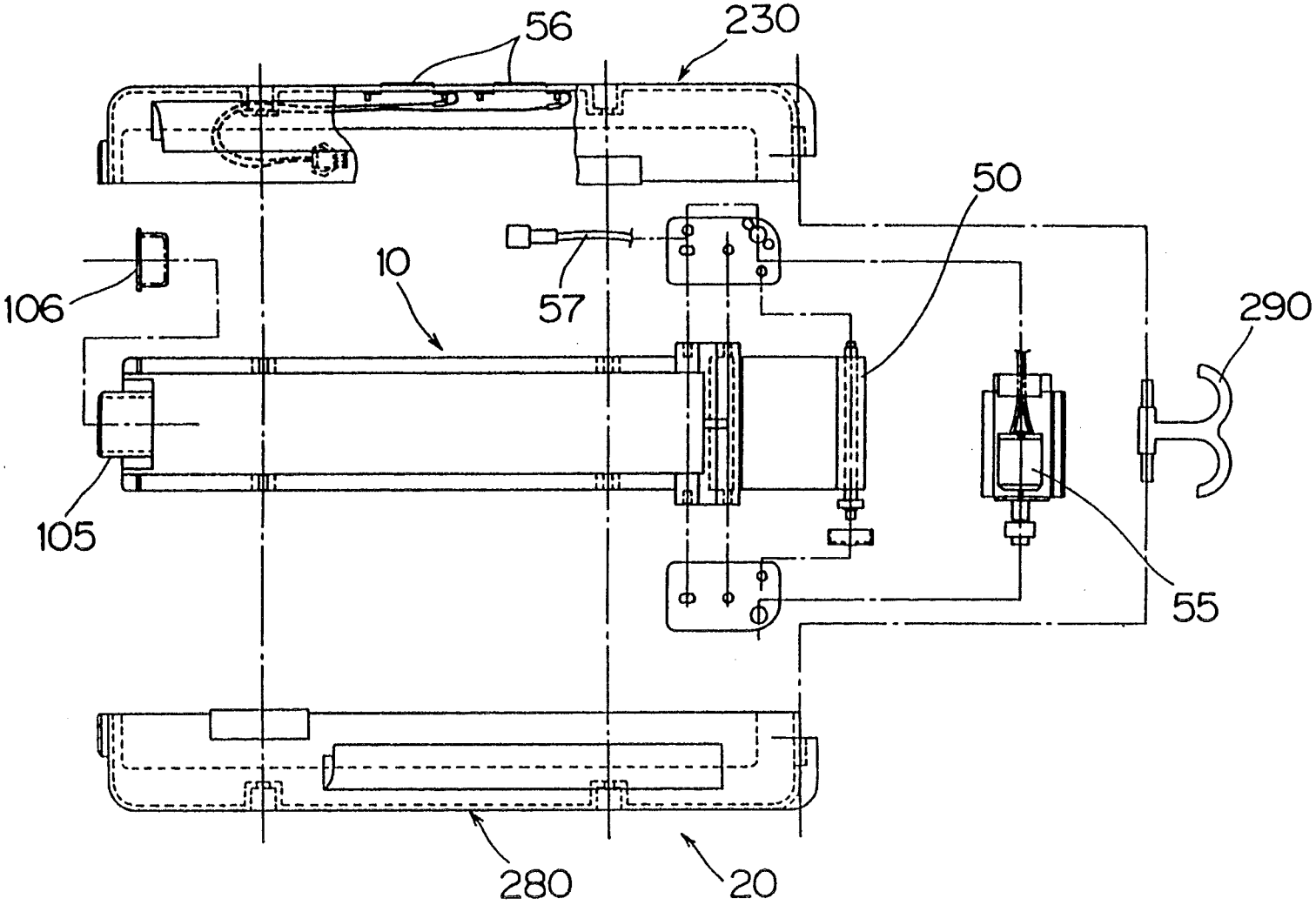
FIG. 37 is an exploded plan view of a toner cartridge relating to a third embodiment of the invention.
Figures 38A, 38B, 38C:
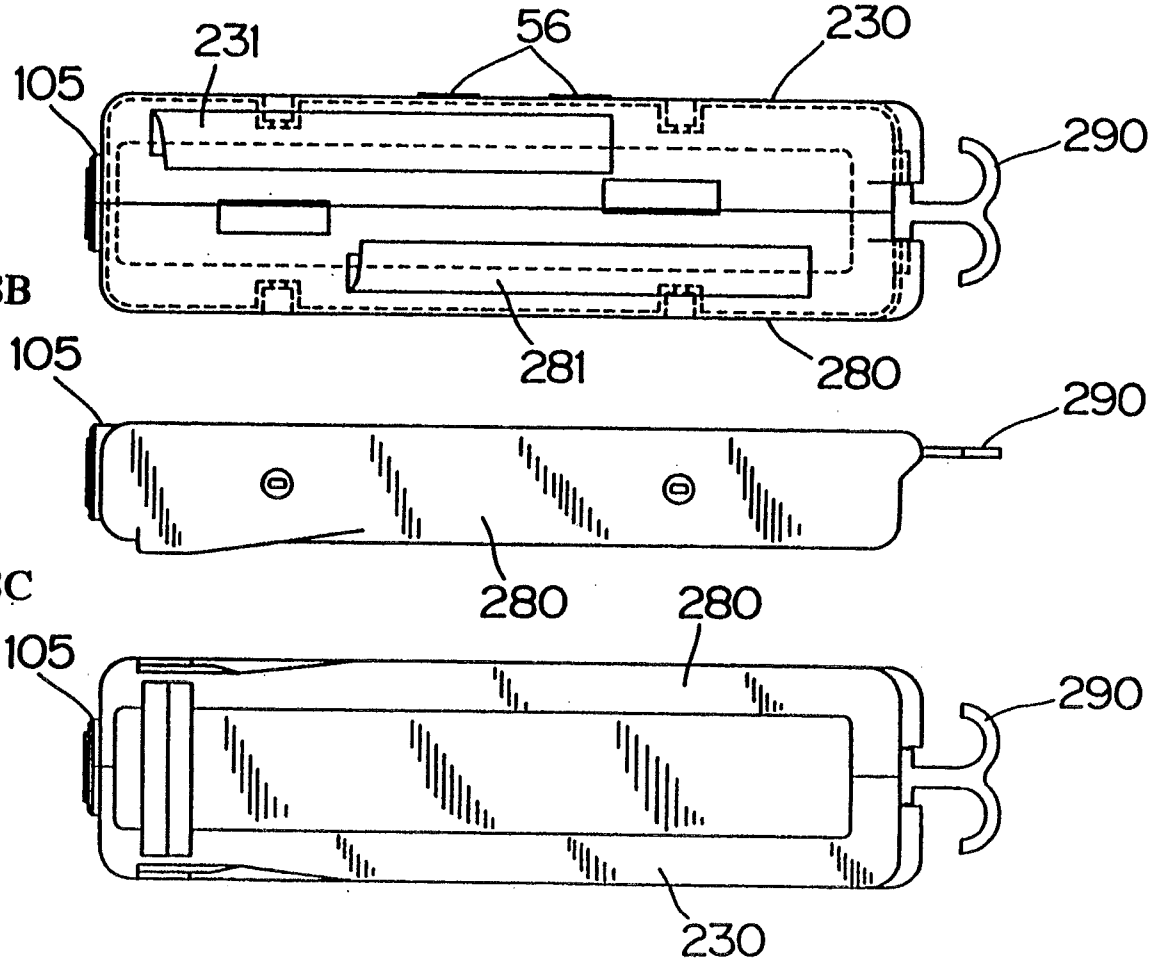
FIG. 38A, FIG. 38B, and FIG. 38C are plan, side and bottom views of the toner cartridge.

Referring to FIG. 33, at the lower edge 251 of the lower casing 250, there are formed pawl members 264 for presenting a pair of slide member move suppressing means projecting into the toner dropping opening 20*a* from the edge of the withdrawal side end 1*b* side of the toner dropping opening 20*a*. These pawl members 264 arrest the slide member 60 with a specified holding force as shown in FIG. 36, and hold the outer seal member 50 in open state. The section of the main body 60*a* of the slide member 60 is rectangular as shown in FIG. 35.

The other constitution is same as in Embodiment 1, and its explanation is omitted by identifying the related parts with the same reference numbers.

In Embodiment 2, also, when removing for replacement, the toner dropping openings 10*a*, 20*a* are automatically closed by the outer seal member 40 not contaminated with the toner, and the toner scatter can be securely prevented, and the replacement work is very easy.

Embodiment 3

FIG. 37 and FIGS. 38A, 38B, 38C relate to the third embodiment. Referring to the drawings, Embodiment 3 differs from Embodiments 1 and 2 in the following points i) to iv).

i) The outer container 20 is divided into right and left casings 230, 280.

ii) A motor 55 for driving the take-up shaft 50 is disposed in the space between the inner container 10 and outer container 20. A pair of terminals 56 for feeding power to this motor 55 through led wires 57 are exposed at the side surface of the left casing 230. These terminals 56 are designed to contact with the power feeding terminals (not shown) disposed at the side surface in the storing recess 50 with the toner cartridge TC settling in the storing recess 500.

iii) A tiltable T-shaped handle 290 is attached to the withdrawal side end 1*b* of the toner cartridge main body 1.

iv) On the upper surfaces of the right and left casings 230, 280, guide rails 231, 281 to be guided to specified parts in the storing recess 500 are provided.

The other constitution is same as in Embodiments 1 and 2, and its explanation is omitted by identifying with the same reference numbers. The internal structure is same as in Embodiment 1, except that the structure for engaging the slide member 60 is omitted, and hence it is not shown in the drawing.

In this embodiment, the inner seal member 30 can be taken up automatically by a motor, not manually.

Embodiment 4

FIG. 39A to FIG. 41 relate to the fourth embodiment of the invention.

Figure 39A:
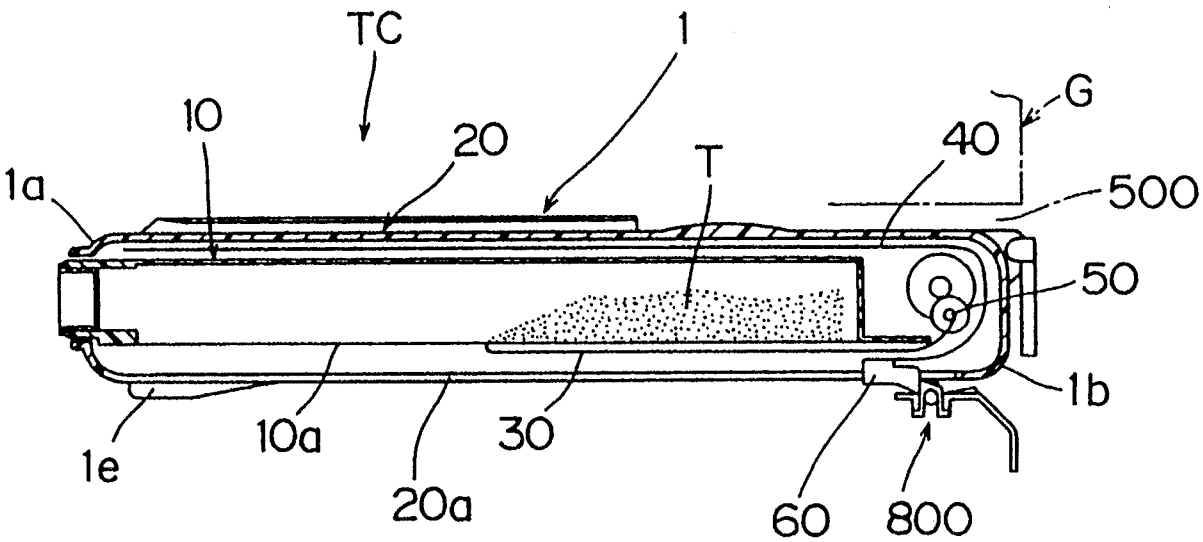
FIG. 39A and FIG. 39B are schematic sectional views showing a step of peeling off the inner seal member in an installed state of toner cartridge in a fourth embodiment of the invention, and an intermediate step of withdrawal of a spent toner cartridge.
Figure 39B:
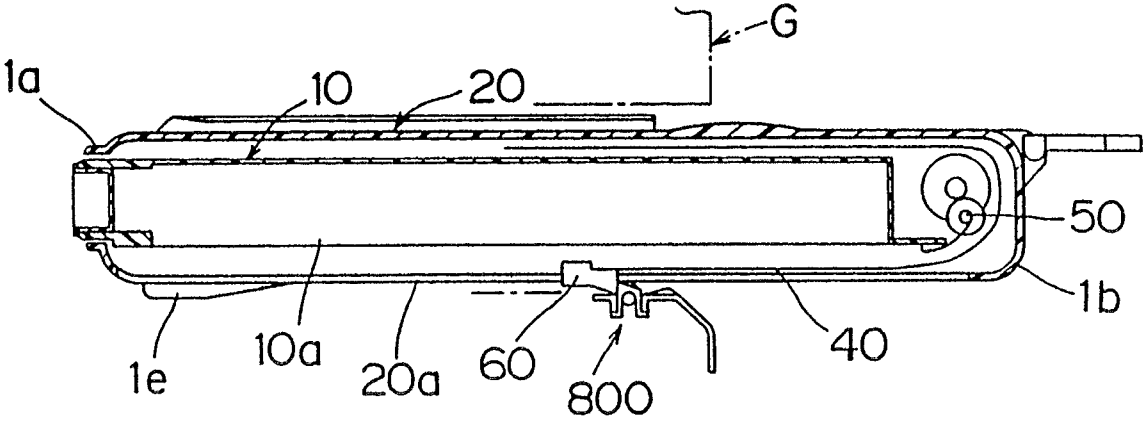

Referring first to FIG. 39A, a sloped withdrawal guide 1*e* is formed in the bottom of the lead-in side end 1*a* of the outer container 20 of the toner cartridge main body 1. As shown in FIG. 39A, after the inner seal member 30 is peeled off, the spent toner cartridge TC is drawn out as shown in FIG. 39B. At this time, the slide member 60 is moved relatively to the toner cartridge main body 1 by the slide member moving member 800, and the outer seal member 40 is moved in the closing direction. So far, it is same as in Embodiment 2.

Figure 40A:
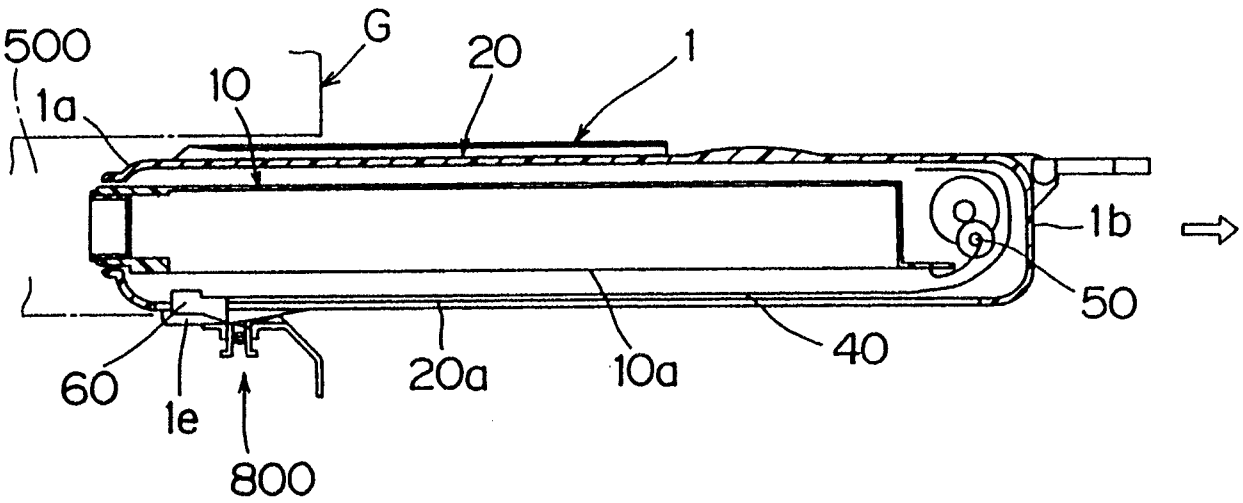
FIG. 40A and FIG. 40B are schematic sectional views showing the state immediately before and the state immediately after completion of withdrawal of toner cartridge.
Figure 40B:
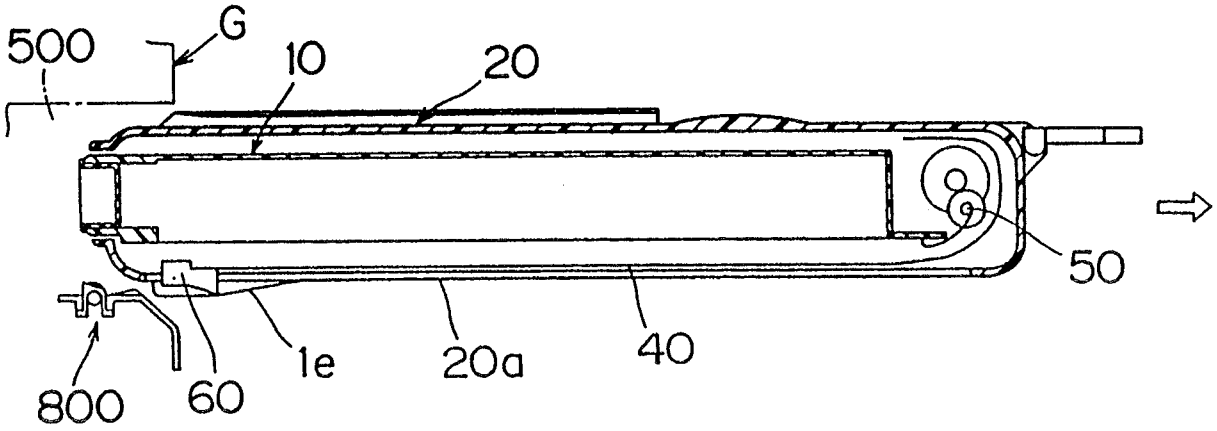

What Embodiment 4 differs from the other embodiments is the following points. As shown in FIG. 40A, just before completion of withdrawal of the toner cartridge TC, this withdrawal guide 1*e* lifts the lead-in side end 1*a* of the toner cartridge main body 1, in the state of being guided by the abutting part 810*f* described below of the slide member moving member 800, and thereby smoothly canceling the engagement between the slide member 60 and the slide member moving member 800 (see FIG. 40B).

Figure 41:
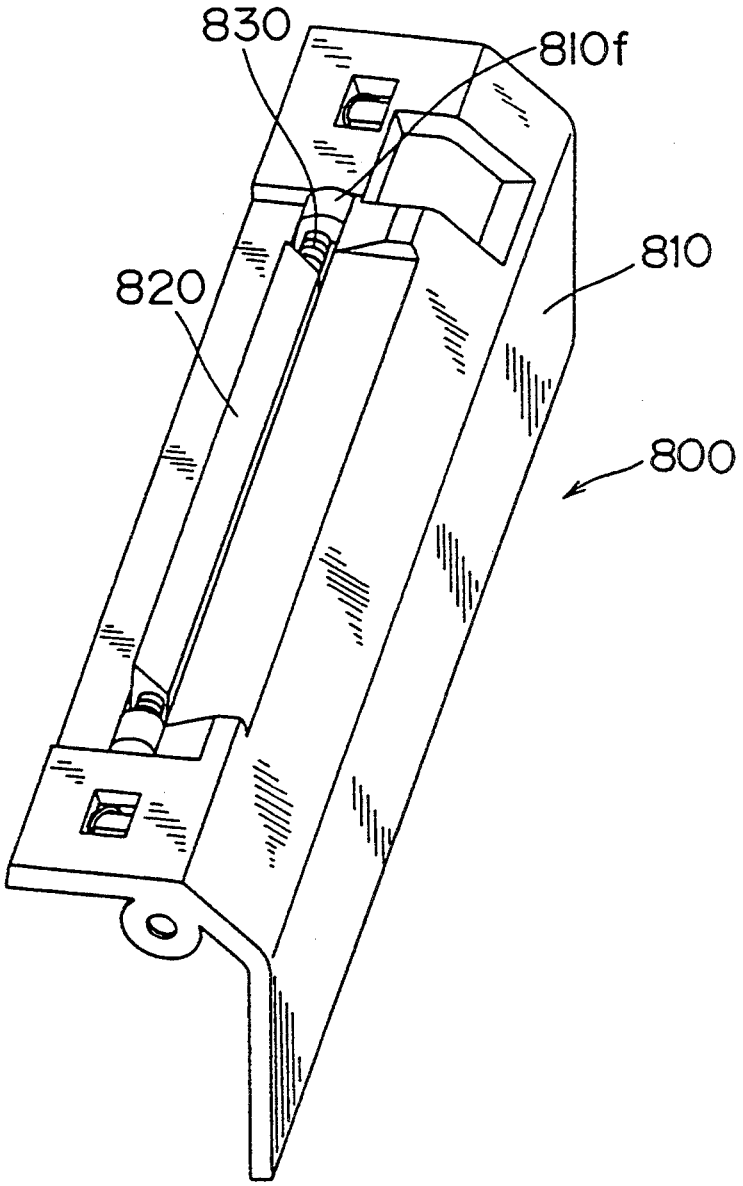
FIG. 41 is a schematic perspective view of slide member moving means.

Then, referring to FIG. 41, the slide member moving member 80 in Embodiment 4 comprises a fixed member 810, an engaging protruding member 820 of an angle section to be engaged with the slide member 60, disposed in the recess of the fixed member 810 being free to move back and forth by vertical motion, and a tension coil spring 830 with the both ends suspended on the fixed member 810 in a state of penetrating through the engaging protruding member 820, for thrusting the engaging protruding member 820 upward. A pair of abutting parts 810*f* are provided closely to both ends in the longitudinal direction of the engaging protruding member 820 of the fixed member 810.

Embodiment 5

Figure 42:
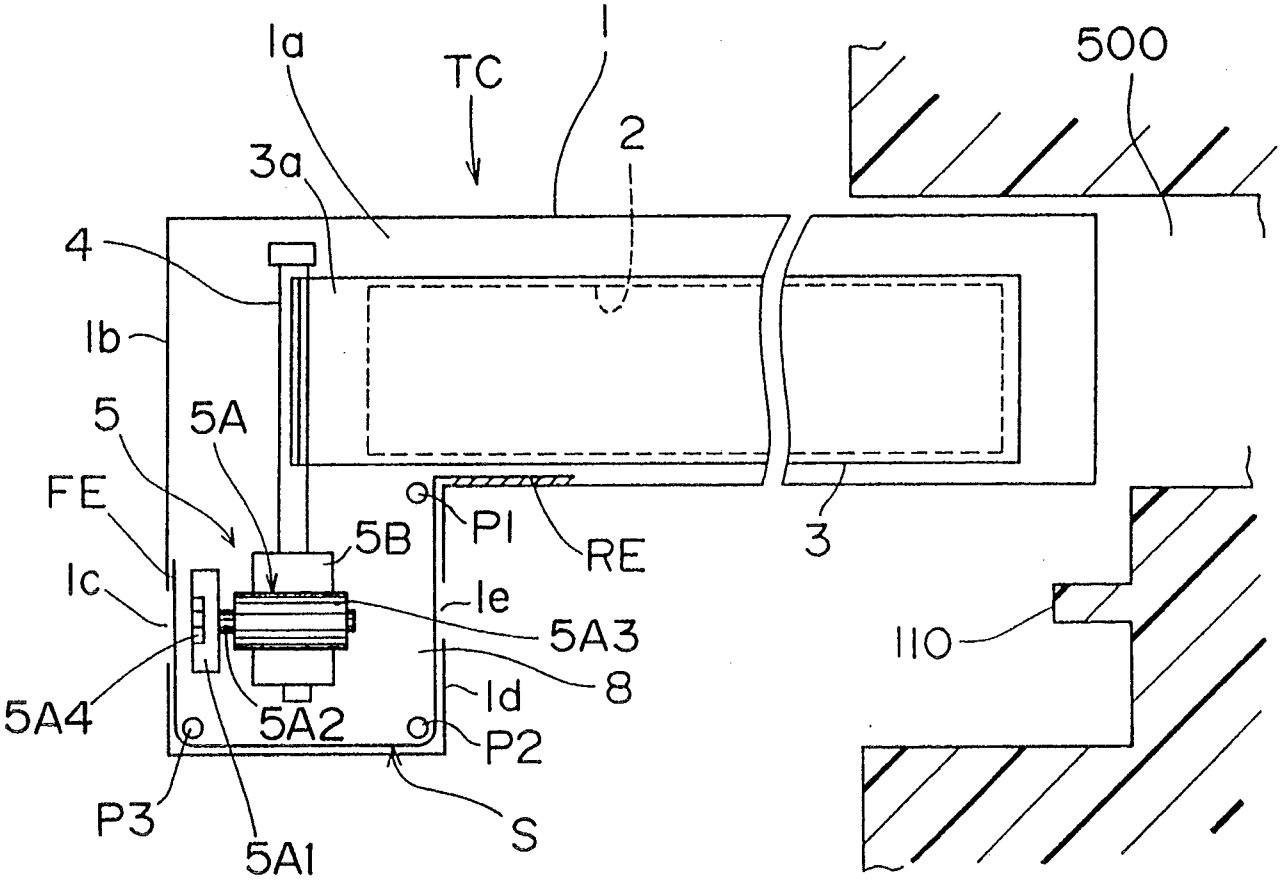
FIG. 42 is a schematic diagram of a toner refilling device in a fifth embodiment of the invention.
Figure 43:
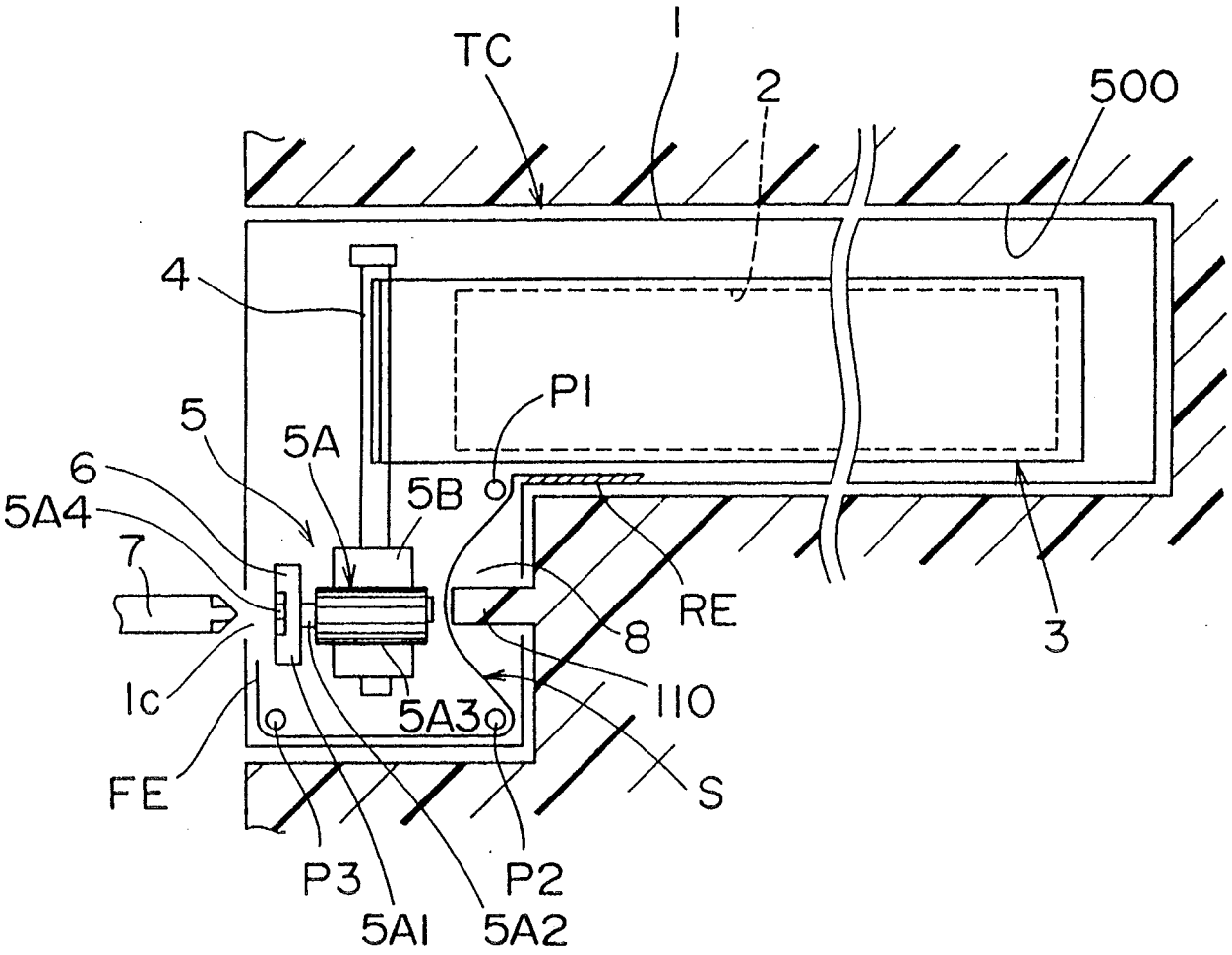
FIG. 43 is a schematic diagram showing the set state of toner cartridge.

FIG. 42 and FIG. 43 are schematic diagrams showing a toner refilling device in the fifth embodiment of the invention. FIG. 42 shows the state before the toner cartridge TC is set in the storing recess 500 of the image forming apparatus main body G, and FIG. 43 shows the complete setting state.

The toner cartridge TC has an approximately L-shaped section in a plan view, and comprises i) a toner cartridge main body 1 containing the toner, ii) a toner dropping opening 2 provided in the bottom 1*a* of the toner cartridge main body 1, iii) a seal member 3 in a sheet form for closing the toner dropping opening, being peelably adhered to the lower surface of the toner cartridge main body 1 in fresh state of the toner cartridge TC, iv) a take-up shaft 4 as take-up means for fixing one end 3*a* of the seal member 3, peeling off the seal member 3, and taking it up, and v) driving force transmitting means for transmitting the driving force of a driver 7 as an external driving member to the take-up shaft 4.

The driving force transmitting means 5 comprises a driving gear member 5A coupled with the driver 7, and a worm wheel 5B for presenting a driven gear member that can rotate together with the take-up shaft 4. The driving gear member 5A consists of a disk 5A1 forming a fitting groove 5A4 as the drive coupling recess to be coupled with the driver 7, a worm shaft 5A2 fixing the disk 5A1 rotatably together at one end, and a worm 5A3 coaxially fixed on the worm shaft 5A2. The worm wheel 5B as the driven gear member is engaged with the worm 5A3, and is fixed coaxially at one end of the take-up shaft 4. The fitting groove 5A4 is a cross groove for fitting the driver 7, being formed in the central part of the end of the disk 5A1.

In the portion confronting the disk 5A1 of the withdrawal side end 1*b* of the toner cartridge main body 1, a driving member insertion hole 1*c* is formed for driving and coupling the driver 7 to the fitting groove 5A4 of the disc 5A1, as required, by inserting the driver 7 from outside of the toner cartridge main body 1. What is characteristic of this embodiment is that a shutter member S composed of a sheet member is provided in the toner cartridge main body 1 as route cut-off means for opening and closing the driving member insertion hole 1*c*, and that a push rod 110 is provided in the storing recess 500 as the releasing means for pushing and releasing the shutter member S.

The shutter member S runs along the inner side of the toner cartridge main body 1 in a ladle shape, with one end fixed at the inner side of the toner cartridge main body 1 (hereinafter this one end is called the restricted end RE), while the other part in a slidable state along the inner side of the toner cartridge main body 1. The other end of the shutter member S (hereinafter called the free end FE) is usually closing the driving member insertion hole 1*c* of the toner cartridge main body 1, and releases the driving member insertion hole 1*c* along with the sliding motion. The toner cartridge main body 1 forms first to third guide pins P1 to P3 for guiding the slide of the shutter member S against the inner side of the toner cartridge main body 1, at three bent positions of the shutter member S in a ladle shape. In the toner cartridge main body 1, there is a space 8 for deflecting the shutter member S inward between the first guide pin P1 and second guide pin P2, and a push rod lead-in opening 1*e* for leading the push rod 110 into the space 8 is formed in the back side 1*d* of the toner cartridge main body 1.

According to this embodiment, when the toner cartridge TC is inserted into the storing recess 500 of the image forming apparatus, as shown in FIG. 43, the push rod 110 deflects the shutter member S upon completion of setting, and the free end FE of the shutter member S slides and releases the driving member insertion hole 1*c*. As a result, the driver 7 can be coupled with the fitting groove 5A4 of the disk 5A1 through the driving member insertion hole 1*c*. That is, unless the toner cartridge TC is set completely in the storing recess 500, the seal member 3 cannot be peeled off, so that scattering of toner due to unexpected opening of the toner cartridge TC may be securely prevented.

Figure 51:
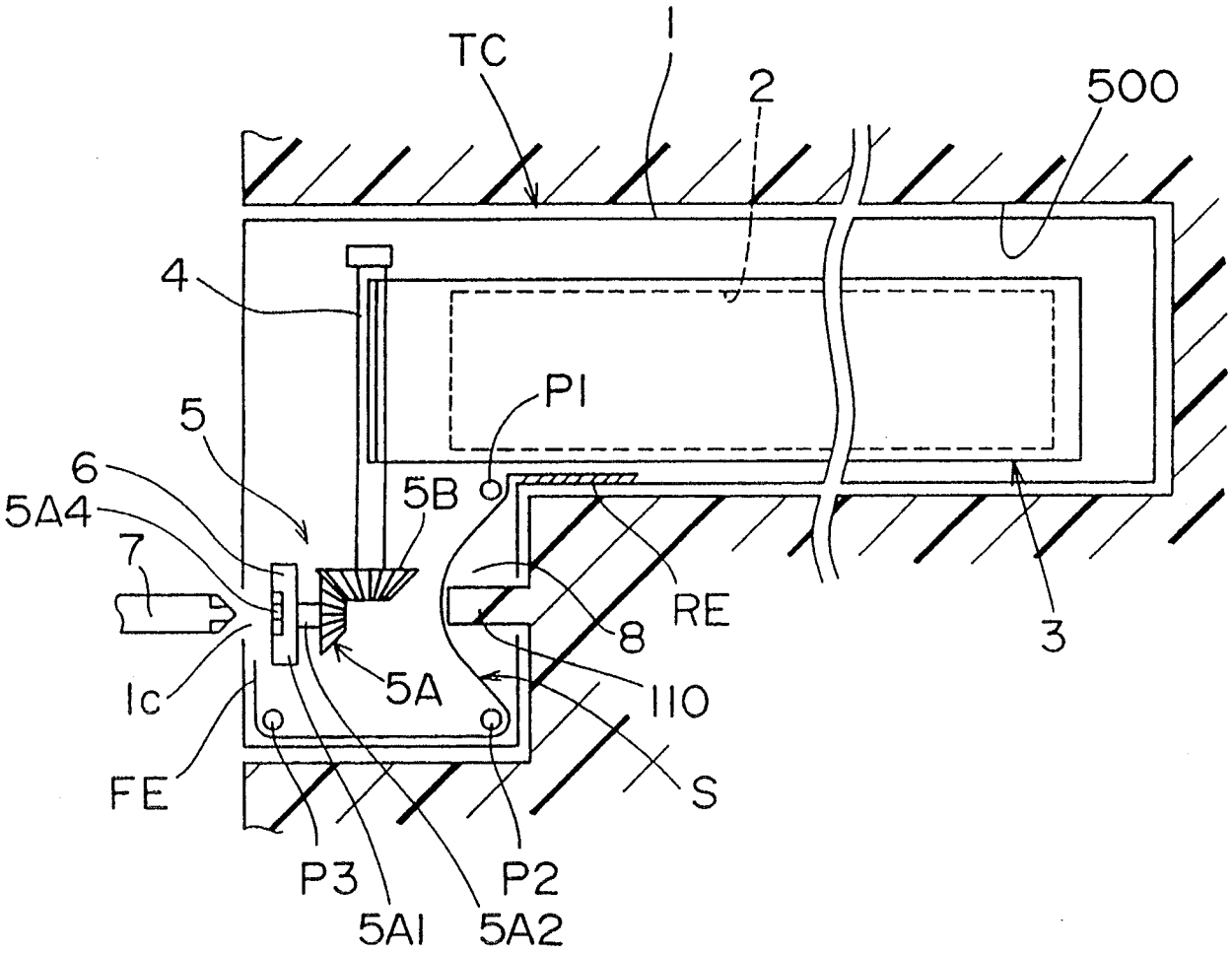
FIG. 51 is a view, similar to FIG. 43 where the skew gear mechanism includes a crossed helical gear mechanism.

FIG. 51 shows an arrangement similar to FIG. 43 accept that the skew gear mechanism includes a crossed helical gear mechanism 5A, 5B in FIG. 51.

Embodiment 6

Figure 44:
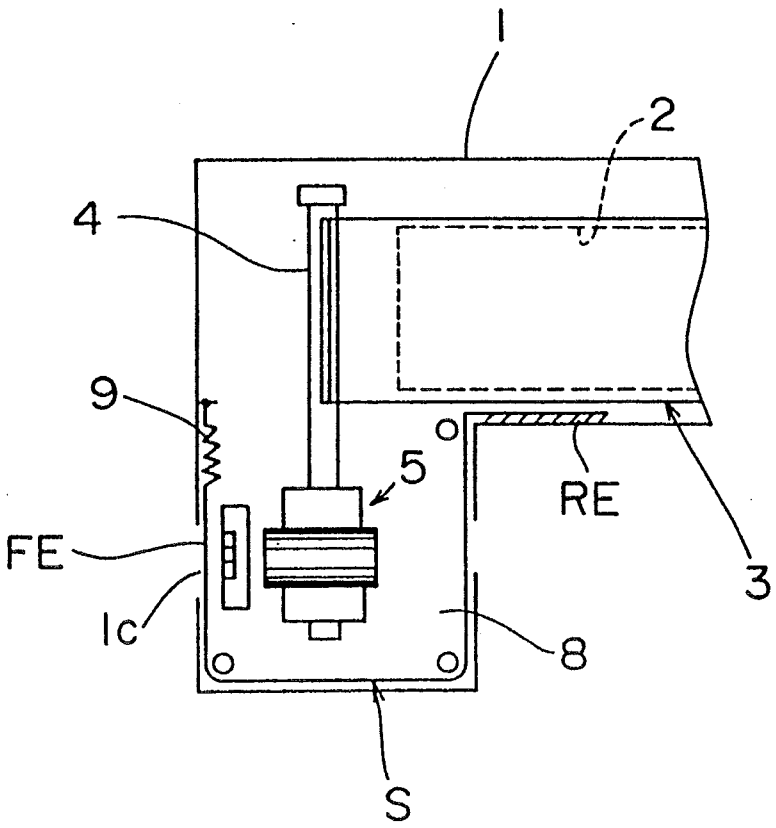
FIG. 44 is an essential schematic diagram of a toner refilling device in a sixth embodiment of the invention.

The sixth embodiment shown in FIG. 44 is a modified example of the fifth embodiment. What this embodiment differs from Embodiment 5 is that the free end FE of the shutter member S is thrust in the direction of closing the driving member insertion hole 1*c*, by the tension coil spring 9 as thrusting means, interspaced between the free end FE of the shutter member S and the engaging part of the toner cartridge main body 1. The other constitution is same as in Embodiment 5, and the same reference numbers are used in the drawing and the explanation is omitted.

According to the embodiment, the driving member insertion hole 1*c* can be closed when drawing out the toner cartridge TC from the storing recess 500. Therefore, if the toner cartridge TC is once set, and immediately removed and set again, unnecessary release of the toner cartridge TC may be prevented at the time of setting again.

Embodiment 7

Figure 45A:
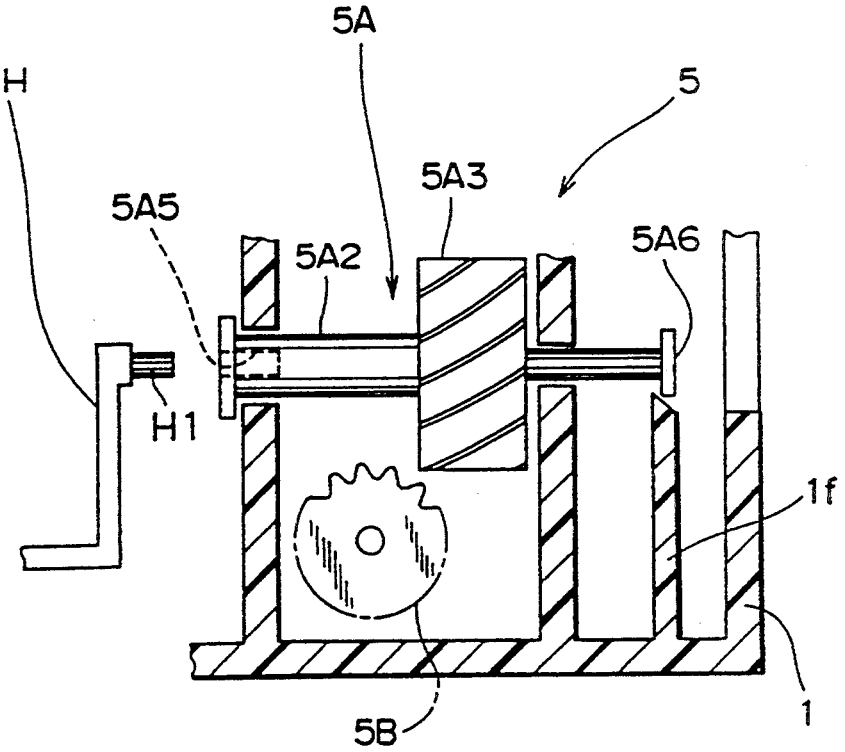
FIG. 45A and FIG. 45B are essential schematic longitudinal sectional views of a toner refilling device in a seventh embodiment of the invention, FIG. 45A showing the state before setting of toner cartridge, and FIG. 45B showing the set state.
Figure 45B:
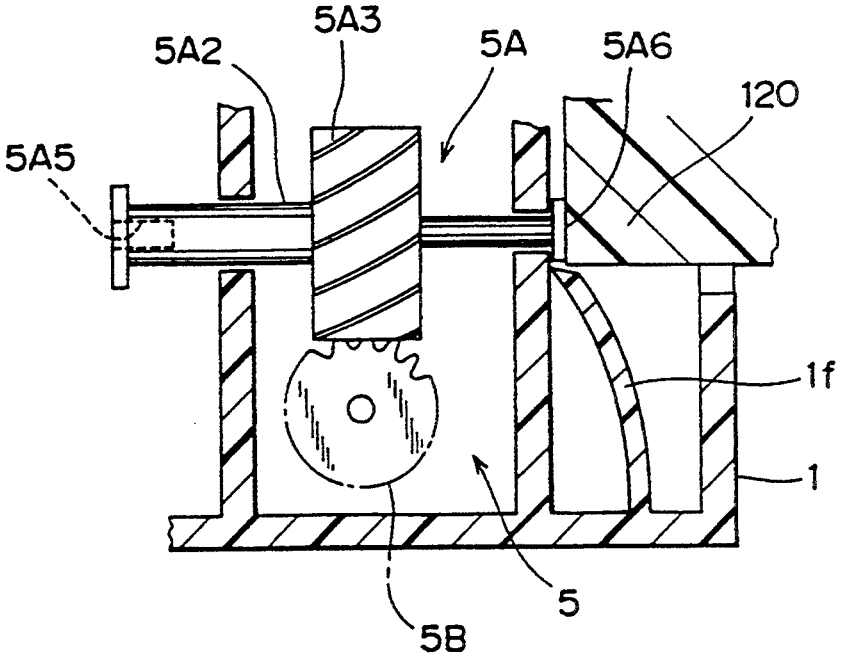

FIG. 45A and FIG. 45B relate to the seventh embodiment of the invention. Referring to these diagrams, what is characteristic of this embodiment is that the drive transmission route is cut off by sliding the driving gear member 5A to the position for canceling the engagement with the worm wheel 5B as the driven gear member. In this embodiment, the route cut-off means is composed of the sliding driving gear member 5A.

The driving gear member 5A is supported by the toner cartridge main body 1, in a manner free to slide between the engaging position with the worm wheel 5B as the driven gear member (see FIG. 45A), and the engagement clearing position (see FIG. 45B). The driving gear member 5A consists of a worm shaft 5A2, and a worm 5A3 coaxially fixed nearly to the central position of the worm shaft 5A2. At one end of the worm shaft 5A2, a fitting hole 5A5 is provided as a drive coupling recess that can be fitted with the coupling protrusion H1 of the hand turning handle H as driving member, while a flange 5A6 is provided at the other end.

The toner cartridge main body 1 is furnished with an elastic rib 1*f* as thrusting means for thrusting the driving gear member 5A to the engagement clearing position. This elastic rib if thrusts the driving gear member 5A to the position for clearing engagement through the flange 5A6. On the other hand, in the storing recess 500 of the image forming apparatus main body G, as shown in FIG. 45B, there is provided a protrusion 120 for presenting operating means for moving the driving gear member 5A to the engaging position, by pushing the flange 5A6 of the driving gear member 5A, upon completion of setting of the toner cartridge TC in the storing recess 500. The other constitution is same as the embodiment shown in FIG. 42, and the explanation is omitted.

According to this embodiment, while the toner cartridge is in fresh state, the driving gear member 5A is held in the position avoiding engagement with the worm wheel 5B by the elastic rib 1*f* as shown in FIG. 45A. Therefore, while the toner cartridge TC is not set in the storing recess 500 of the image forming apparatus main body G, undesired peeling of the seal member 3 is avoided. As a result, toner scatter can be securely prevented. On the other hand, when the toner cartridge TC is set in the storing recess 500, the protrusion 120 of the storing recess 500 moves the driving gear member 5A to the engaging position as shown in FIG. 45B, so that the seal member 3 can be taken up.

Embodiment 8

Figure 46:
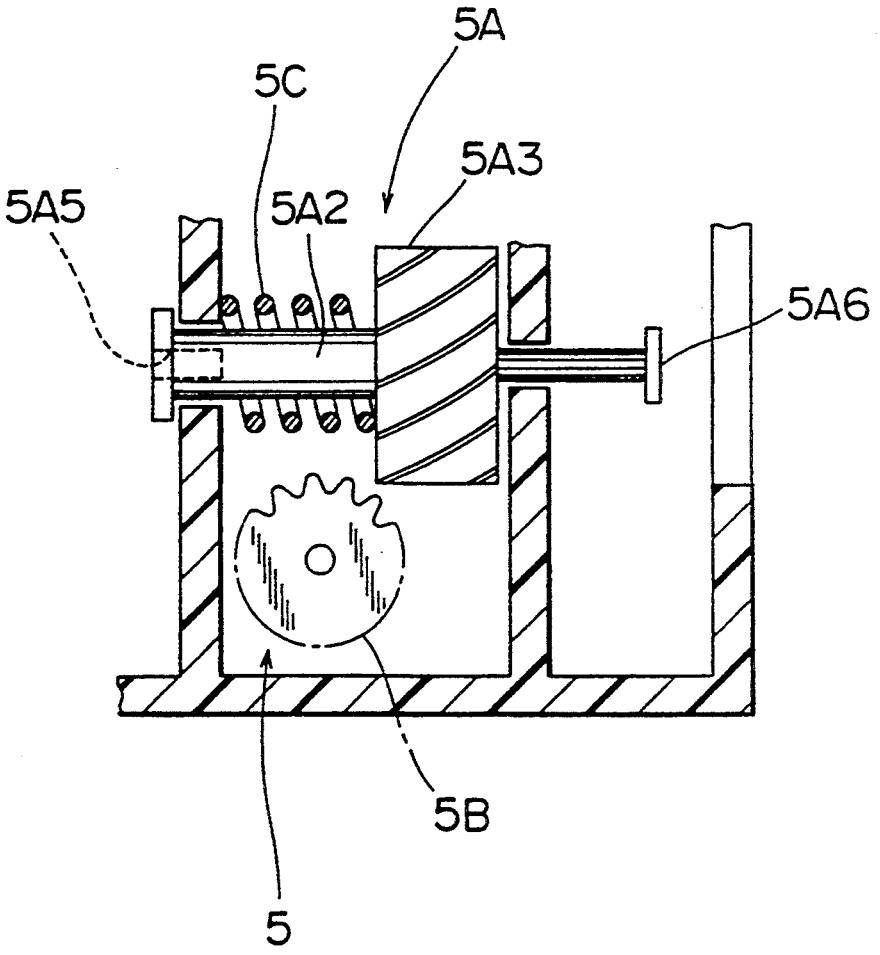
FIG. 46 is an essential schematic sectional view of a toner refilling device in an eighth embodiment of the invention.

FIG. 46 shows a modified example of Embodiment 7. In this Embodiment 8, instead of the elastic rib 1*f* used in Embodiment 7, a compression coil spring 5C interspaced between the worm 5A3 and inner surface of toner cartridge main body 1 is used.

Embodiment 9

Figure 47A:
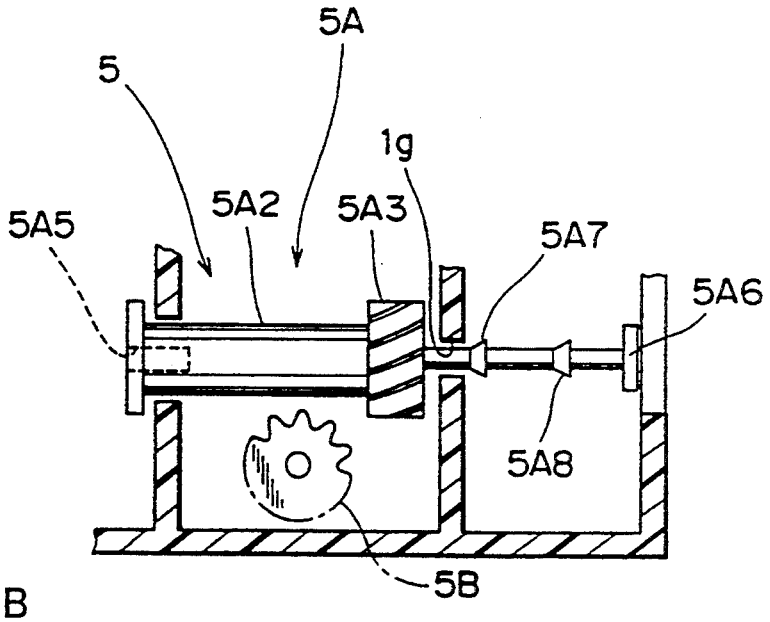
FIG. 47A, FIG. 47B, and FIG. 47C are essential schematic sectional views of a toner refilling device in a ninth embodiment of the invention, FIG. 47A showing the state before setting of toner cartridge, FIG. 47B showing the set state of toner cartridge, and FIG. 47C showing the state of completion of take-up of seal member.
Figure 47B:
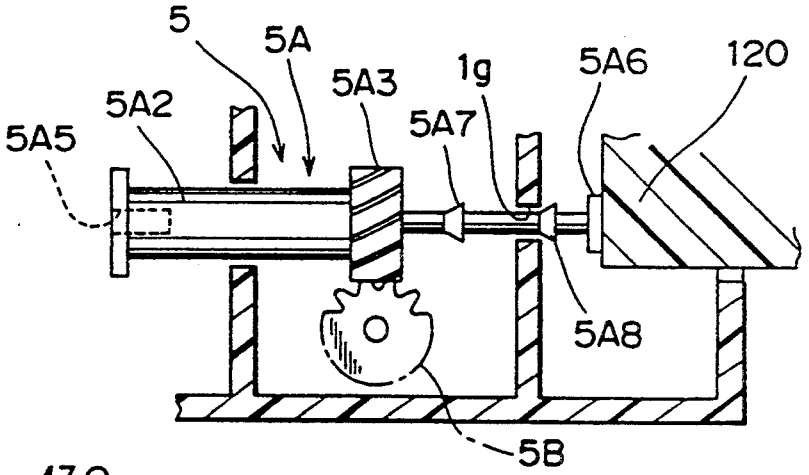
Figure 47C:
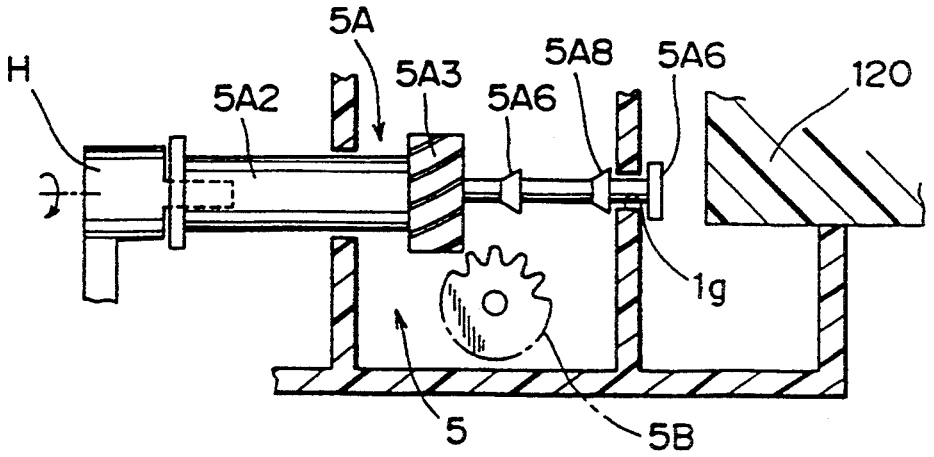

FIG. 47A to FIG. 47C relate to a further different modified example of Embodiment 7. In Embodiment 7, the driving gear member 5A is held in the engagement clearing position by the thrusting means. By contrast, in this modified example, as shown in FIG. 47A, by using a wedge protrusion 5A7 provided at a position closer to the flange 5A6 than the worm 5A3 of the worm shaft 5A2, the driving gear member 5A is held in the engagement clearing position. On the worm shaft 5A2, other wedge protrusion 5A8 is provided at the position closer to the flange 5A6 than the wedge protrusion 5A7.

According to this embodiment, while the toner cartridge TC is not set in the storing recess 500 of the image forming apparatus main body G, as shown in FIG. 47A, the wedge protrusion 5A7 abuts against the right side peripheral part of the worm shaft support hole 1*g* of the toner cartridge main body 1, and accordingly the driving gear member 5A is held in the engagement clearing position. Therefore, the take-up shaft 4 cannot be driven.

When setting the toner cartridge TC in the storing recess 500 of the image forming apparatus main body G, the protrusion 120 pushes the flange 5A6, and penetrates the wedge protrusion 5A7 leftward into the worm shaft support hole 1*g*. In the complete setting state of the toner cartridge, as shown in FIG. 47B, the driving gear member 5A is moved to the position to be engaged with the worm wheel 5B. As a result, it is ready to take up, and the driving gear member 5A is driven by the handle H, and the seal member can be taken up on the take-up shaft 4. In the state shown in FIG. 47B, incidentally, the other wedge protrusion 5A8 abuts against the right side peripheral edge of the worm shaft support hole 1*g*, and the driving gear member 5A is held in the engagement position by a specified holding force.

When take-up of the seal member 3 by the take-up shaft is over, the worm wheel 5A3 is in locked state, and even after the locked state, by turning the driving gear member 5A continuously by the handle H, the driving gear member 5A receives a driving reaction from the worm wheel 5B. By this driving reaction, if it exceeds the holding force by the wedge protrusion 5A8, the driving gear member 5A is moved to the left in the axial direction as shown in FIG. 47C, to a position avoiding engagement. In this state, the wedge protrusion 5A8 is penetrating through the worm shaft support hole 1*g*, and the wedge protrusion 5A8 prevents the driving gear member 5A from being to the engagement position as shown in FIG. 47B. Therefore, instead of completion of take-up of the seal member 3, if the handle H is turned continuously, the toner cartridge main body 1 will not be broken. Besides, due to sudden rise of the rotation load of the handle H, completion of take-up is noticed to the operator, so that occurrence of breakage may be prevented.

Embodiment 10

Figure 48A:
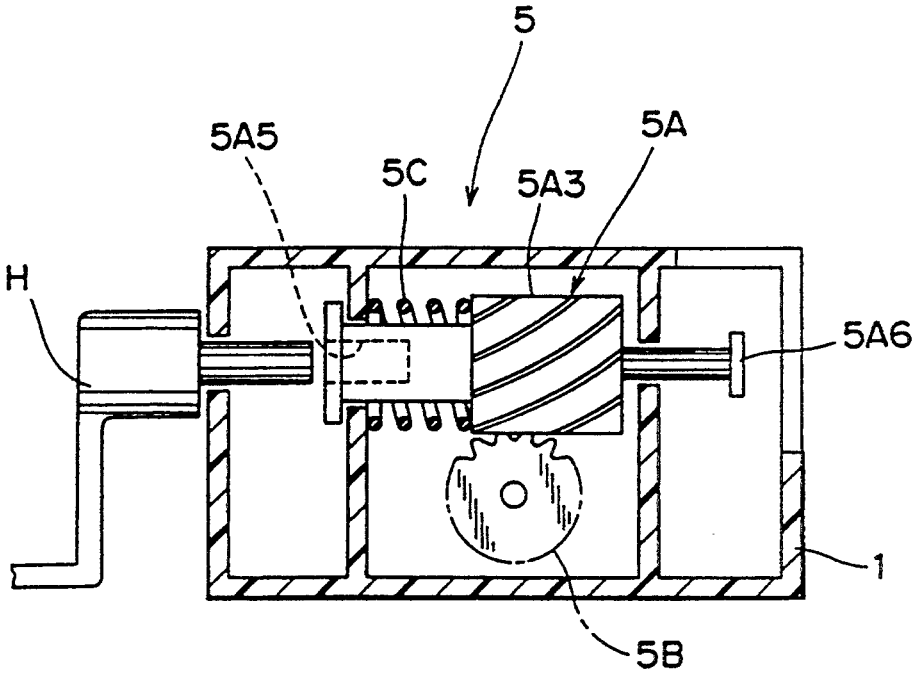
FIG. 48A and FIG. 48B are essential schematic sectional views of a toner refilling device in a tenth embodiment of the invention, FIG. 48A showing the state before setting of toner cartridge, and FIG. 48B showing the set state of toner cartridge.
Figure 48B:
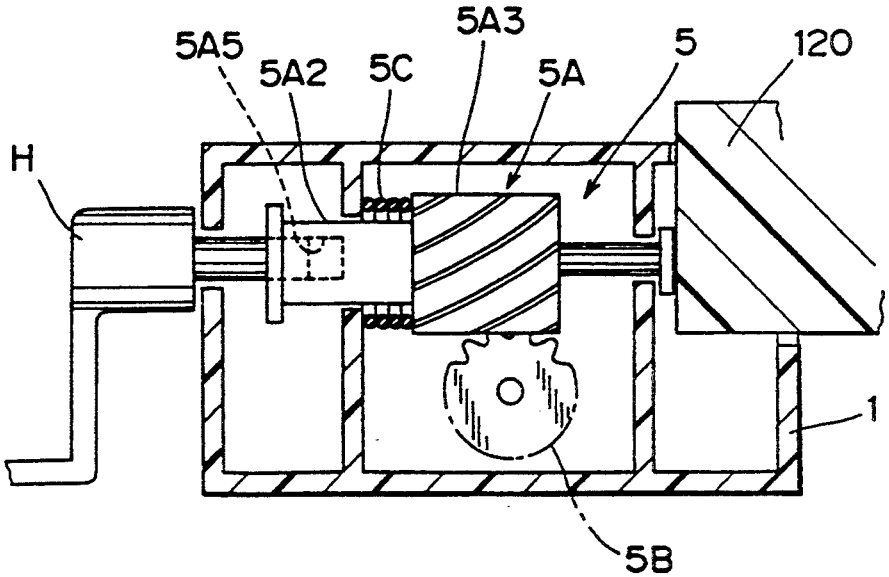

FIG. 48A and FIG. 48B relate to Embodiment 10. What differs between this embodiment and the embodiment in FIG. 45A is as follows. That is, in the embodiment in FIG. 45A, by the move of the driving gear member 5A, the engagement with the worm wheel 5*b* as the driven gear member is cleared, whereas in this embodiment, by the move of the driving gear member 5A, coupling of the driving gear member 5A and the handle H is disabled.

Referring to FIG. 48A and FIG. 48B, the driving gear member 5A is supported by the toner cartridge main body 1 so as to be capable of sliding between the position to be coupled with the hand turning handle H as shown in FIG. 48A, and the position disabled to be coupled as shown in FIG. 48B. The driving gear member 5A is, at whichever position, engaged with the worm wheel 5B. The driving gear member 5A is thrust at a position disabled to be coupled by the compression coil spring 5c. In this embodiment, unnecessary opening of the toner cartridge main body 1 is prevented, and toner scatter can be securely prevented.

Embodiment 11

Figure 49A:
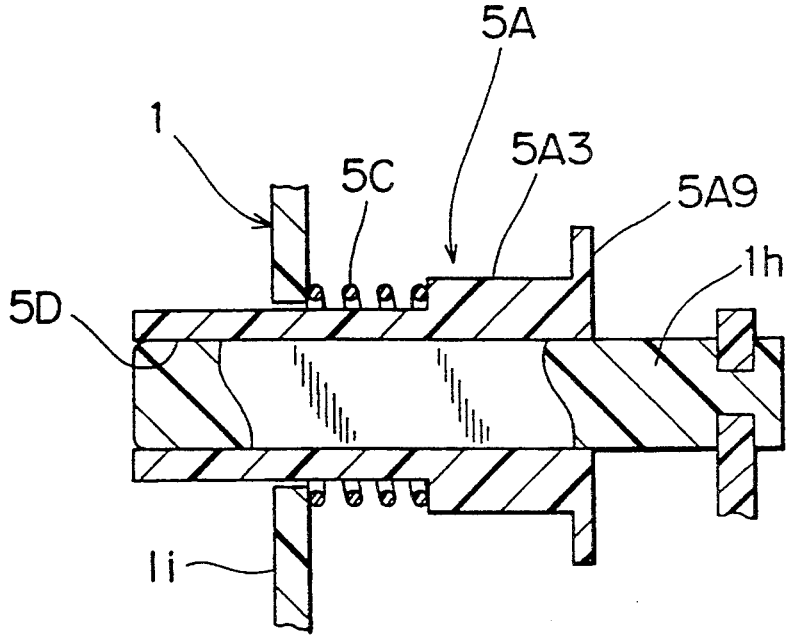
FIG. 49A and FIG. 49B are essential schematic sectional views of a toner refilling device in an eleventh embodiment of the invention, FIG. 49A showing the state before setting of toner cartridge, and FIG. 49B showing the set state of toner cartridge.
Figure 49B:
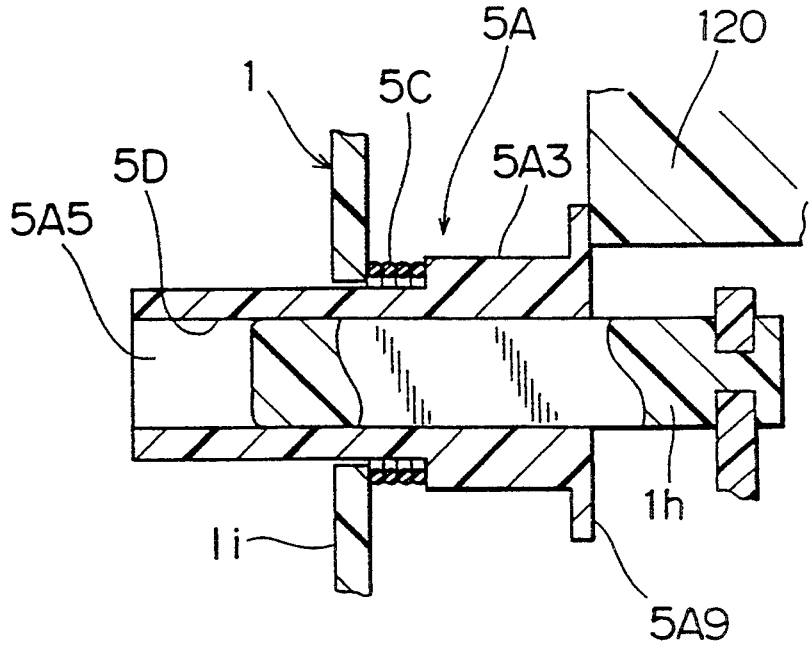

FIG. 49A and FIG. 49B show a modified example of Embodiment 10. What is characteristic of this embodiment is that the fitting hole 5A5 for fitting the handle H is not formed unless the toner cartridge TC is set in the storing recess 500 of the image forming apparatus main body G. The driving gear member 5A is composed of a box body with the square section hole 5D to be supported penetrating in the axial direction. On the outer circumference of the right side of the driving gear member 5A from the middle part in the axial direction, a worm 5A3 is formed, as being engaged with a worm wheel as driven gear member not shown in the drawing. At the right end of the driving gear member 5A, a flange 5A9 to abut against the protrusion 120 is formed.

In the hole to be supported 5D, a square section support member 1*h* rotatably supported by a rib 1*i* of the toner cartridge main body 1 is penetrating. Accordingly, the driving gear member 5A can rotate together with the support member 1*h*, and is free to slide in the axial direction as mentioned above. The driving gear member 5A slides in the axial direction, and moves relatively leftward of the support member 1*h*, and a part of the hole to be supported 5D is opened, and the fitting hole 5A5 into the handle H is formed. While the toner cartridge TC is not set in the image forming apparatus main body G, as shown in FIG. 49A, the driving gear member 5A thrust by the compression coil spring 5C is moved to the right, and the hole to be supported 5D is closed by the support member 1*h*.

In this embodiment, too, the drive transmission route can be cut off when not required, and unnecessary take-up of the seal member can be prevented.

Embodiment 12

Figure 50:
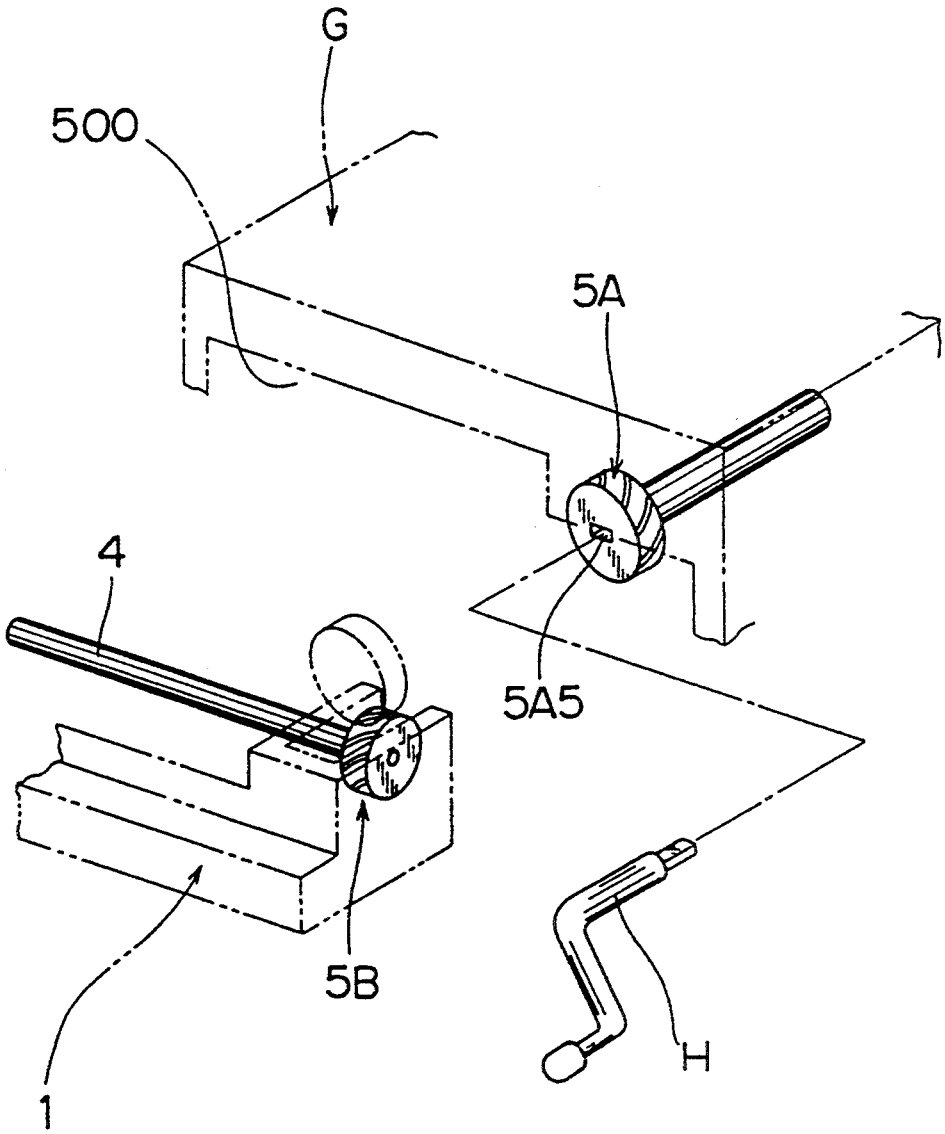
FIG. 50 is an essential schematic exploded perspective view of a toner refilling device in a twelfth embodiment of the invention.

FIG. 50 shows a further different embodiment of the invention. In this embodiment, the worm wheel 5B as the driven gear member rotating together with the take-up shaft 4 is provided on the toner cartridge main body 1, and the driving gear member 5A to be engaged with the worm wheel 5B is provided on the image forming apparatus main body G. Therefore, only when the toner cartridge TC is set in the storing recess 500, the both gear members 5A, 5B are engaged with each other so that the seal member can be taken up. In this embodiment, the route cut-off means is composed of both gear members 5A, 5B. In this embodiment, too, unnecessary take-up of the seal member 3 can be prevented, so that scatter of toner can be prevented securely.

The invention is not limited to these embodiments alone, but, for example, the gear mechanism included in the driving force transmitting means 5 may be realized by worm gear mechanism, screw gear mechanism, other skew gear mechanism, bevel gear mechanism, or other crossed shaft gear mechanism.

In Embodiments 5 to 12, the toner cartridge main body 1 may be composed in a double container structure as in Embodiments 1 to 4, and the outer seal member 40 and slide member 60 may be provided.

Besides, other modifications of the design may be possible within a range not departing from the true spirit of the invention.

What is claimed is:

1. A toner cartridge, detachably settable in a storing recess of an image forming apparatus main body, for containing toner to be supplied in a predetermined part of the image forming apparatus, said toner cartridge comprising:

a toner cartridge main body for containing toner, said toner cartridge main body having a toner dropping opening in a lower surface thereof, an inner seal member, in a sheet form, for closing said toner dropping opening, said inner seal member being peelably attached to said lower surface of said toner cartridge main body, take-up means for opening said toner dropping opening by selectively peeling said inner seal member by taking up said inner seal member, an outer seal member, in a sheet form, capable of sealing said toner dropping opening, said outer seal member being slidably provided beneath said inner seal member along said lower surface of said toner cartridge main body, and outer seal member operating means, engaable with engaging means provided on the image forming apparatus main body, for operating said outer seal member to close said toner dropping opening when said toner cartridge main body is drawn out from the storing recess and said outer seal member operating means engages with the engaging means.

2. A toner cartridge according to claim 1, wherein said toner cartridge main body includes an inner container containing toner, and an outer container containing said inner container.

3. A toner cartridge according to claim 2, wherein said outer container includes a pair of casings which are coupled with each other to make up said outer container.

4. A toner cartridge according to claim 3, wherein said pair of casings fits into the other.

5. A toner cartridge according to claim 4, wherein said pair of casings consist of an upper casing and a lower casing, said inner container has a tongue on a side surface thereof, and said tongue of said inner container is pinched in interconnecting parts of said upper and lower casings, whereby said inner container becomes fixed to said outer container when said inner container is brought into a predetermined position with respect to said outer container.

6. A toner cartridge according to claim 2, wherein said take-up means is contained in a space defined by an inner surface of said outer container and an outer surface of said inner container.

7. A toner cartridge according to claim 2, wherein said outer seal member is contained inside of a space defined by an inner surface of said outer container and an outer surface of said inner container when said toner cartridge main body has been set in the storing recess of the image forming apparatus main body.

8. A toner cartridge according to claim 7, wherein said outer seal member is composed of an elastic sheet member, and when said outer seal member is in said defined space, said toner dropping opening is open, and when said toner cartridge main body is drawn out from the storing recess, said outer seal member is drawn out from said defined space to cover said toner dropping opening by a interaction between said outer seal member operating means and said engaging means.

9. A toner cartridge according to claim 8, wherein said outer seal member is guided and inverted by said take-up means.

10. A toner cartridge according to claim 2, wherein said toner cartridge main body is capable of containing a motor for driving said take-up means in a space defined by an inner surface of said outer container and an outer surface of said inner container.

11. A toner cartridge according to claim 2, further comprising:

a toner feed tube formed at an end portion of said inner container, an inside of said toner feed tube communicating with an inside of said inner container, and a front end portion of said toner feeding tube penetrating through an end portion of said outer container, and a plug for closing said front end portion of said toner feed tube after toner is supplied to the inside of said inner container through said toner feed tube.

12. A toner cartridge according to claim 1, wherein said take-up means includes a take-up shaft disposed orthogonally to a withdrawal direction of said toner cartridge, and one end of said inner seal member is fixed to said take-up shaft.

13. A toner cartridge according to claim 12, wherein said take-up shaft includes a drive coupling part for coupling to an external driving member.

14. A toner cartridge according to claim 12, further comprising:

driving force transmitting means for transmitting driving force from an external driving member to said take-up shaft, said driving force transmitting means including a first drive coupling part to be coupled with an external driving member and a second drive coupling part capable of coupling with said take-up shaft.

15. A toner cartridge according to claim 14, wherein said driving force transmitting means includes a crossed axes gear mechanism.

16. A toner cartridge according to claim 14, wherein said driving force transmitting means includes a skew gear mechanism.

17. A toner cartridge according to claim 16, wherein said skew gear mechanism includes a worm gear mechanism.

18. A toner cartridge according to claim 17, wherein said worm gear mechanism includes:

a worm mounted on a shaft member which has said first drive coupling part and which extends along said withdrawal direction of said toner cartridge, and a worm wheel mounted on said take-up shaft to be engaged with said worm.

19. A toner cartridge according to claim 16, wherein said skew gear mechanism includes a crossed helical gear mechanism.

20. A toner cartridge according to claim 1, wherein said outer seal member operating means includes a slide member which is fixed to one end of said outer seal member, and is movable along said lower surface of said toner cartridge main body.

21. A toner cartridge according to claim 20, wherein said toner cartridge main body includes guide means for slidable guiding said slide member along said lower surface of said toner cartridge main body.

22. A toner cartridge according to claim 21, wherein said slide member has end portions, said slide member being disposed orthogonally to said withdrawal direction of said toner cartridge, and said guide means includes guide grooves formed between a lower edge of said inner container and a confronting lower edge of said outer container, said end portions of said slide member being insertable in said guide grooves.

23. A toner cartridge according to claim 22, wherein said outer seal member has side edges along said guide grooves, and said side edges of said outer seal member are guided by said guide grooves.

24. A toner cartridge according to claim 22, wherein said guide grooves include slide member movement restricting means for restricting movement of said slide member when said outer seal member has covered said toner dropping opening.

25. A toner cartridge according to claim 20, wherein said slide member includes closing engagement means for engaging with the engaging means provided on the image forming apparatus main body, whereby, when drawing out said toner cartridge, the engaging means pushes said slide member to slide said outer seal member relative to said toner cartridge main body so as to cover said toner dropping opening with said outer seal member.

26. A toner cartridge according to claim 25, wherein said toner cartridge main body includes:

closing position stopper means for releasing an engagement of said closing engagement means of said slide member with the engaging means provided on the image forming apparatus main body by restraining movement of said slide member when said toner dropping opening is covered by said outer seal member, and when said toner cartridge is drawn out from the storing recess.

27. A toner cartridge according to claim 26, wherein said toner dropping opening is covered with said outer seal member before setting said toner cartridge in the storing recess of the image forming apparatus main body, and said slide member includes opening engagement means for engaging with opening means provided on the image forming apparatus main body, whereby, when setting said toner cartridge in the storing recess, the opening engaging means pushes said slide member to slide said outer seal member relative to said toner cartridge main body so as to uncover said toner dropping opening.

28. A toner cartridge according to claim 27, wherein said toner cartridge main body includes:

opening position stopper means for causing said opening engagement means of said slide member to engage with the opening means provided on the image forming apparatus main body by restraining movement of said slide member when said toner dropping opening is not covered by said outer seal member while setting said toner cartridge in the storing recess.

29. A toner refilling device for refilling a predetermined portion of an image forming apparatus main body with toner by a toner cartridge that contains toner and is detachably settable in a storing recess of the image forming apparatus main body, said refilling device comprising:

a toner cartridge main body for containing toner and, said main body having a toner dropping opening in a lower surface thereof, an inner seal member, in a sheet form, for closing said toner dropping opening, said inner seal member being peelably adhered to said lower surface of said toner cartridge main body, take-up means, provided inside said toner cartridge main body, for opening said toner dropping opening by selectively peeling said inner seal member by taking up said inner seal member, an outer seal member, in a sheet form, capable of sealing said toner dropping opening, said outer seal member being slidably provided beneath said inner seal member along said lower surface of said toner cartridge main body, closing engaging means for operating said outer seal member to close said toner dropping opening and being provided on the image forming apparatus main body, and outer seal member operating means, provided on said toner cartridge main body so as to be engaged with said closing engaging means, for operating said outer seal member to close said toner dropping opening when said toner cartridge main body is drawn out of the storing recess with said outer seal member operating means being engaged with said closing engaging means.

30. A toner refilling device according to claim 29, wherein said outer seal member operating means includes a slide member having closing engagement means for engaging with said closing engaging means provided on the image forming apparatus main body, said slide member being movable along said lower surface of said toner cartridge main body and being fixed to one end of said outer seal member, and said closing engaging means is provided on a movable member which is free to move between a position advancing into an inside of the storing recess of the image forming apparatus main body and a position retreating from the inside thereof, and is urged to said advancing position by urging means.

31. A toner refilling device according to claim 30, wherein said movable member is provided with a guide portion for guiding said closing engagement means of said slide member into engagement with said closing engaging means when setting the toner cartridge in the storing recess.

32. A toner refilling device according to claim 29, further comprising opening engaging means, provided on the image forming apparatus main body, for operating said outer seal member to open said toner dropping opening, and wherein said outer seal member operating means includes a slide member having opening engagement means for engaging with said opening engaging means to operate said outer seal member to open said toner dropping opening during setting of the toner cartridge in the storing recess of the image forming apparatus main body.

33. A toner refilling device according to claim 32, wherein said closing engaging means and said opening engaging means are composed of a pair of angle-shape sloped surfaces.

34. A toner refilling device for refilling a predetermined part of an image forming apparatus main body with toner, by a toner cartridge that contains toner and is detachably settable in a storing recess of the image forming apparatus main body, said refilling device comprising:

a toner cartridge main body for containing toner, said main body having a toner dropping opening in a lower surface thereof, a seal member, in a sheet form, for sealing said toner dropping opening, said seal member being peelably adhered to said lower surface of said toner cartridge main body, take-up means, provided inside said toner cartridge main body, for opening said toner dropping opening by selectively peeling said seal member by taking up said seal member, driving force transmitting means, including a first drive coupling part adapted to be coupled with an external driving member and a second drive coupling part adapted to be coupled with said take-up means, for transmitting the driving force from an external driving member to said take-up means, and route cut-off means for cutting off a driving force transmitting route from an external driving member to said take-up means through said driving force transmitting means when the toner cartridge has not been set in the storing recess.

35. A toner refilling device according to claim 34, further comprising:

releasing means for terminating cutting off of the driving force transmitting route by said route cut-off means, and wherein i) said driving force transmitting means is provided on said toner cartridge main body, ii) said toner cartridge main body has a driving member insertion hole for insertion of an external driving member to couple an external driving member with said first drive coupling part of the driving force transmitting means, iii) said route cut-off means includes a shutter member being capable of opening and closing said driving member insertion hole, and being set in a closed state while said toner cartridge is brand-new, and iv) said releasing means is provided on the image forming apparatus main body so as to release said shutter member from said closed state upon completion of setting of the toner cartridge in the storing recess.

36. A toner refilling device according to claim 35, wherein said shutter member includes:

a sheet member possessing a restricted end fixed to said toner cartridge main body, and a free end slidable along an inner surface of said toner cartridge main body, said free end being slidable between a closed position for obstructing said driving member insertion hole and an open position for opening said driving member insertion hole, and said releasing means includes:

a push rod for deflecting a part of said sheet member upon completion of setting of the toner cartridge in the storing recess, thereby causing said free end of said sheet member to slide to said open position.

37. A toner refilling device according to claim 36, further comprising:

urging means for urging said free end of said sheet member to said closed position.

38. A toner refilling device according to claim 34, further comprising:

releasing means for terminating cutting off of the driving force transmitting route by said route cut-off means, and wherein said driving force transmitting means is provided on said toner cartridge main body, and includes:

a driven gear member rotatable with said take-up means, and a driving gear member composing said route cut-off means, and being movable between an engaging position with said driven gear member and an disengaging position, said releasing means being provided on the image forming apparatus main body for moving said driving gear member to said engaging position upon completion of setting of the toner cartridge in the storing recess.

39. A toner refilling device according to claim 38, further comprising:

holding means for holding said driving gear member at said disengaging position.

40. A toner refilling device according to claim 39, wherein said holding means includes urging means.

41. A toner refilling device according to claim 40, wherein said urging means includes an elastic rib formed in said toner cartridge main body.

42. A toner refilling device according to claim 40, wherein said urging means includes a coil spring interposed between said toner cartridge main body and said driving gear member.

43. A toner refilling device according to claim 39, wherein said holding means includes a wedge protrusion engaged with an edge of an insertion hole of said toner cartridge main body with a specified engaging force, said wedge protrusion being disposed on a gear shaft of said driving gear member which is inserted through said insertion hole, and said operating means clears an engagement of said wedge protrusion and said edge of said insertion hole to move said driving gear member to said engaging position.

44. A toner refilling device according to claim 43, wherein said gear member receives a reaction force along said gear shaft when taking up said seal member, said gear shaft of said driving gear member is provided with another wedge protrusion, which is engaged with said edge of said insertion hole of said toner cartridge main body with a specified engaging force when said driving gear member is at said engaging position for holding said driving gear member at said engaging position, and said reaction force acting on said gear member increases when a rotation of said driving gear member is restrained upon termination of taking-up of said seal member, thereby clearing an engagement of said another wedge protrusion with said edge of said insertion hole to move said driving gear member along said gear shaft so as to cancel an engagement of said driving gear member and said driven gear member.

45. A toner refilling device according to claim 34, further comprising:

releasing means for terminating cutting off of the driving force transmitting route by said route cut-off means, and wherein i) said driving force transmitting means includes a member forming said first drive coupling part and composing said route cut-off means, said member being movable between a coupling position where said first drive coupling part can be coupled with an external driving member and an uncoupling position where said first drive coupling part cannot be coupled with an external driving member, and ii) said releasing means is provided on the image forming apparatus main body, for moving said member forming said first drive coupling part to said coupling position upon completion of setting of the toner cartridge in the storing recess.

46. A toner refilling device according to claim 45, further comprising:

holding means for holding said member forming said first drive coupling part at said uncoupling position.

47. A toner refilling device according to claim 46, wherein said holding means includes urging means.

48. A toner refilling device according to claim 47, wherein said urging means includes an elastic rib formed in said toner cartridge main body.

49. A toner refilling device according to claim 47, wherein said urging means includes a coil spring.

50. A toner refilling device according to claim 34, wherein said driving force transmitting means includes:

a first member possessing an insertion hole, and a second member movably inserted in said insertion hole of said first member, and wherein said second member is movable relative to said first member in said insertion hole between a first position for prohibiting coupling of an external driving member with said first drive coupling part and a second position for allowing coupling of an external driving member with said first drive coupling part.

51. A toner refilling device according to claim 50, wherein said first drive coupling part is provided by said insertion hole of said first member.

52. A toner refilling device according to claim 50, wherein said first drive coupling part is provided by a front end of said second member, said front end projecting from said insertion hole of said first member when said second member is at said second position.

53. A toner refilling device according to claim 34, wherein said driving force transmitting means includes:

a driven gear member rotatable together with said take-up means, and being provided in said toner cartridge main body, and a driving gear member which is engaged with said driven gear member when the toner cartridge has been set in the storing recess, said driving gear member being provided in the image forming apparatus main body, and said route cut-off means includes said driven gear member and said driving gear member.

54. A toner refilling device according to claim 34, further comprising:

releasing means for terminating cutting off of the driving force route by said route cut-off means, and wherein said driving force transmitting means includes a member forming said second drive coupling part for said take-up means, said member being movable between a coupling position where said second drive coupling part is coupled with said take-up means, and an uncoupling position where said second drive coupling part is not coupled with said take-up means, and said releasing means includes interlocking means for moving said member forming said second drive coupling part to said coupling position in cooperation with closing of a lid for opening and closing an inlet of the storing recess of the image forming apparatus main body.

55. A toner refilling device according to claim 54, wherein said interlocking means includes:

first urging means for urging said member forming said second drive coupling part to said coupling position, and wherein said route cut-off means includes a lock member movable between a locking position for holding said member forming said second drive coupling part at said uncoupling position by advancing between said member forming said second drive coupling part and said take-up means, and an unlocking position wherein said lock member is retreated from said locking position, and second urging means for urging said lock member to said locking position, and wherein said interlocking means further includes a lock member driving part for moving said lock member to said unlocking position in cooperation with closing said lid.

56. A toner refilling device according to claim 55, wherein said lock member driving part is provided with an insertion hole for insertion of said member forming said second drive coupling part to allow said lock member to move to said unlocking position.

57. A toner refilling device for refilling a predetermined part of an image forming apparatus main body with toner, by a toner cartridge that contains toner and is detachably settable in a storing recess of the image forming apparatus main body, said refilling device comprising:

a toner cartridge main body for containing toner, said main body having a toner dropping opening in a lower surface thereof, a seal member, in a sheet form, for closing said toner dropping opening, said seal member being peelably adhereable to said lower surface of said toner cartridge main body, take-up means provided inside said toner cartridge main body for opening said toner dropping opening by selectively peeling said seal member by taking up said seal member, driving force transmitting means including a drive coupling part adapted to be coupled with an external driving member for transmitting driving force from an external driving member to said take-up means, route cut-off means for cutting off a driving force transmitting route from an external driving member to said take-up means through said driving force transmitting means when the toner cartridge is not set in the storing recess, and releasing means for terminating cutting off of said driving force transmitting route by said route cut-off means, said driving force transmitting means including a drive coupling part for said take-up means, said drive coupling part being movable between a coupling position with said take-up means, and an uncoupling position, and said releasing means including interlocking means for moving said drive coupling part to said coupling position in cooperation with closing of a lid that opens and closes an inlet of the storing recess of the image forming apparatus main body.

58. A toner refilling device of claim 57, wherein said interlocking means includes:

first urging means for urging said drive coupling part to said coupling position, and wherein said route cut-off means includes a lock member movable between a locking position for holding said coupling part at said uncoupled position by advancing between said drive coupling part and said take-up means, and an unlocking position wherein said lock member has retreated from said locking position, second urging means for urging said locking member to said locking position, and wherein said interlocking means further includes a lock member driving part for moving said lock member to said unlocking position in cooperation with closing the lid.

59. A toner refilling device of claim 58, wherein said lock member driving part is provided with an insertion hole for insertion of said drive coupling part during moving of said lock member to said unlocking position.

* * * * *